US011524206B2

(12) United States Patent
Ellis

(10) Patent No.: US 11,524,206 B2
(45) Date of Patent: Dec. 13, 2022

(54) UPPER AND LOWER BODY PUSH AND PULL EXERCISE MACHINE WITH A ONE DIRECTIONAL RESISTANCE MECHANISM AND ADJUSTABLE ANGLE

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 24 days.

(21) Appl. No.: 16/876,239

(22) Filed: May 18, 2020

(65) Prior Publication Data

US 2020/0276471 A1 Sep. 3, 2020

Related U.S. Application Data

(63) Continuation-in-part of application No. 15/848,656, filed on Dec. 20, 2017, now Pat. No. 10,653,914, which is a continuation-in-part of application No. 14/840,776, filed on Aug. 31, 2015, now Pat. No. 9,873,016.

(51) Int. Cl.

| | |
|---|---|
| ***A63B 22/00*** | (2006.01) |
| ***A63B 21/00*** | (2006.01) |
| ***A63B 21/22*** | (2006.01) |
| ***A63B 22/20*** | (2006.01) |
| ***A63B 24/00*** | (2006.01) |

(52) U.S. Cl.

CPC .... *A63B 22/0046* (2013.01); *A63B 21/00069* (2013.01); *A63B 21/154* (2013.01); *A63B 21/157* (2013.01); *A63B 21/225* (2013.01); *A63B 21/4034* (2015.10); *A63B 21/4035* (2015.10); *A63B 22/001* (2013.01); *A63B 24/0087* (2013.01); *A63B 2022/206* (2013.01)

(58) Field of Classification Search

CPC ..... A63B 23/03575–03591; A63B 23/0216

See application file for complete search history.

(56) References Cited

U.S. PATENT DOCUMENTS

| | | | |
|---|---|---|---|
| 4,848,737 | A | 7/1989 | Ehenfield |
| 5,370,594 | A | 12/1994 | Grinblat |
| 5,518,483 | A | 5/1996 | Oswald |
| 5,554,086 | A | 9/1996 | Habing |
| 5,569,132 | A | 10/1996 | Wu |
| 5,580,340 | A | 12/1996 | Yu |
| 6,264,588 | B1 | 7/2001 | Ellis |

(Continued)

*Primary Examiner* — Nyca T Nguyen

(74) *Attorney, Agent, or Firm* — Smith Tempel Blaha LLC; Laurence P. Colton

(57) ABSTRACT

An upper and lower body push and pull exercise machine with a rotatable one directional resistance mechanism and adjustable angle having a movable user support frame having a forward end and a rearward end and the rearward end is pivotable relative to the floor, an angle adjusting mechanism, movable lower body user supports having a foot support platform and a shin support pad operatively connected to the movable user support frame; movable upper body user supports having a gripping handle operatively connected to the movable user support frame, a linkage assembly operatively connected to all of the user supports, a rotatable one direction resistance mechanism operatively connected to the upper and lower body user supports for creating resistance to the exercise motion of the user supports, and a resistance mechanism drive assembly operatively connecting all of the user supports to the rotatable one direction resistance mechanism.

6 Claims, 40 Drawing Sheets

(56) References Cited

U.S. PATENT DOCUMENTS

| | | | |
|---|---|---|---|
| 6,287,241 | B1 | 9/2001 | Ellis |
| 6,361,476 | B1 | 3/2002 | Eschenbach |
| 7,104,933 | B1 | 9/2006 | Liao |
| 7,220,221 | B2 | 5/2007 | Moismann |
| 7,232,404 | B2 | 6/2007 | Nelson |
| 7,244,217 | B2 | 7/2007 | Rodgers, Jr. |
| 7,335,140 | B2 | 2/2008 | Webber |
| 7,455,633 | B2 | 11/2008 | Brown |
| 7,585,263 | B2 | 9/2009 | Brown |
| 7,594,880 | B2 | 9/2009 | Webber |
| 7,611,446 | B2 | 11/2009 | Chuang |
| 7,662,076 | B1 | 2/2010 | Ho |
| 7,727,128 | B2 | 6/2010 | Gianneli |
| 7,731,638 | B2 | 6/2010 | Webber |
| 7,780,585 | B1 | 8/2010 | Rivas |
| 7,833,143 | B1 | 11/2010 | Tsai |
| 7,867,149 | B1 | 1/2011 | Webber |
| 7,963,890 | B2 | 6/2011 | Webber |
| 8,025,609 | B2 | 9/2011 | Gianneli |
| 8,162,807 | B1 | 4/2012 | Webber |
| 8,172,732 | B1 | 5/2012 | Webber |
| 8,317,665 | B2 | 11/2012 | Webber |
| 8,888,661 | B2 | 11/2014 | Ellis |
| 9,649,529 | B1 | 5/2017 | Miller |
| 2002/0013199 | A1 | 1/2002 | Gianneli |
| 2002/0019298 | A1 | 2/2002 | Eschenbach |
| 2005/0148438 | A1 | 7/2005 | Carlsen |
| 2009/0247370 | A1 | 10/2009 | Stearns |
| 2010/0048367 | A1 | 2/2010 | Kiang |
| 2010/0311555 | A1 | 12/2010 | Campanaro |
| 2011/0028283 | A1 | 2/2011 | Webber |
| 2013/0331238 | A1 | 12/2013 | Ellis |
| 2015/0182787 | A1 | 7/2015 | Liu |
| 2015/0283425 | A1* | 10/2015 | Zhou ..... A61B 5/222 482/56 |
| 2015/0343250 | A1 | 12/2015 | Lagree |
| 2016/0213970 | A1 | 7/2016 | Eschenbach |
| 2017/0157460 | A1 | 6/2017 | Lin |
| 2017/0296865 | A1 | 10/2017 | Lagree |

* cited by examiner

UPPER AND LOWER BODY PUSH AND PULL EXERCISE MACHINE WITH A ONE DIRECTIONAL RESISTANCE MECHANISM AND ADJUSTABLE ANGLE

STATEMENT OF RELATED APPLICATIONS

This patent application claims priority on and the benefit of U.S. patent application Ser. No. 15/848,656 having a filing date of 20 Dec. 2017, which claims priority on and the benefit of U.S. patent application Ser. No. 14/840,776 having a filing date of 31 Aug. 2015.

BACKGROUND OF THE INVENTION

Technical Field

This invention relates to the general technical field of physical fitness and exercise equipment and machines. This invention relates more specifically to the field of exercise equipment for concurrently exercising the user's upper and lower body by performing reciprocating left side and right side pushing and pulling motions resisted by a one directional resistance mechanism.

Prior Art

Exercise, physical fitness and physical therapy equipment and machines are available in various configurations and for various purposes, and are available for all of the major muscle groups. In the general exercise equipment field, there are generally two categories of machines. One category of machines known as strength or anaerobic training machines are geared more towards lower repetition, shorter duration and higher resistance exercises and there are many configurations of strength training machines that exercise a specific muscle group or set of muscle groups. A second category commonly known as cardiovascular or aerobic training machines are generally geared towards longer duration, lower resistance and higher repetition exercise.

There are many configurations of cardiovascular training machines that exercise a specific muscle group or set of muscle groups such as treadmills, stationary bikes, stair climbing machines, ladder climbing machines, elliptical striding machines, arcing strider machines and other specialized machines. Many of these machines incorporate a rotational reciprocating crank component into the motion that defines and controls the range of motion. This reciprocating close loop crank requires the user regardless of size or capabilities to follow that full range of motion to operate the machine. This fixed range of circular crank motion also allows the machine to create momentum during operation of the machine and does not require adequate sustained effort from the user to keep the machine moving. Moreover, these machines that incorporate a rotational reciprocating motion into the mechanical features of the machine require the user to follow the complete closed loop range of motion predetermined by the machine because at least a portion of the linkage travels in an endless circular path. Therefore, many of these rotational linkage reciprocating motion machines require additional components to make the range of motion of the arc or ellipse adjustable to fit users of various sizes and with various capabilities. Also, most of these machines position the user in a mostly vertical orientation allowing the user to simply shift their weight from side to side to operate the machine as opposed to being able to get into an angular more powerful forward leaning position to drive the foot pedals and handles forward while operating the machine.

An improved exercise machine would incorporate the benefits of both cardiovascular and strength training machines into a single exercise motion that concurrently engage a user's upper and lower body muscle groups with resisted pushing and pulling motions while allowing the user to define the range of motion of the foot pedals and handles and engage pushing and pulling force into the resistance mechanism without creating reciprocal momentum and simulate multiple exercises including climbing, hiking, running and crawling.

Other machines have been developed that concurrently engage a user's upper and lower body into one exercise motion but all of these machines have various deficiencies as described in the previous paragraph when compared to the present invention disclosed herein.

U.S. Pat. No. 6,361,476 of Eschenbach illustrates an elliptical exercise striding machine with individual left and right foot pedals, each movably mounted to and dependently connected by an adjustable rotational crank arm assembly proximal to a first end and supported by either a rolling wheel or pivoting handle linkage proximal to a second end. During operation of the machine, the foot pedals move dependently in a rotating ellipse with a closed loop range of motion and can be adjusted in stride length and the shape or motion pattern of the elliptical motion can be adjusted. The left-side foot pedals and handles and right-side foot pedals and handles are dependently connected in opposing positions of the range of motion and move in unison. This closed loop range of motion of the elliptical pattern requires the user to follow the machines complete range of motion requiring the range of motion to be adjustable to fit various size users with various capabilities adding additional components and wear components to the cost of the machine. This closed loop motion also creates momentum that decreases the force required by the user to keep the machine moving. It also prevents short burst of high force motions without increasing the speed of the motion of the foot pedals and handles. This causes the machine to create an exercise that is mostly aerobic versus a machine that can create both aerobic and anaerobic exercises.

U.S. Pat. No. 8,025,609 of Giannelli et al. illustrates a striding exercise machine comprising a pair of pivotally supported individual foot pedals that are dependently linked together through a rotational crank assembly and move in unison in a back and forth fixed range of motion arcuate path with the arcuate path being adjustable to a selected segment. The apparatus includes handles or arms interconnected or interlinked to the foot pedals for upper body pushing or pulling energy input. The handles or arms pivot together with and in the same back and forth direction as the pedals to which they are inter-linked and the left-side pedals and arms are in an opposing position of the range of motion as the right said pedals and arms. The motions of the pedals and handles or arms are controlled by a circular rotating crank linkage assembly. This closed loop range of motion of the elliptical pattern requires the user to follow the machine linkage's complete circular range of motion requiring the range of motion to be adjustable to fit users of various sizes and capabilities. Adding this adjustment feature to the machine is costlier to produce and creates additional wear components. This closed loop motion of the pedals and handles also prevents short burst of high force motions without increasing the speed of the motion of the foot pedals and handles. This causes the machine to create an exercise that is mostly aerobic versus a machine that can create both aerobic and anaerobic exercises.

US Patent Publication No. 2009/0247370 of Stearns et al. illustrates an elliptical striding machine comprising opposing left and right crank assemblies mounted to the base frame about a common axis. Left- and right-side foot support linkages are supported proximal to a first end by a movable rocker shaft that is mounted on opposing ends to the left- and right-side crank assemblies. Said left and right foot support linkages are operatively linked to and supported by left- and right-side handle bars that are pivotally mounted to an upper portion of the stationary frame. The rotating rocker support shaft and linkage assembly are configured such that the left foot support and left handle bar assembly are 180 degrees out of phase with the right foot support and right handle bar assembly such that the left- and right-side user engagement features are opposing in the range of motion of the machine and remain as such during operation of the machine. Left- and right-side draw bars are pivotally mounted at a first end to an upper portion of the stationary main frame and movably mounted at a second end to the left- and right-side crank assemblies such that the draw bars can be adjusted to alter the range of motion and shape of the elliptical motion of the foot pedal assemblies during operation of the machine. The motions of the left- and right-side foot support and handle bar assemblies are controlled by the closed loop circular rotating motion of the left- and right-side cranks and rocker shaft assembly such that the left- and right-side foot support assemblies are geometrically opposed along the shape of the elliptical motion path and remain that way during operation of the machine. This closed loop range of motion of the elliptical pattern requires the user to follow the machines complete range of motion requiring the range of motion to be adjustable to fit various size users with various capabilities and these additional components of the adjustment feature increase the cost of the machine and create additional wear components. This closed loop motion of the pedals and handles also prevents short burst of high force motions without increasing the speed of the motion of the foot pedals and handles. This causes the machine to create an exercise that is mostly aerobic versus a machine that can create both aerobic and anaerobic exercises.

U.S. Pat. No. 4,848,737 of Ehrenfield illustrates a ladder climbing exercise machine comprising a stationary base frame and a pivotally supported movable ladder assembly wherein the movable ladder assembly is pivotally connected at a location proximal to a central portion of the ladder assembly to elongated support members extending upwards from the base frame such that the ladder assembly can be adjusted to various angles of vertical orientation. The ladder assembly being operatively connected to a moving retarder means for controlling the speed of movement of the ladder assembly during operation of the machine. The movement of the ladder is driven by the user's body weight as the user climbs the ladder and puts their body weight on the ladder rungs. This machine does cause the user to simultaneously lift their legs and arms in an alternating pattern as they perform a climbing motion and the entire user support can be adjusted to various angles but that angle adjustment is limited to absolute vertical and slightly off of vertical on either side of a perpendicular orientation to the base frame because the user's body weight is required to propel the motion of the ladder assembly. Moreover, the user is working against gravity by lifting their own body weight and not engaging a resistance to their movement produced by the machine. Also, the user does not constantly stay engaged with the user support components as they operate the machine. While this can be a useful exercise machine, the overall diversity is limited compared to the current invention disclosed herein.

Most users do not know how to best move their bodies on an exercise machine to get the safest and most efficient workout. However, as users come in various shapes and sizes, a machine that defines the motion path but allows the user to control the range of motion will provide the safest, most efficient and comfortable workout. Also, a machine that will allow a user to put as much pushing and pulling force into the exercise motion as they prefer but also control the speed of motion of the user engagement features will allow the user to concentrate on aerobic or anaerobic exercise conditioning or a combination of the two.

BRIEF SUMMARY OF THE INVENTION

The present invention creates multiple pushing and pulling exercises that engage various muscle groups by varying the angle of the machine from mostly vertical to mostly horizontal. The adjustable angle frame of the machine that supports the user is elongated having a forward end and rearward end and can be mounted on a stationary base frame or be connected to a lifting arm that engages the floor to adjust the angle. Mounted on the adjustable frame is a left side foot platform and shin support pad and a left side handle that are linked such that the user's left leg and left arm can push in unison or pull in unison. Also mounted on the frame is a right side foot platform and shin support pad and a right side handle that are linked such that the user's right leg and right arm can push in unison or pull in unison. The left and right side pushing and pulling assemblies are linked such that a pushing motion of one leg and arm will move concurrently with a pulling motion of the other leg and arm. The user's hands and feet move in concurrent fixed arcing paths of reciprocating pushing and pulling motions that are defined by the machine but the range of the motion is controlled by the user. Each left and right side pushing and pulling assembly cooperates with individual one directional clutches that engage and rotate a common axle that is operatively connected to a one directional rotatable resistance mechanism. The rearward portion of the machine pivots relative to the floor and the forward portion of the machine is supported by an angle adjusting device wherein the angle of the pushing and pulling motions relative to the floor is adjustable such that the user can perform a variety of exercise motions similar to climbing, hiking, running, crawling, and other exercise motions.

In each preferred embodiment of the invention the frame is capable of adjusting less than 90 degrees and is adjustable with an angle adjusting device between angles that are below one side of a vertical line and above a horizontal line such that the user is always oriented in a forward leaning exercise position. Individual left and right foot platforms and shin support pads support and brace the user's lower legs as he or she leans into the exercise motion in a position that generates maximum leverage and power. The foot support platforms and shin pads are partially supported by and move along a curved rail to mimic the natural leg motion of a pushing or pulling exercise. The individual left and right grip handles for the arm pushing and pulling motions move in pivoting arcing motions to mimic the natural arm motion of a pushing or pulling exercise. The arm and leg motions are operatively connected with a multi-link linkage system that reciprocates in a back and forth motion but does not rotate around a circular crank, which allows the user to control the range of the reciprocating motion. The individual left and right pushing and pulling arms are mounted on separate independent pivots and those separate pivots are mounted on a common lever arm that is pivotably mounted on the adjustable angle frame. This common lever arm is operatively connected to the angle adjusting mechanism such that when the user support frame is adjusted to a different angle, the arcing path of the pushing and pulling handles is concurrently adjusted to optimize the biomechanical motion of the exercise at every angle in the adjustable range of motion of the user support.

In preferred embodiments of the invention, the rotational inertia resistance mechanism can consist of a flywheel with adjustable magnetic resistance, a flywheel with an adjustable friction resistance, a fan blade air resistance, an alternator assembly, a liquid and rotational blade resistance, or combination of these mechanisms or other similar mechanisms.

In one embodiment, the invention is comprised of a stationary base frame and a movable user support frame pivotally attached to the stationary base frame at the rearward end and supported at the forward and central portion with the angle adjusting mechanism such that the angle adjusting mechanism is operatively engaged with the stationary base frame and the movable user support for adjusting the angle of the movable user support relative to the stationary base frame and the floor.

In another embodiment, the invention is comprised of a movable user support frame wherein a rearward portion of the movable frame is in pivotable contact with the floor and an elongated support arm is pivotably connected at a first end to a central or forward portion of the movable user support and the second end of the elongated support arm is in rollable contact with the floor proximal to the forward end of movable user support frame and the angle adjusting mechanism is operatively engaged with the movable user support frame and the elongated support arm for adjusting the angle of the movable user support frame relative to the floor.

In any embodiment of the invention, the rotatable one-directional resistance mechanism can be mounted on the stationary base frame, the movable user support frame, or the elongated support arm.

In all embodiments of the invention, the pushing and pulling forces exerted by the user on any or all of the user supports can be transmitted to the rotatable one direction resistance system with various components, assemblies, and mechanisms.

In any embodiment of the invention, the left and right curved rails that support the left and right foot platforms and shin support pads can be mounted on the machine in a parallel configuration or an angled configuration. In the angled configuration, the rails are more proximal to one another in the forward portion of the machine closer to the angle adjusting device and the left and right curved rails are more distal to one another in the rearward portion of the machine away from the angle adjusting device.

In any embodiment of the invention, the left and right side pushing and pulling arms can be pivotably mounted on the machine in a parallel configuration or an angled configuration. In the angled configuration the handles move towards a vertical center line of the user's body in the push direction and away from a vertical center line of the user's body in a pull direction.

Concurrent upper and lower body exercises are very beneficial forms of exercising to increase strength and flexibility of the major muscle groups as well conditioning of the cardio-pulmonary system. Most everyday human physical activities involve movement of multiple joints concurrently with engagement of multiple muscle groups moving in multiple dimensional planes of motion. Therefore, exercise machines offering multi-dimensional planes of motion will better condition the body to perform the way it naturally moves. Moreover, exercise machines that allow a user to concurrently perform pushing and pulling motions with all four limbs by reciprocating the left side limbs and the right side limbs will best strengthen a user's core torso musculature and soft tissue, which is critically important to performing a variety of physical activities.

BRIEF DESCRIPTION OF THE DRAWINGS

In some figures, the invention is illustrated from one side and in these figures the invention looks the same, but in a general mirror image, from the opposite side, with both sides having similar structures, features, and components.

DETAILED DESCRIPTION OF PREFERRED EMBODIMENTS

Figure 1:
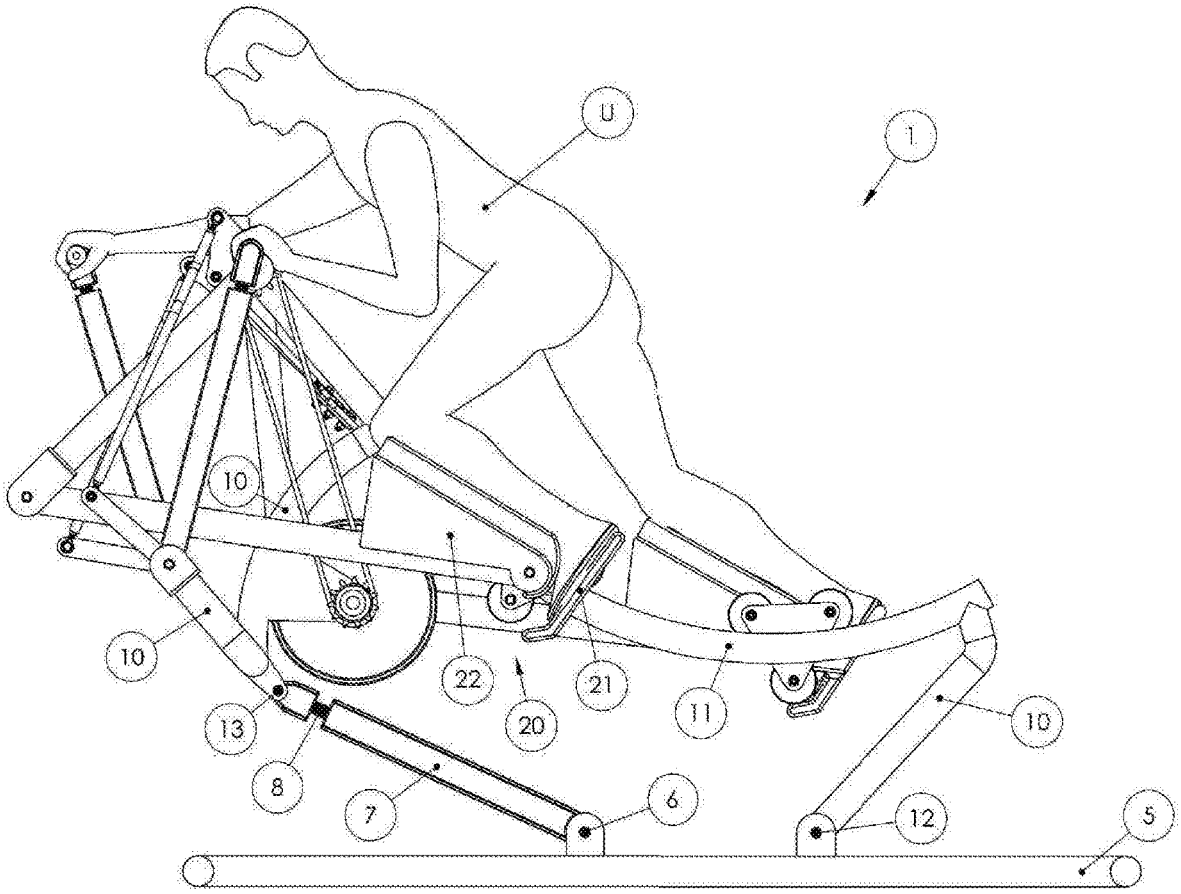
FIG. 1 is a side view of the invention at a lower angle position with a user performing a simulated crawling motion exercise.

Exemplary preferred embodiments are disclosed below in connection with the attached drawings. Throughout this specification, various terms will be used to describe various elements or sets of elements, features or sets of features, mechanisms and devices. For example, the term movable frame will refer to the frame that can change in angle and that supports the operational components of the machine. The term rearward end or portion of the machine will refer to the end or portion of the machine most near the user's feet and distal to the user's hands. The term forward end or portion of the machine will refer to the end or portion of the machine most near the user's hands and distal to the user's feet. The term linkage or linkage assembly will refer to the movable components that connect the user engage features and cooperate with the drive components and resistance components. The terms push, pushing, press, pressing, pull, or pulling when referring to the user operating the machine will be used to describe any motion or movement by a user when they are maintaining or increasing their exertion force. The term upper body will refer generally to the user's arms and hands but may also refer to the user's chest, back, and torso as well. The term lower body will generally refer to the user's legs and feet but may also refer to the user's buttocks and hips as well. The term lower legs will refer to the user's shin, ankles and feet and in some instances the user's knees. The terms limbs or extremities will refer to the user's arms and legs. The term angle adjusting mechanism will refer to any mechanism and its components that adjust the angle of the movable user support. The term pivot will refer to an axle or fastener in which a component or set of components rotate upon. The invention is comprised of many identical left and right components as illustrated in various perspective views and many of these components will frequently be referred to and described in a plural context so as to prevent the duplication of descriptions of identical left and right components.

FIGS. 1-40 are all views of embodiments of the invention this inventor refers to as "an upper and lower body push and pull exercise machine with a one directional resistance mechanism and adjustable angle". Generally, the invention is a machine for concurrently pushing with one side of the user's body while concurrently pulling with the other side of the user's body in a reciprocating back and forth motion while being resisted by a one directional resistance mechanism. The user supports are operatively connected by a multi-link linkage assembly and operate in unison such that movement of any of the user engagement components will concurrently move all of the user engagement components. All of the exercise motion components of the machine are mounted on a movable frame that in certain embodiments is pivotally mounted on a stationary base frame and in other embodiments the movable frame directly engages the floor and does not require a separate base frame. In each embodiment, the movable frame is adjustable in angle during operation of the machine such that the user can perform multiple pushing and pulling exercises at various angles relative to the stationary base frame and relative to the floor.

Referring now to FIGS. 1-14, various views of these embodiments of the machine 1 are shown to provide a more complete understanding of the invention. FIGS. 1-14 all illustrate a set of left and right curved lower body support rails 11 mounted on a rearward portion of movable frame 10. Traveling member assemblies 80 are rollably engaged with curved lower body support rails 11. Lower body user support assemblies 20 are pivotally connected to traveling member assemblies 80 with lower body user support pivots 29. Lower body user support assemblies 20 are connected to a linkages connection hubs 70 with first lower body support linkage bars 24 and second lower body support linkage bars 26. Upper body user support assemblies 30 are pivotally connected to movable frame 10 at upper body user support pivots 34 and upper body user support assemblies 30 are connected to linkages connection hubs 70 with upper body user support linkage connection flanges 35, upper body user support linkage bars 37 and linkages connection hub flanges 71. Resistance axle 41 is connected to movable frame 10 with resistance axle connection flanges 42 and linkages. Connection hubs 70 are connected to resistance mechanism 40 with resistance drive assembly 50. Rocker arm linkage assembly 60 operatively connects left lower body user support assembly 20 and left upper body user support assembly 30 to right lower body user support 60 and right upper body user support 30 such that the left and right upper and lower body user supports move in unison during operation of machine 1.

FIGS. 1-9 illustrate an embodiment of the invention wherein movable frame 10 is pivotally mounted proximal to a rearward end proximal to a rearward end of stationary base frame 5 with movable frame base pivot 12. Movable frame 10 is pivotally connected proximal to a forward end at angle adjusting device upper pivot 13 such that angle adjusting device 7 supports the forward portion of movable frame 10 and angle adjusting device 7 adjusts the angle of movable frame 10 by extending and contracting angle adjusting shaft 8 causing movable frame 10 to pivot about movable frame base pivot 12 such that the angle of movable frame 10 increases or decreases relative to stationary base frame 5 and the floor.

FIGS. 10-13 illustrate an embodiment of the invention wherein the rearward portion of movable frame 10 is in direct contact with the floor and pivots on movable frame foot 9. A central portion of movable frame 9 is connected to and pivots on angle adjusting support arm pivot 19 and a forward portion of movable frame 10 is connected to and pivots on angle adjusting device upper pivot 13. Angle adjusting device 7 is pivotally connected to angle adjusting support arm 16 at angle adjusting device lower pivot 6. Angle adjusting support arm cross brace 17 is connected in a perpendicular configuration at a central location to a forward end of angle adjusting support arm 16. An angle adjusting support arm wheel 18 is connected to each end of angle adjusting support arm cross brace 17. Angle adjusting support arm wheels 18 are in rollable contact with the floor. Angle adjusting support arm wheels 18 roll forward when the angle of movable frame 10 is decreasing relative to the floor as movable frame 10 pivots about movable frame foot 9. Angle adjusting support arm wheels 18 roll rearward when the angle of movable frame 10 is increasing relative to the floor as movable frame 10 pivots about movable frame foot 9.

Figure 13:
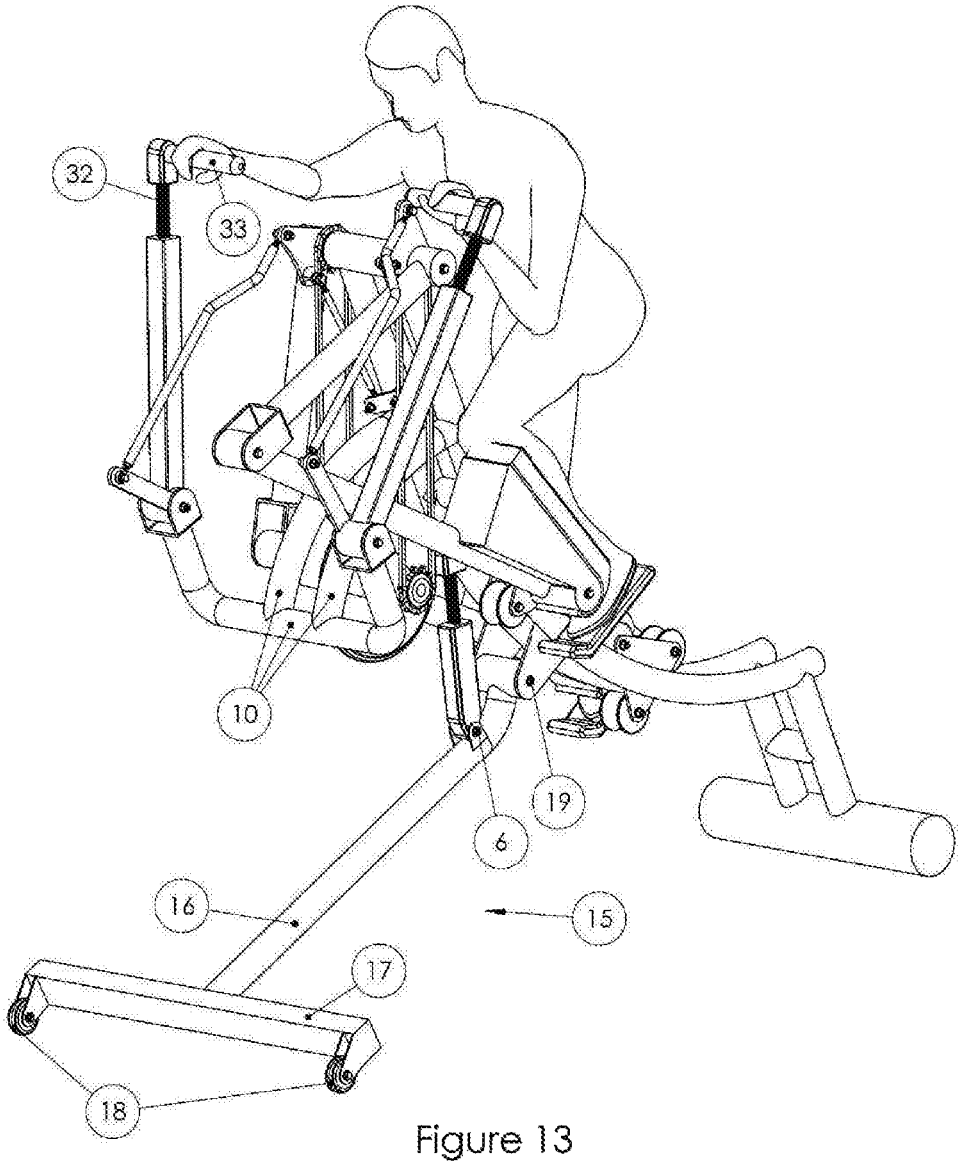
FIG. 13 is a front perspective view of the invention a mid-point angle position with a user performing a simulated hill climbing exercise.
Figure 14:
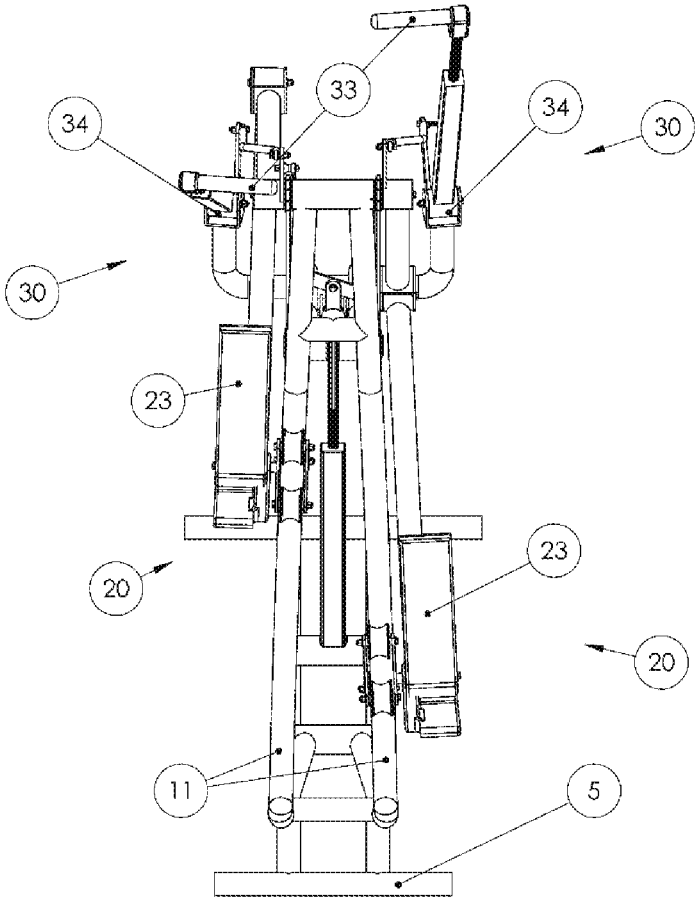
FIG. 14 is a rear view of the invention at a higher angle position with converging and diverging lower body supports and converging and diverging push and pull arms.
Figure 15:
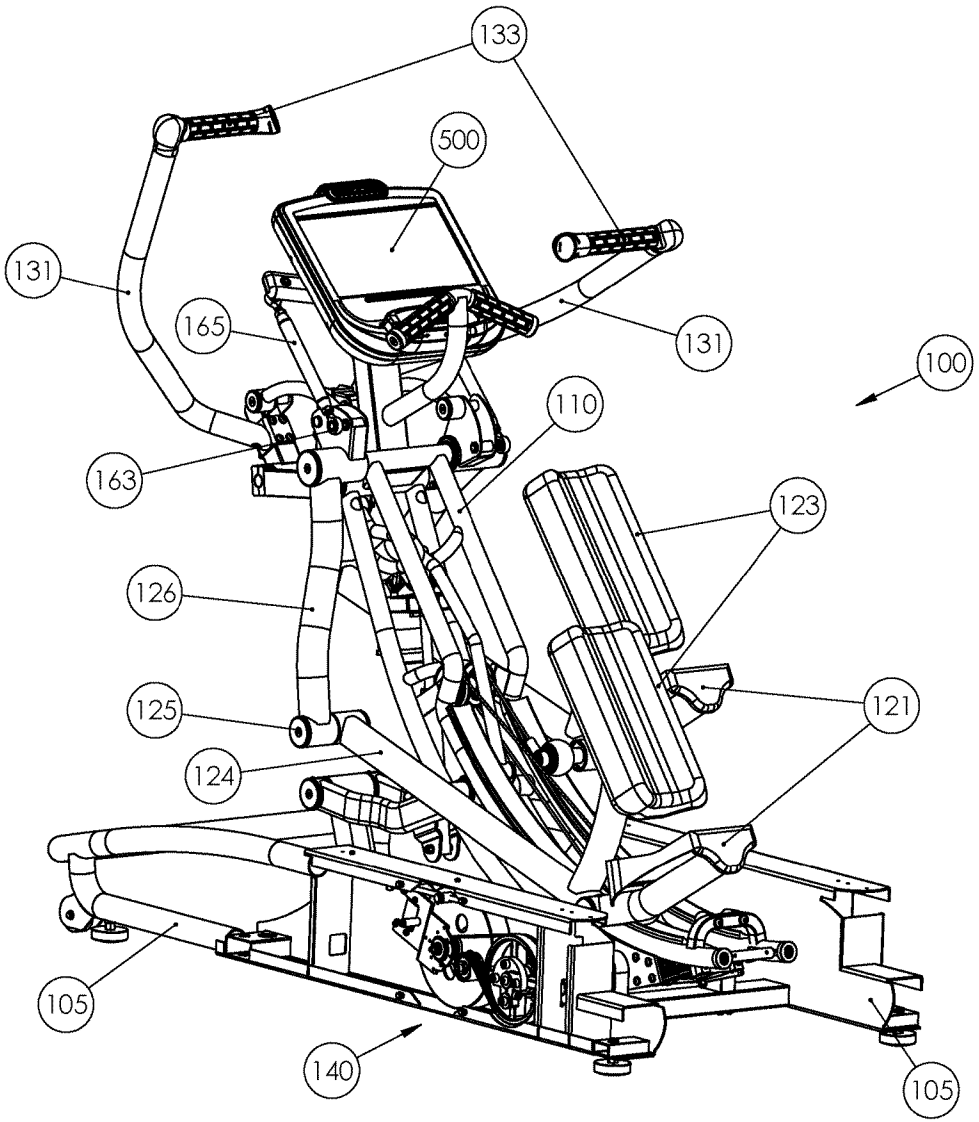
FIG. 15 is a left side perspective view of the invention at a higher angle position with an electrical angle adjustment mechanism.

FIG. 14 illustrates alternative configurations to the pushing and pulling motions of machine 1. FIGS. 1-13 illustrate the invention wherein the pushing and pulling arms move in a parallel motion to one another and the lower body supports move back and forth in a parallel motion to one another. In FIG. 14 the forward ends of lower body support rails 11 are mounted on movable frame 10 in a narrower more proximal distance to one another and the rearward ends of lower body support rails 11 are mounted on movable frame 10 in a wider more distal distance to one another such that the distance between lower body support rails 11 increases from front to back. Also in FIG. 14 the pushing and pulling arms are pivotably mounted on movable frame 10 in an angled configuration such that each handle moves inward as it moves towards the front of the machine and each handle moves outward as it moves towards the rear portion of the machine.

Stationary base frame 5 can be constructed of any suitable material such as pipes or tubes and preferably is made of metal for strength and durability and is represented in the drawings herein as a metal tubing weldment or assembly with two parallel elongated tubes that are positioned below movable frame 10 and extend the substantial length of movable frame 10. A single tube is positioned on each end perpendicular to the two parallel tubes so as to join the two parallel tubes into a solid and sturdy base mostly rectangular shaped frame for supporting movable frame 10 and user U during operation of machine 1. However, stationary base frame 5 can be constructed in various configurations capable of supporting movable frame 10 and user U during operation of machine 1.

Angle adjusting support arm assembly 15 can be constructed of any suitable materials that can adequately support movable frame 10 and user U during operation of machine 1 and are presented in the drawings herein such that angle adjusting support arm 16 is constructed of an elongated tube that is fastened at a rearward end to a central portion of movable frame 10 and pivots about angle adjusting support arm pivot 19. A forward end of angle adjusting support arm 16 is connected to a central portion of angle adjusting support arm cross brace 17 in a perpendicular configuration to provide stability to angle adjusting arm 16. Angle adjusting support arm wheels 18 are connected to each end of angle adjusting support arm cross brace to allow angle adjusting support arm assembly 15 to roll forwards or backwards on the floor as angle adjusting arm support assembly 15 raises and lowers movable frame 10 during operation of machine 1.

Referring now to FIGS. 1-14, various assemblies and components are common to these two embodiments of the invention and are described in detail herein. Angle adjusting device 7 can be constructed of various components but is represented as an elongated outer cylinder having a first end and a second end and an inner angle adjusting shaft 8 having a first end and a second end that is represented as a threaded rod that rotates on the second end of angle adjusting device 7 outer cylinder as it extends or contracts. Angle adjusting shaft 8 has a coupling on the second end that connects to movable frame 10 at angle adjusting device upper pivot 13. In the first embodiment as illustrated in FIGS. 1-9, the first end of angle adjusting device 7 outer cylinder connects to base frame 5 at angle adjusting device lower pivot 6 and, in the second embodiment as illustrated in FIGS. 10-13, the first end of angle adjusting device 7 is connected to angle adjusting support arm 16 at angle adjusting device lower pivot 6.

In these two embodiments, angle adjusting device 7 outer cylinder is operatively engaged with a center portion of angle adjusting shaft 8 and a first end of angle adjusting shaft 8 rotates inside of angle adjusting device 7 outer cylinder. Although not illustrated, angle adjusting device 7 is represented as being a known common actuating device that is powered by an electric motor to rotate threaded adjusting shaft 8 as it cooperates with a fixed threaded nut located at the second end of angle adjusting device 7 outer cylinder to cause threaded adjusting shaft 8 to extend or contract. However, alternatively, angle adjusting device 7 could operate with a hydraulic or pneumatic cylinder or similar device to extend and contract adjusting shaft 8. Also, not illustrated so as to more clearly illustrate the mechanical components of the invention, an electronic control panel commands and controls the motion of angle adjusting device 7 and therefore the angle of movable frame 10 relative to the floor in the first and second embodiments of the invention.

Lower body user support rails 11 can be constructed of any material capable of supporting lower body user support assemblies 20 but are represented as metal tubes that are curved in shape to match the natural motion pattern of a user's lower body during an exercise motion. The rearward ends of lower body user support rails 11 are rigidly connected to movable frame 10 and the forward ends of lower body user support rails 11 are rigidly connected to movable frame 10. The lower body user support rails 11 are mostly identical and can be mounted to movable frame 10 in a parallel configuration or angled configuration.

Traveling member assemblies 80 can comprise various configurations for rollably engaging lower body user support rails 11 and are capable of supporting and moving lower body user support assemblies 20 and user U during operation of machine 1. Traveling member assemblies 80 are represented as triangular shaped inner and outer metal plates 81 fastened to concave wheels with a fixed axle protruding from the outer plate wherein two spaced traveling member wheels 83 engage the upper side of lower body user support rails 11 and are fastened in between traveling member inner frame plates 81 and traveling member inner frame plates 82. A traveling member wheel 83 engages the underside of lower body user support rails 11 and is fastened in between traveling member inner frame plates 81 and traveling member outer frame plates 82 such that the three wheels form a triangular configuration to capture the lower body user support rails 11. The traveling member outer frame plates 82 are rigidly connected proximal to the center of traveling member outer frame plates 82 to a traveling member axle 84 such that traveling member axle 84 extends from one side only from traveling member outer frame plates 82 in a perpendicular configuration.

Lower body user support assemblies 20 can be constructed of various materials capable of supported user U's body weight and transferring the force exerted by user U's legs and providing adequate comfort to user U's lower legs and feet during operation of machine 1. Foot platforms 21 are mostly rectangular plates large enough to support substantially all of user U's feet with a small section near user U's toes angled upward to assist in keeping the user's feet securely positioned and to allow the user to impart maximum force during the pushing motion of the exercise. Shin pads 23 are mostly rectangular shaped boards or plates that are padded on the surface and configured to comfortably support user U's shins and ankles and support a substantial portion of user U's body weight and provide a cushioned exertion surface for user U's upper feet and ankles during the pulling motion of the exercise. Shin pads 23 are secured to an upper portion of lower body user support frames 22 and lower body user support frames 22 are formed metal components that are rigidly connected at a lower end to the first end of first lower body user support linkage bars 24 and lower body user support pivot 29. Lower body user support pivot 29 pivotally connects lower body user support assemblies 20 to traveling member assemblies 80 and pivots about traveling member axle 84 during operation of machine 1. First lower body user support linkage bars 24 have first ends and second ends and second lower body user support linkage bars 26 have first ends and second ends and the first ends of first lower body user support linkage bars 24 are rigidly connected to lower body user support pivots 29 and lower body user support frames 22 and pivotally connected at the second ends to the first ends of second lower body user support linkage bars 26. The second end of second lower body user support linkage bars 26 are rigidly connected to left linkages connection hub 70L and right linkages connection hub 70R.

Upper body user support assemblies 30 can be constructed of various materials capable of comfortably supporting user U's upper body and transferring the force of user U's arms during operation of machine 1. Upper body user support lever arms 31 have a first end and a second end and can be constructed of any rigid material but are represented as round metal cylinders that pivot at a first end about upper body user support pivots 34. Upper body user support pivots 34 can be mounted on movable frame 10 in a parallel configuration or in an angled configuration. Upper body user support adjusting shafts 32 have first ends and second ends and a central portion of upper body user support adjusting shafts 32 are operatively engaged with the second end of upper body user support lever arms 31 as the first ends of upper body user support adjusting shafts 32 rotate inside of upper body user support lever arms 31 when the length of upper body user support assemblies 30 are being adjusted. Second ends of upper body user support shafts 32 are rigidly connected to upper body user support grip handles 33 such that adjustment of the length of upper body user support assemblies 30 creates the correct motion for the exercise in cooperation with the angle of adjustment of movable frame 10.

Although some components are not illustrated, the angle adjusting device for upper body user support assemblies 30 is represented as being a known common actuating device that is powered by an electric motor to rotate threaded upper body user support adjusting shafts 32 as they cooperate with a fixed threaded nut located at the second end upper body user support lever arms 31 to cause threaded upper body user support adjusting shaft 32 to extend or contract. However, alternatively, upper body user support angle adjusting shafts 32 could operate with a hydraulic or pneumatic cylinder or similar device to extend and contract upper body user support adjusting shafts 32 and upper body user support grip handles 33. Upper body user supports 30 also comprise upper body user support linkage connection flanges 35 which have a first end and a second end and upper body user support linkage bars 37 which have a first end and a second end. A first end of upper body user support linkage bar flanges 35 is rigidly connected at a first end to a first end of upper body user support lever arms 31 and pivotally connected at a second end to a first end of upper body user support linkage bars 37 and a second end of upper body user support linkage bars 37 are pivotally connected to left linkages connection hub flange 71L and right linkages connection hub flange 71R at upper body user support linkage bar upper pivot 38. Although not illustrated so as to more clearly illustrate the mechanical components of the invention, an electronic control panel commands and controls the length of upper body user support assemblies 30 and synchronizes that length with the angle of adjustment of angle adjusting device 7 and the angle of movable frame 10 so as to optimize the motion of each exercise position for user U during operation of machine 1.

Rotational resistance mechanism 40 can be comprised of various components that create an adjustable resistance to the rotation of a flywheel, fan blades, paddle wheels or the like. However, resistance mechanism 40 is represented as a flywheel with an electronically controlled resistance component such as a set of magnets. Rotational resistance mechanism 40 is rigidly mounted on rotational resistance axle 41 and preferably to a central portion of rotational resistance axle 41. Rotational resistance axle 41 is rotatably mounted on rotational resistance axle connection flange 42 and rotational resistance axle connection flange 42 is rigidly connected to movable frame 10 and preferably proximal to a central portion of movable frame 10 such that rotational resistance mechanism 40 moves with movable frame 10 when it is adjusted to various angles of exercise position relative to the floor. Although not illustrated, the resistance setting of rotational resistance mechanism 40 is controlled and adjusted by an electronic control panel.

Resistance drive assembly 50 is comprised of multiple components for transferring the synchronized force of pushing and pulling motions imparted by user U upon lower body user support assemblies 20 and upper body user support assemblies 30 to rotate rotational resistance mechanism 40 during operation of machine 1. An upper resistance drive sprocket 51 is rigidly connected to left linkages connection hub 70L and an upper resistance drive sprocket 51 is rigidly connected to right linkages connection hub 70R and lower resistance drive sprockets 52 are mounted on one-way clutches 53 that are mounted on and rotate rotational resistance axle 41. Upper resistance drive sprockets 51 and lower resistance drive sprockets 52 are operatively connected with flexible drive members 54 such that the reciprocal partial rotations of upper resistance drive sprockets 51 cause lower resistance drive sprockets 52 to rotate one-way clutches 53 which causes one directional rotation of rotational resistance axle 41 and rotational resistance mechanism 40 during operation of machine 1.

Left linkages connection hub 70L and right linkages connection hub 70R rotate less than 360 degrees in both directions on fixed linkages connection hub axle 72. Left linkages connection hub flange 71L is rigidly connected to left linkages connection hub 70L and right linkages connection hub flange 71R is rigidly connected to right linkages connection hub 70R.

Rocker arm linkage assembly 60 can be constructed of various components capable of operably connecting and transferring the pushing and pulling force of lower body user support assemblies 20 and upper body user support assemblies 30 during operation of machine 1. Rocker arm linkage assembly 60 is represented as rigid rocker arm 61 having a left end and a right end and a center rocker arm pivot 62 such that rocker arm pivot 62 pivotally connects rocker arm 61 to a central portion of movable frame 10, and rocker arm linkage bars 65 having first ends and second ends such that the left end of rocker arm 61 is pivotally connected to a first end of a linkage bar 65, the second end of said linkage bar 65 is pivotally connected to left linkages connection hub flange 71L, the right end of rocker arm 61 is pivotally connected to a first end of a linkage bar 65, and the second end of said linkage bar 65 is pivotally connected to right linkages connection hub flange 71R.

FIGS. 1-14 represent various angle positions of movable frame 10 relative to the floor. Each of the angles position the user U to perform a different type of exercise as gravity forces user U to support his or her body with different muscle groups and increase or decrease the exertion required from different muscle groups to perform each of the exercises. To optimize the biomechanical motion of each exercise, an electronic control panels synchronizes and controls the length of the upper body user support assembly 30 with the angle of the movable frame 10 such that any time the movable frame 10 is adjusted in angle the length of upper body user support assembly 30 is concurrently adjusted.

Figure 2:
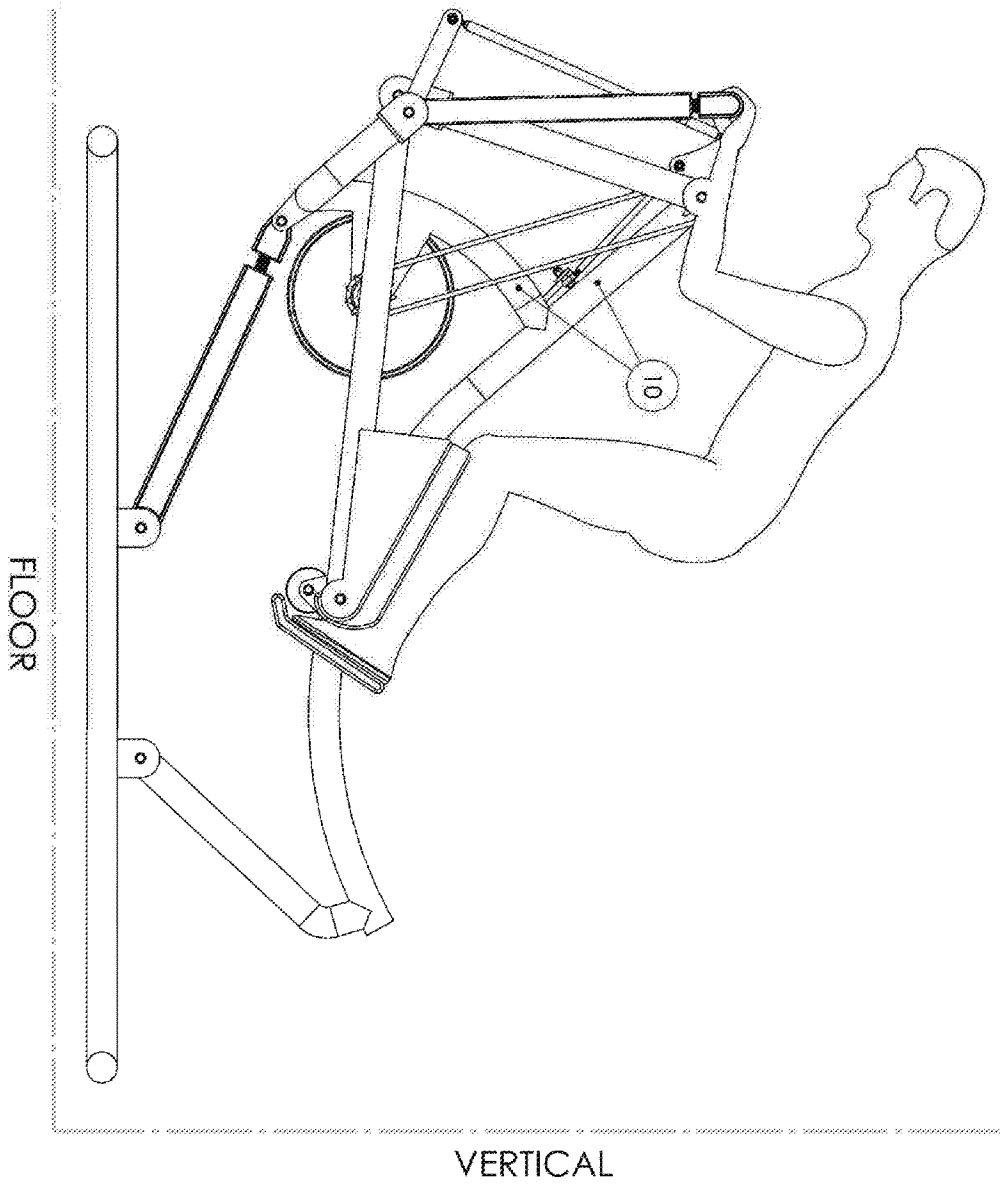
FIG. 2 is a side view of the invention at a lower angle position with a user in a mid-point position of a simulated crawling motion exercise.
Figure 10:
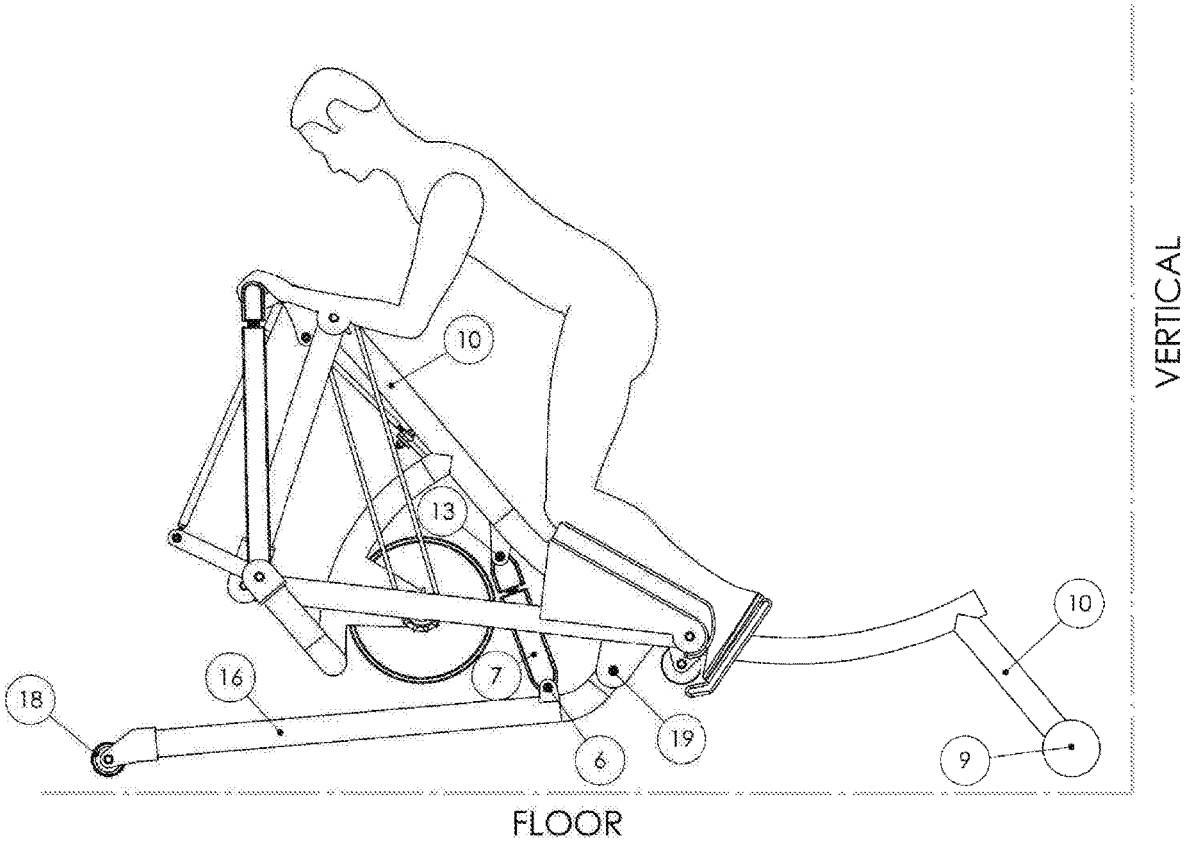
FIG. 10 is a side view of the invention at a lower angle position with a user in a mid-point position of a simulated crawling motion exercise.

FIGS. 1, 2, and 10 represent a simulated crawling motion exercise wherein the user U is proximal to a maximum forward leaning position and user U's weight bearing is divided between the upper body user supports 30, and the angle of the movable user support and the length of the upper body user support assemblies are synchronized proximal to their lower settings to maximize the biomechanical motion of the exercise. In this exercise position, most of user U's lower body weight is supported by the left and right shin pads 23. In FIG. 1, user U is proximal to full pushing extension of user U's right arm and leg and proximal to full pulling contraction of user U's left arm and leg. In FIGS. 2 and 10, user U is at a mid-point in the exercise motion such that user U's left arm and left leg or right arm and right leg are at a mid-point of pushing and the other arm and leg are at a mid-point of pulling.

Figure 3:
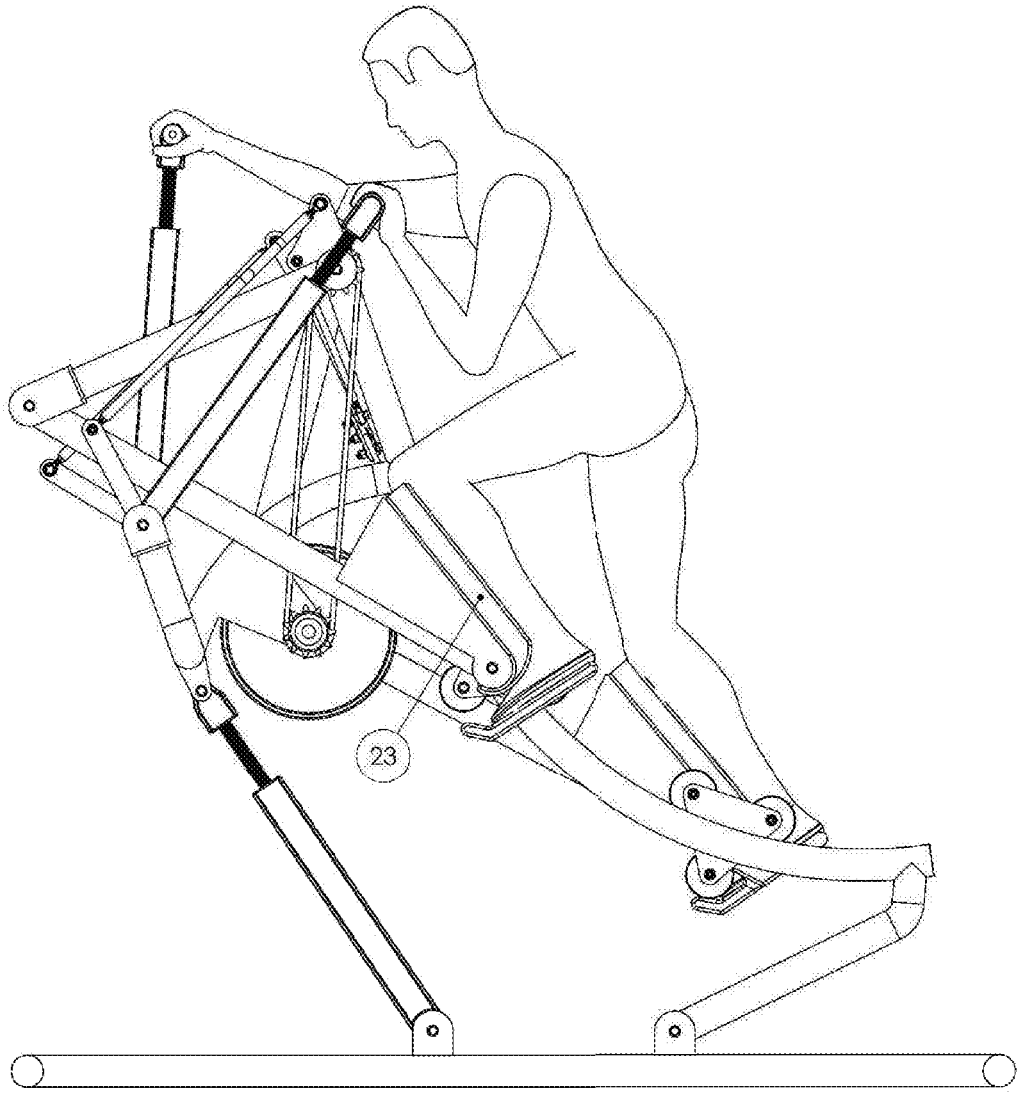
FIG. 3 is a side view of the invention at a mid-point angle position with a user performing a simulated hill climbing exercise.
Figure 4:
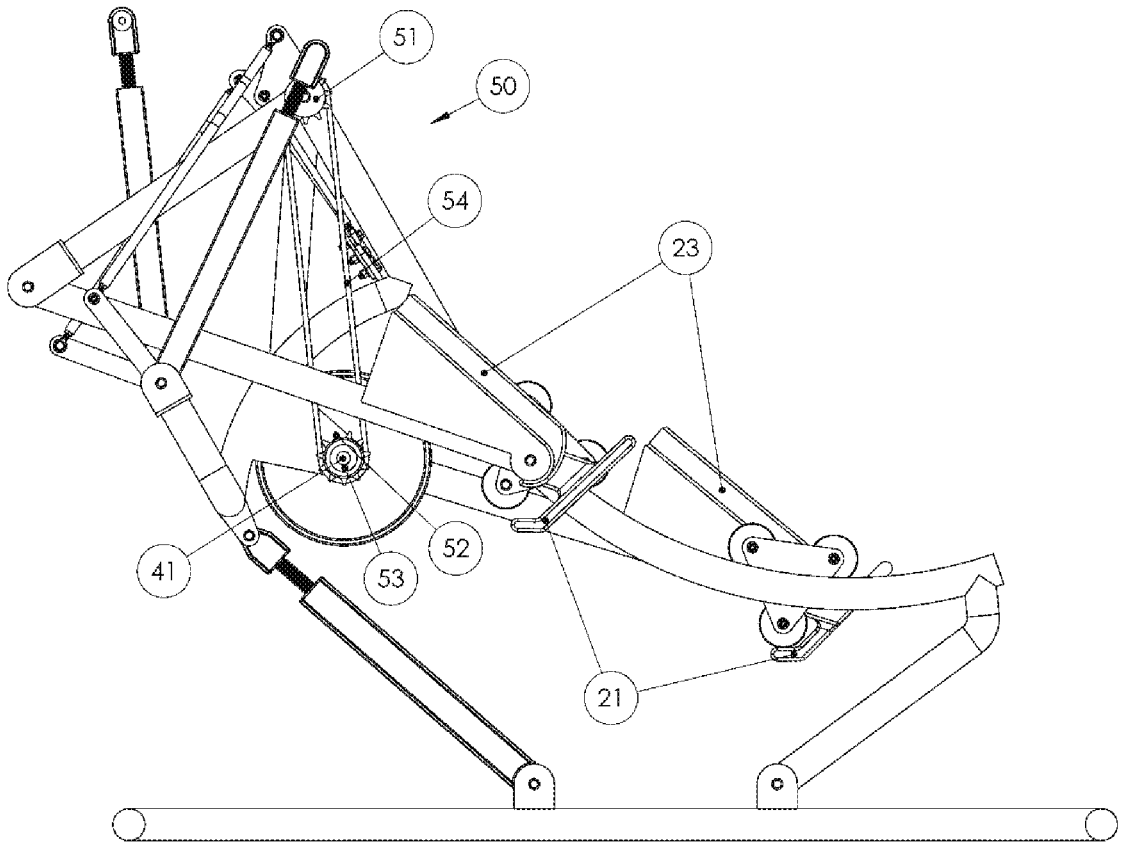
FIG. 4 is a side view of the invention at a lower angle position.
Figure 5:
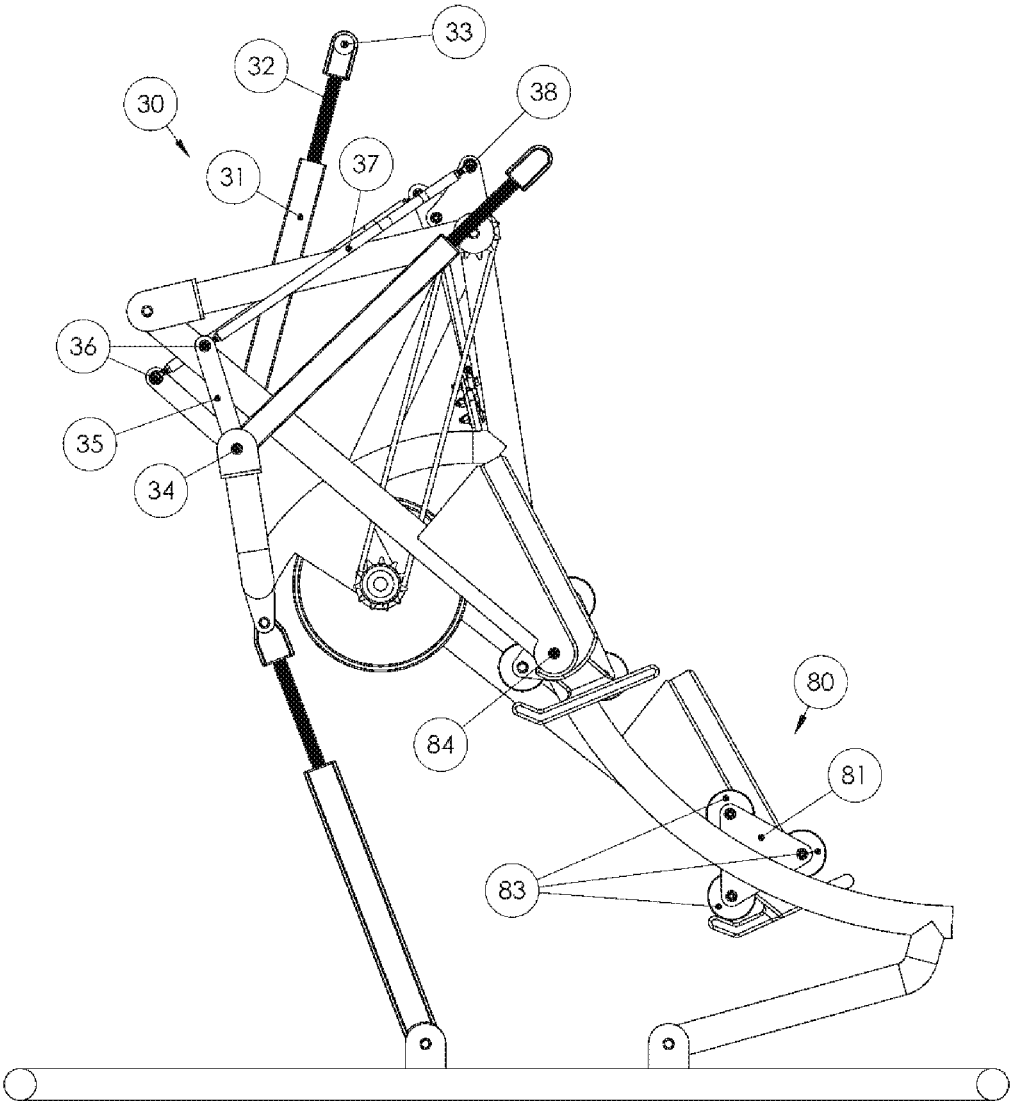
FIG. 5 is a side view of the invention at a higher angle position.

FIGS. 3 and 13 represent a simulated hill climbing exercise wherein user U is in a mid-point forward leaning position and most of user U's weight bearing is supported by lower body user supports 20, and user U is capable of maximizing his or her leverage and pushing and pulling force by leaning into lower body user support shin pads 23 while gripping upper body user support grip handles 33. The angle of movable frame 10 and the length of upper body user supports 30 are synchronized at a mid-point location to optimize the biomechanical motion of the exercise.

Figure 6:
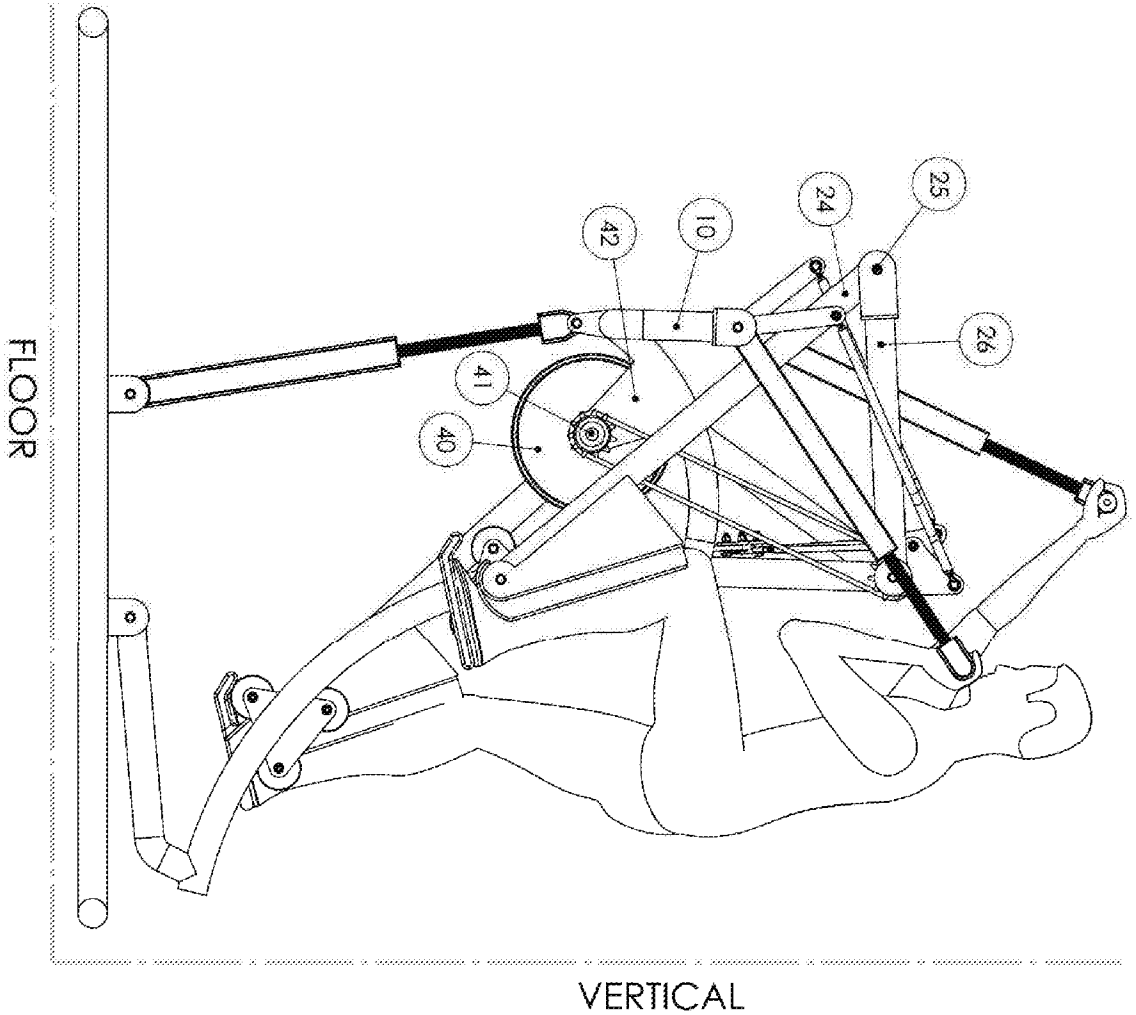
FIG. 6 is a side view of the invention at a higher angle position with a user performing a simulated ladder climbing exercise.
Figure 7:
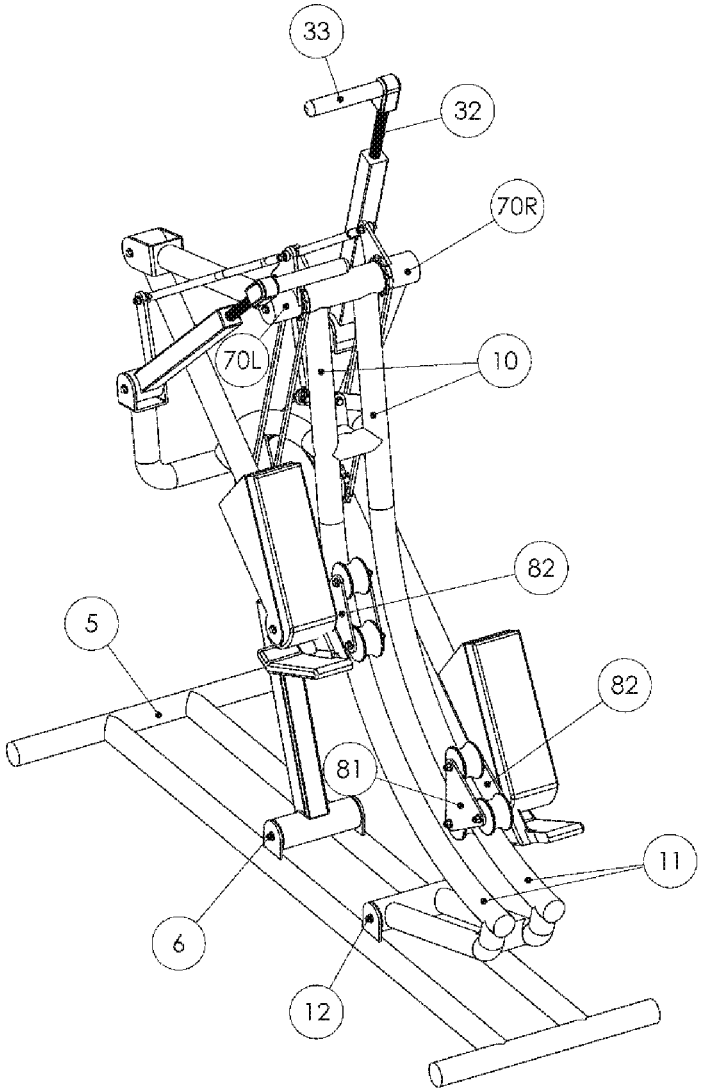
FIG. 7 is a rear perspective view of the invention at a higher angle position.
Figure 8:
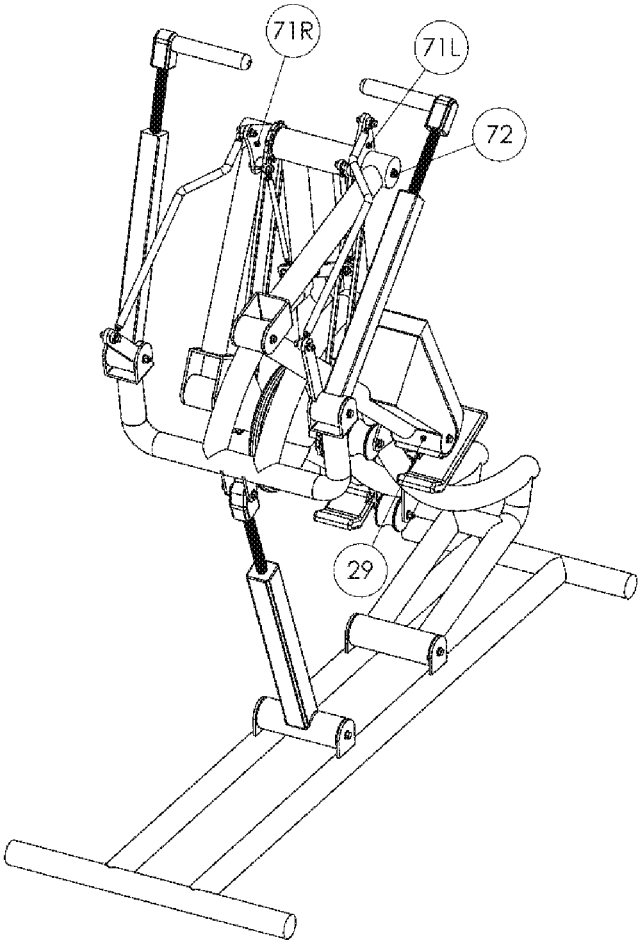
FIG. 8 is a front perspective view of the invention at a higher angle position.
Figure 11:
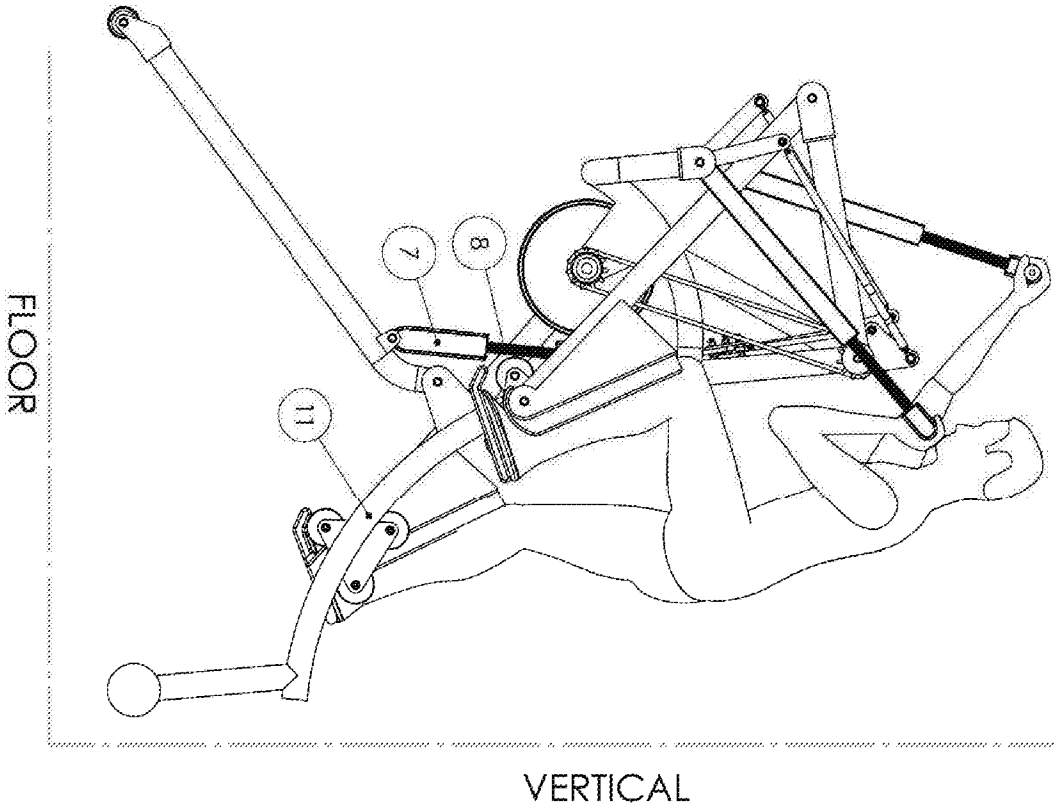
FIG. 11 is a side view of the invention at a higher angle position with a user performing a simulated ladder climbing exercise.

FIGS. 6 and 11 represent a simulated ladder climbing exercise wherein user U is in a more vertical position and substantially all of user U's weight bearing is supported by lower user supports 20, and user U is capable of maximizing his or her leverage and pushing and pulling force by bracing against lower body user support shin pads 23 while gripping upper body user support grip handles 33. The angle of movable frame 10 is proximal to its highest setting and the length of upper body user supports 30 are synchronized proximal their longest length to optimize the biomechanical motion of the exercise.

Figure 12:
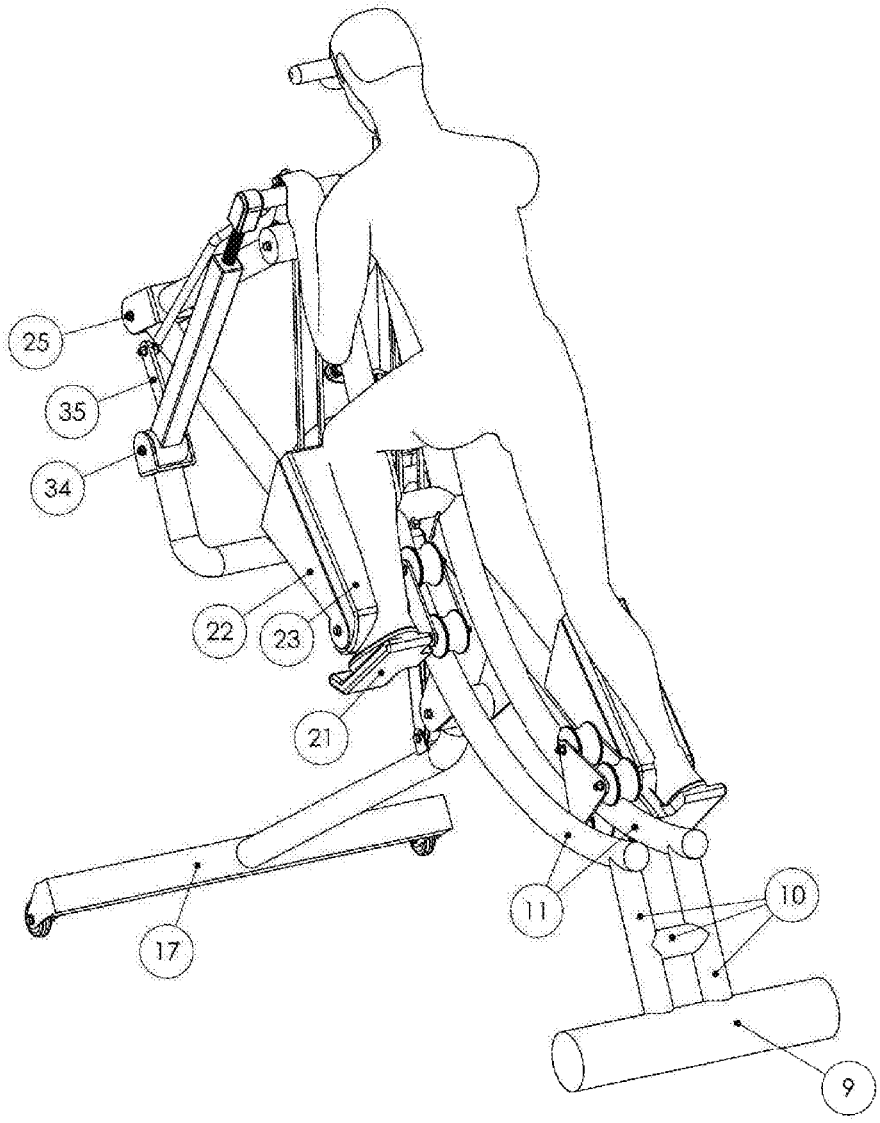
FIG. 12 is a rear perspective view of the invention at a mid-point angle position with a user performing a simulated sprinting exercise.

FIG. 12 represents a simulated forward leaning sprinting motion wherein user U is in a mid-point forward leaning position and more of user U's weight bearing is supported by lower body user supports 20 than upper body user supports 30, and user U is leaning into and bracing against lower body user support shin pads 23 and leaning into and bracing against upper body user support grip handles 33 to obtain maximum leverage and exert maximum force into the user supports. The angle of movable frame 10 and the length of upper body user supports 30 are synchronized at a mid-point location to optimize the biomechanical motion of the exercise.

Figure 9:
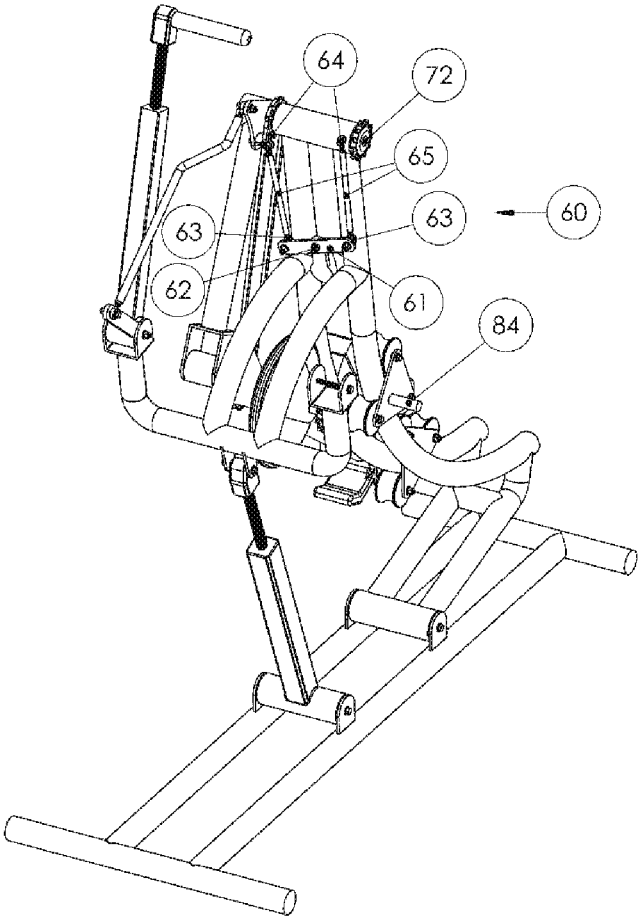
FIG. 9 is a front perspective view of the invention at a higher angle position with a portion of the components removed so as to more clearly illustrate certain components of the machine.

FIG. 9 represents a partially disassembled embodiment of the invention wherein the left lower body user support assembly 20 and the left upper body user support assembly 30 have been removed to better illustrate some of the other features and components that are more central to the machine 1.

The optimal biomechanical motion and function of machine 1 is achieved when the length of upper body user support assemblies 30 is synchronized with the angle of movable frame 10 and the length of upper body user support assemblies 30 adjust in unison with the angle of movable frame 10. However, machine 1 can be operated such that the length of upper body user support assemblies 30 are not synchronized with the angle of movable frame 10 and the adjustment of upper body user support assemblies 30 are independent of the adjustment of the angle of movable frame 10.

To operate the invention in any position, user U steps onto left and right foot platforms 21 and leans forward towards machine 1 such that user U's shins, a portion of user U's ankles, the tops of user U's feet, and, based on the size of user U, possibly a portion of user U's knees, contact and brace against left and right shin pads 23, and user U grasps left and right upper body user support grip handles 33. User U may also set the desired resistance (resistance force) of rotational resistance mechanism 40, the desired angle position of movable frame 10, and the desired length of upper body user support assembly 30 prior to operating machine 1 with an electronic control panel that is not illustrated. Said electronic control panel may also comprise preset computer programs that can be selected by user U such that said electronic control panel can set and adjust the resistance of rotational resistance mechanism 40, the angle position of movable frame 10, and the length upper body user supports 30 prior to and during operation of machine 1 by user U.

To begin exercising on machine 1, user U will push against grip handle 33 and foot platform 21 with one side of user U's body while simultaneously pulling against the opposing grip handle 33 and shin pad 23 with the other side of user U's body. For example, if user U's right hand is gripping right grip handle 33 while user U's right arm is extending, then user U's right foot will be pressing against right foot platform 21 and user U's right lower leg will be bracing against right shin pad 23 while user U's right leg is extending, and user U's left hand will be gripping left grip handle 33 while user U's left arm is contracting and user U's left foot will be contacting left foot platform 21 and the top of user U's left foot, ankle and shin will be pulling against left shin pad 23 while user U's left leg is contracting. This exercise motion will cause right upper body user support lever arm 31 to pivot forward about right upper body user support pivot 34, causing right upper body user support linkage connection flange 35 to pivot forward about right upper body user support pivot 34, causing right upper body user support linkage bar 37 to move downward and pivot about right upper body user support linkage bar lower pivot 36 and right upper body user support linkage bar upper pivot 38, causing right linkages connection hub flange 71R to pivot forward about linkages connection hub axle 72.

Concurrently with this motion, right traveling member wheels 83 roll rearward on right lower body support rail 11 moving right lower body user support foot platform 21 and right shin pad 23 rearward on right lower body support rail 11 while right lower body user support frame 23 pivots about right travel member axle 84 at right lower body user support pivot 29, causing right first lower body user support linkage bar 24 to move rearward and pivot about right lower body user support linkage pivot 25, causing right second lower body user support linkage bar 26 to move rearward and pivot on right linkages connection hub 70R about linkages connection hub axle 72. This right side motion of machine 1 concurrently causes right upper resistance drive sprocket 51 to rotate forward, causing the forward portion of right flexible drive member 54 to move downward and rotate right lower resistance drive sprocket 52 forward, causing one-way clutch 53 to engage and rotate rotational resistance axle 41 and rotational resistance mechanism 40. This right side motion of machine 1 concurrently engages rocker arm linkage assembly 60 causing right side rocker arm linkage bar 65 to move downward and pivot on right rocker arm linkage upper pivot 64 and right rocker arm linkage lower pivot 64, causing rocker arm 61 to pivot about rocker arm pivot 62 and the right end of rocker arm 61 to move downward, causing the left end of rocker arm 61 to move upward, causing left rocker arm linkage bar 65 to move upward and pivot about left rocker arm linkage lower pivot 63 and left rocker arm linkage upper pivot.

This movement of rocker arm linkage assembly 60 concurrently causes left upper body user support lever arm 31 to pivot rearward about left upper body user support pivot 34, causing left upper body user support linkage connection flange 35 to pivot rearward about left upper body user support pivot 34, causing left upper body user support linkage bar 37 to move upward and pivot about left upper body user support linkage bar lower pivot 36 and left upper body user support linkage bar upper pivot 38, causing left linkages connection hub flange 71L to pivot rearward about linkages connection hub axle 72.

Concurrently with this motion, left traveling member wheels 83 roll forward on left lower body support rail 11 moving left lower body user support foot platform 21 and left shin pad 23 forward on left lower body support rail 11 while left lower body user support frame 23 pivots about left travel member axle 84 at left lower body user support pivot 29, causing left first lower body user support linkage bar 24 to move forward and pivot about left lower body user support linkage pivot 25, causing left second lower body user support linkage bar 26 to move forward and pivot on left linkages connection hub 70R about linkages connection hub axle 72.

This left side motion of machine 1 concurrently causes left upper resistance drive sprocket 51 to rotate rearward, causing the forward portion of left flexible drive member 54 to move upward and rotate left lower resistance drive sprocket 52 rearward, causing one-way clutch 53 to disengage from rotational resistance axle 41. The reciprocal and opposite motion of operating the left and right sides of machine 1 reverses the order of the concurrent motion of the components of machine 1.

User U can perform multiple reciprocal repetitions of pushing and pulling motions at a fixed angle or at various angles during an exercise session.

Rocker arm linkage assembly 60 cooperatively links left side upper and lower body user supports to the right side upper and lower body user supports of machine 1 such that user U can combine synchronized pushing and pulling motions with all four limbs to rotate rotational resistance axle 41 and propel rotational resistance mechanism 40.

In various embodiments, the lower body support rails 11 that are mounted on the movable user support frame 10 can have a curved shape. Alternatively, in various other embodiments, the lower body support rails 11 that are mounted on the movable user support frame 10 can have a straight or linear shape.

Now referring to FIGS. 15-40, various views of these embodiments of the machines 100, 200, and 300 are shown to provide a more complete understanding of these embodiments of the invention. The exercise function of all three of these embodiments is the same. The three machines differ in how the angle adjustment of the movable user support frame 110, 210, or 310 is achieved. Machine 100 uses an assembly powered by an electrical actuator motor to adjust the angle of the movable user support frame 110. Machine 200 uses a manually driven gearing assembly powered by the exercise motion of the user to adjust the angle of the movable user support frame 210. Machine 300 uses a lockable lever that requires the user to manually adjust the angle of the movable user support frame 310 prior to operating machine 300. The primary advantage of machine 100 is the convenience, speed and electronic programmability of angle adjustment of the user support. The primary advantage of machine 200 is that it does not require electricity to operate machine 200. The advantages of machine 300 are that it does not require electricity to operate machine 300 and machine 300 is constructed with many fewer components than machine 100 or 200 and is therefore less costly to manufacture.

FIGS. 15-40 use common components to create the exercise motion of machines 100, 200, and 300. Machines 100 and 200 respectively use 100 and 200 series numbers to identify their components. Components identification for machine 300 are limited to the angle adjustment components and the stationary and movable frames to avoid excessive repetition. These common components that create the exercise motion of the invention may be configured or connected in multiple variations, and located in various positions on machines 100, 200, or 300 to produce the same or very similar exercise motion. Machine 100, 200, or 300 may also produce the same or very similar exercise motion if one or more of these common components that create the exercise motion of the invention is eliminated from machine 100, 200, or 300.

Referring to FIGS. 15-36, a rearward portion of movable user support frame 110 or 210 is pivotably mounted on a rearward portion of stationary base frame 105 or 205 and left and right lower body user support wheel tracks 185 or 285 are rigidly mounted on a rearward and central portion of movable user support frame 110 or 210.

Left and right lower body user support wheels 183 or 283 are mounted proximal to first ends of left and right first lower body user support linkage bars 124 or 224 and are rollably engaged with lower body users support wheel tracks 185 or 285. Left and right foot platforms 121 or 221 and left and right shin pads 123 or 223 are rigidly mounted proximal to first ends of first lower body user support linkage bars 124 or 224 and second ends of first lower body user support linkage bars 124 or 224 are pivotably connected to first ends of left and right second lower body user support linkage bars 126 or 226 with left and right lower body user support pivots 125. The second ends of second lower body user support linkage bars 126 or 226 are rigidly connected to left and right linkages connection hubs 170 or 270 such that a rolling motion of lower body user support wheels 183 or 283 causes rotational movement of linkages connection hubs 170 or 270.

A first end of upper body user support height adjustment lever 175 or 275 is pivotably connected to a forward and upper portion of movable user support frame 110 or 210 at upper body user support height adjustment lever pivot 176 or 276. Left and right upper body user support grip handles 133 or 233 are rigidly mounted to first ends of left and right upper body user support lever arms 131 or 231 and second ends of upper body user support lever arms 131 or 231 are independently pivotably connected to left and right sides of a second end of upper body user support height adjustment lever 175 or 275 with upper body user support pivots 134 or 234. First ends of left and right upper body user support arm linkage bars 137 or 237 are pivotably connected to left and right upper body user support pivots 134 or 234 and second ends of upper body user support linkage bars 137 or 237 are pivotably connected to left and right linkage connect hub flanges 171 or 271 such that a pivoting arcing motion of user support grip handles 133 or 233 causes rotational movement of linkages connection hub flanges 171 or 271 and linkages connection hubs 170 or 270.

Left linkage hubs 170 or 270 and left linkage hub flanges 171 or 271 operatively and dependently connect the exercise motions of the left side upper body user supports and the left side lower body users. Right side linkage hubs 170 or 270 and right side linkage hub flanges 171 or 271 operatively and dependently connect the exercise motions of the right side upper body user supports and the right side lower body users supports. During operation of machine 100, 200, or 300, left linkage hubs 170 or 270 and right linkage hubs 170 or 270 oscillate back and forth in partial rotations only such that user U controls the range of oscillating motion of left and right linkage hubs 170 or 270 and the left and right upper and lower body user supports.

A central portion or second end of upper body user support height adjustment lever 175 or 275 is operatively connected to angle adjustment assembly 190 or 290 via upper body user support height adjustment lever push rod 177 or 277. A first end of upper body user support height adjustment lever push rod 177 or 277 is pivotably connected to upper body user support height adjustment lever 175 or 275 at upper body user support height adjustment lever push rod upper pivot 178 or 278 and a second end of upper body user support height adjustment lever push rod 177 or 277 is pivotably connected to angle adjustment assembly 190 or 290 at upper body user support height adjustment lever push rod lower pivot 179 or 279 such that anytime the angle of movable user support frame 110 or 210 is adjusted, the angle of upper body user support height adjustment lever 175 or 275 is concurrently adjusted relative to movable upper body user support 110 or 210. When angle adjustment assembly 190 or 290 causes the angle of movable user support 110 or 210 to move into a more vertical position, angle adjustment assembly 190 or 290 concurrently causes upper body user support height adjustment lever 175 or 275 to pivot about movable user support frame 110 or 210 to lift left and right upper body user support lever arms 131 or 231 and upper body user support grip handles 133 or 233 upward and away from movable user support frame 110 or 210 such that user U will be moving upper body user support lever arms 131 or 231 and upper body user support grip handles 133 or 233 in a higher arcing path during operation of machine 100, 200, or 300 and when angle adjustment assembly 190 or 290 causes the angle of movable user support 110 or 210 to move into a more horizontal position, angle adjustment assembly 190 or 290 concurrently causes upper body user support height adjustment lever 175 or 275 to pivot about movable user support frame 110 or 210 to lower left and right upper body user support lever arms 131 or 231 and upper body user support grip handles 133 or 233 downward and closer to movable user support frame 110 or 210 such that user U will be moving upper body user support lever arms 131 or 231 and upper body user support grip handles 133 or 233 in a lower arcing path during operation of machine 100, 200 or 300. This concurrent and synced adjustment of movable user support frame 110 or 210 and upper body user support grip handles 133 or 233 creates a more comfortable and biomechanically correct exercise motion for user U during operation of machine 100, 200 or 300.

A stationary grip handle 139 or 239 is rigidly connected to a forward central portion of movable user support frame 110 or 210 such that user U can steady his or her upper body during operation of machine 100, 200, or 300 while only urging left and right lower body user supports with left and right foot platforms 121 or 221 and left and right shin pads 123 or 223 and not engaging upper body user support lever arms 131 or 231 and upper body user support grip handles 133 or 233. User U may also may use stationary grip handle 139 or 239 to steady himself or herself while entering or exiting machine 100, 200 or 300.

Figure 19:
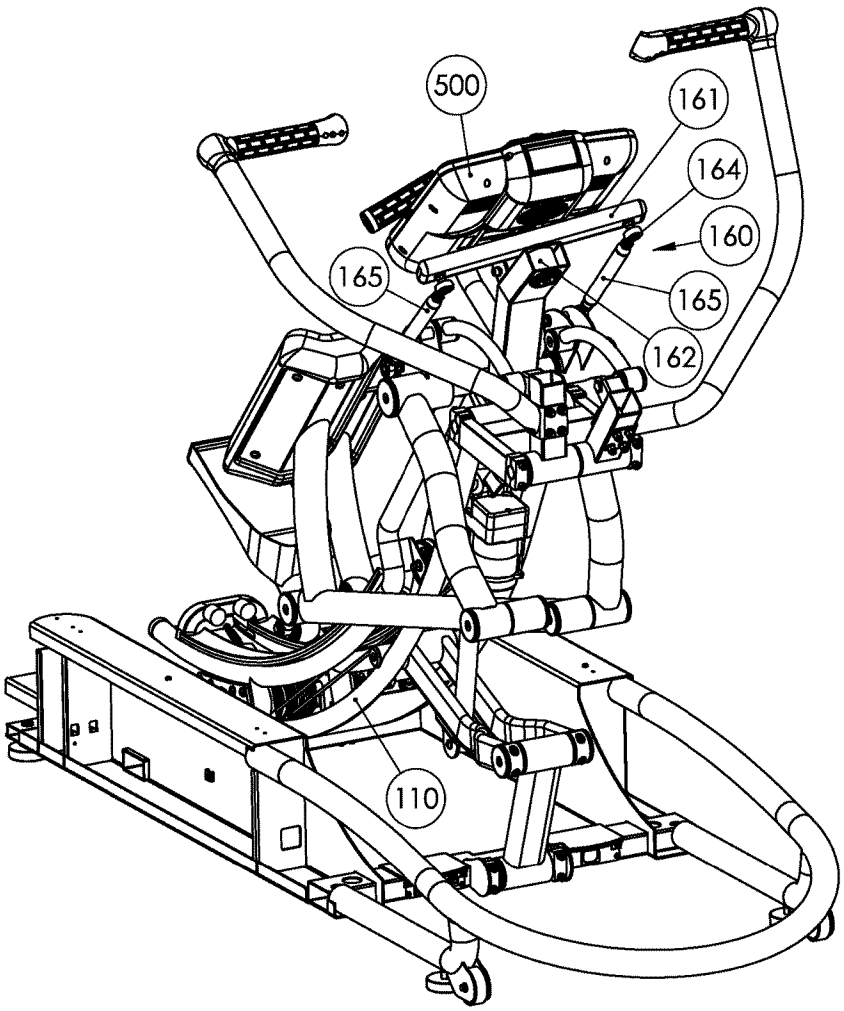
FIG. 19 is a front right side perspective view of the invention at a middle angle position with an electrical angle adjustment mechanism.
Figure 33:
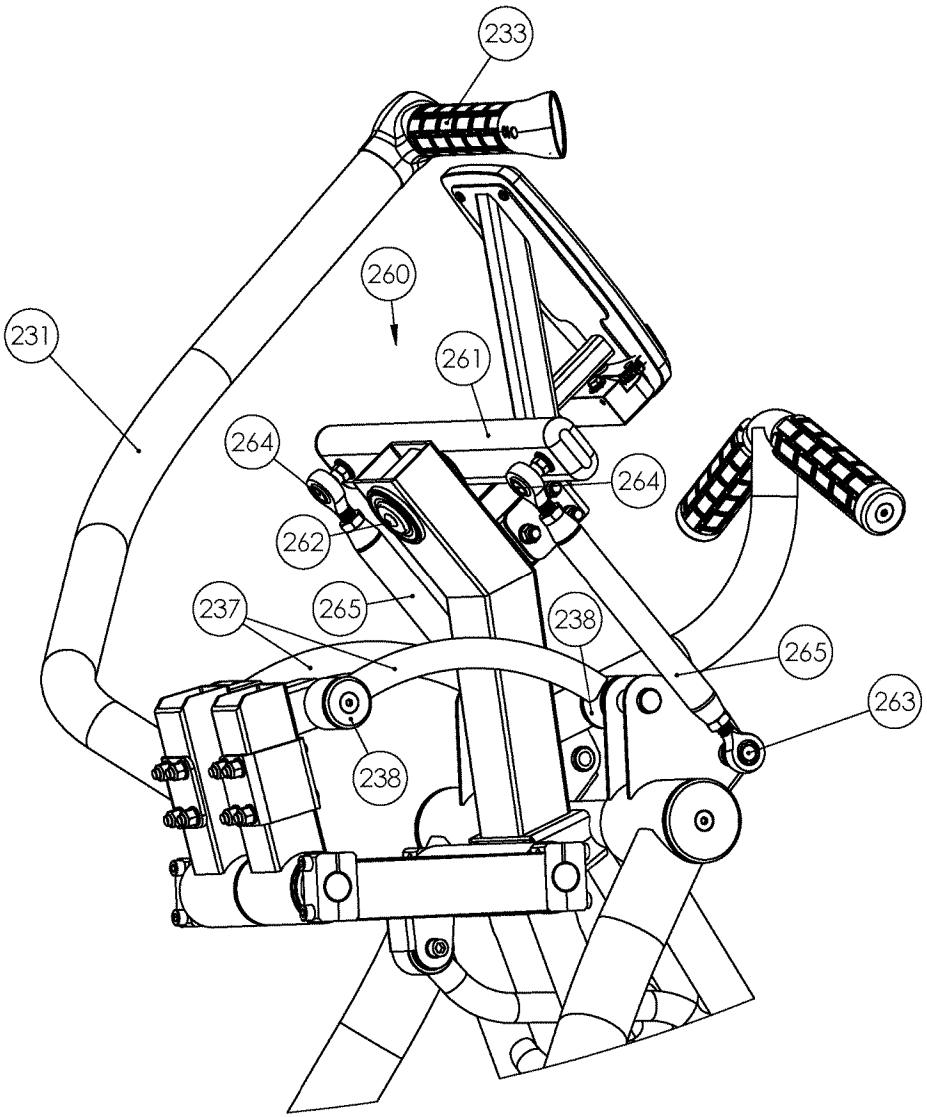
FIG. 33 is a close up front view of the upper portion of the invention with a manual gear drive adjustment mechanism illustrated with some components removed to offer a better view of other components FIG. 34 Is a close up elevated rear view of the upper portion of the invention with a manual gear drive adjustment mechanism.
Figure 34:
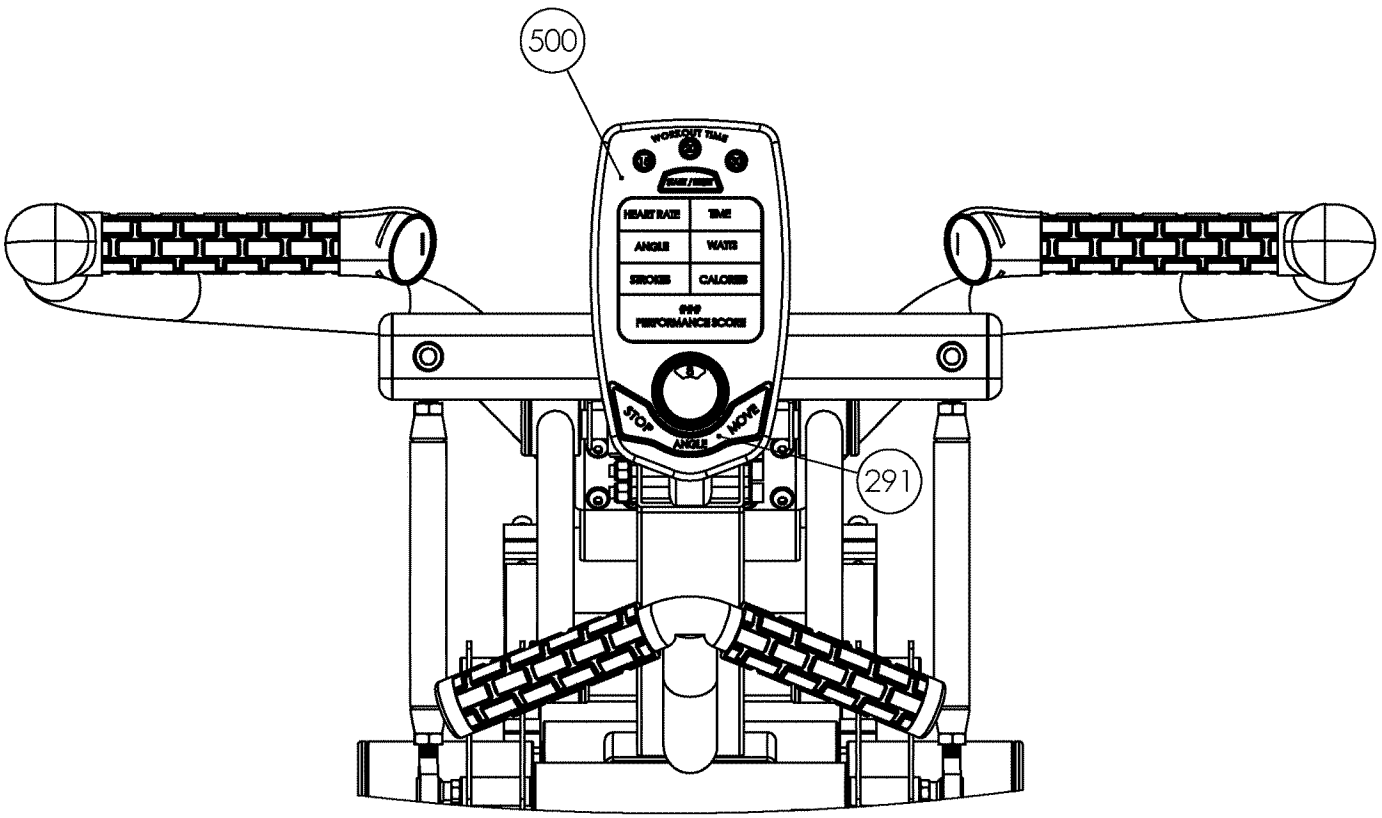
Figure 35:
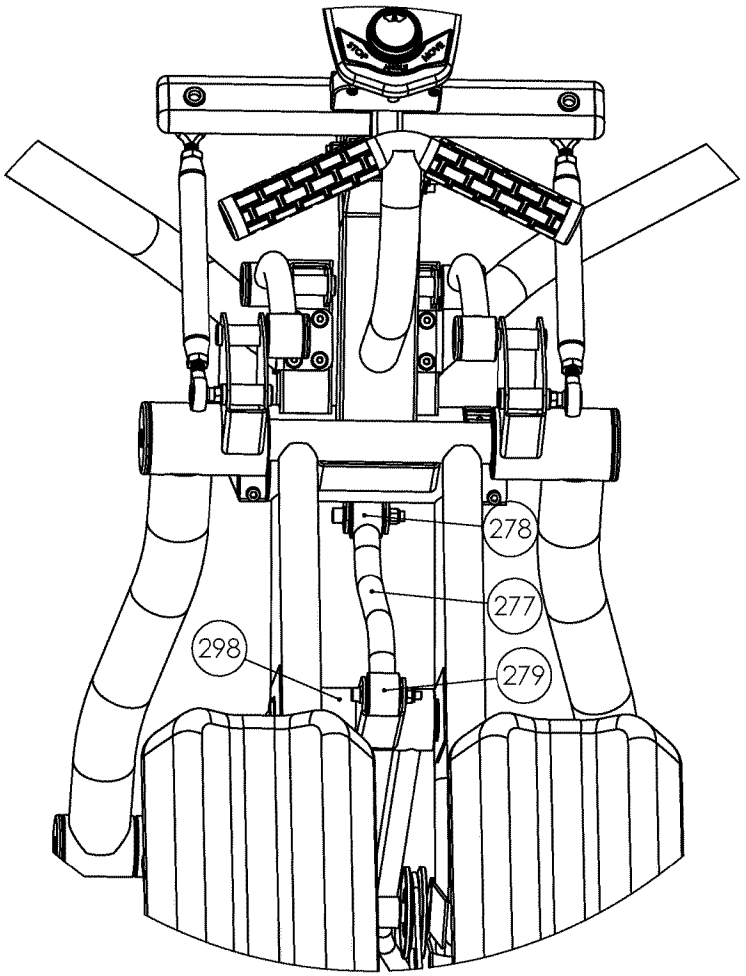
FIG. 35 is a close up elevated rear view of the central portion of the invention with a manual gear drive adjustment mechanism.
Figure 36:
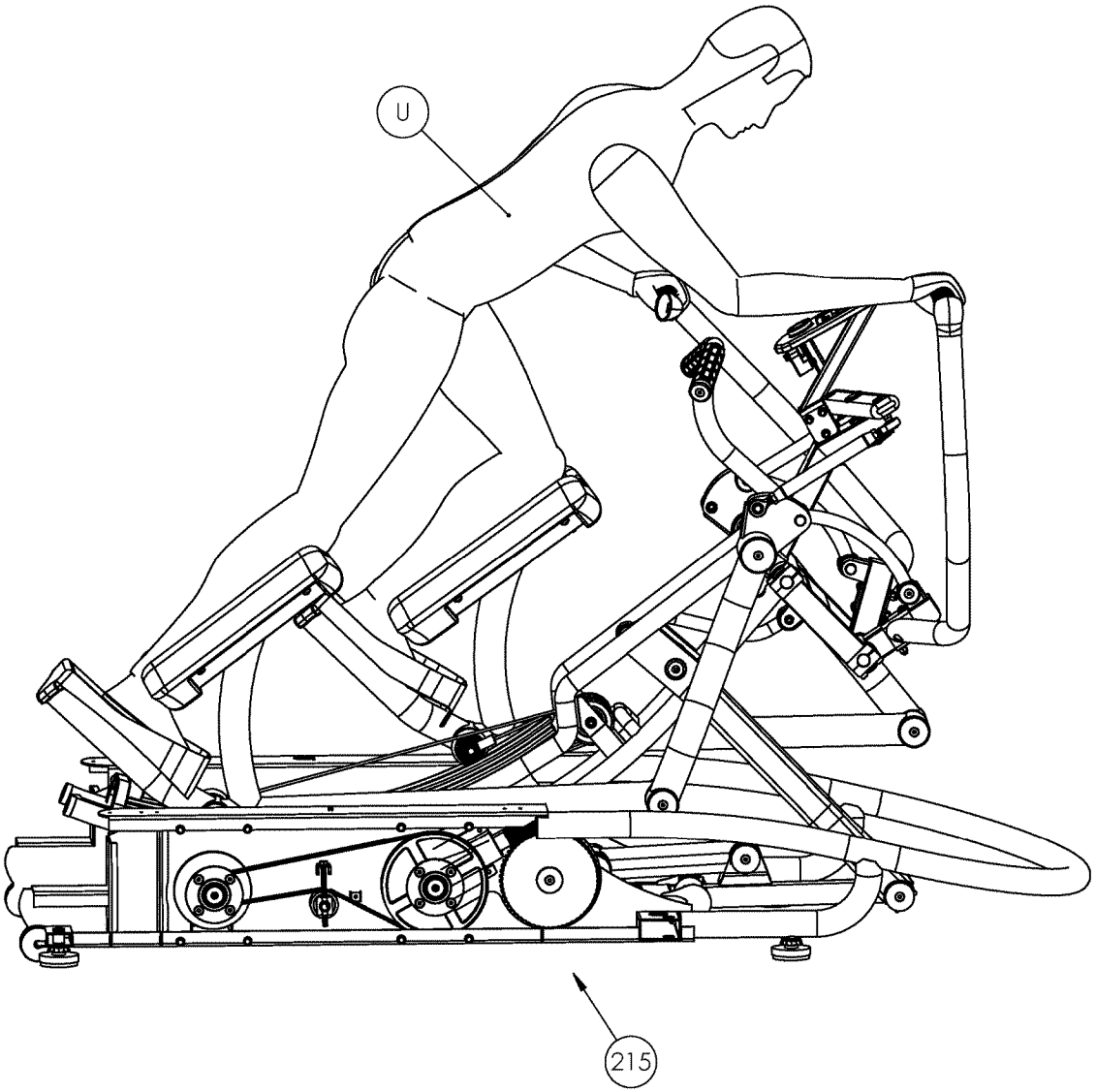
FIG. 36 is a right side view of the invention in a lower angle position with a manual gear drive adjustment mechanism and a user operating the machine.

Rocker arm assembly 160 or 260 is best illustrated in FIGS. 19 and 33 and described in detail as follows:

A central portion of rocker arm 161 or 261 is pivotably connected to a forward and upper portion of movable user support frame 110 or 210. Left and right ends of rocker arm 161 or 261 are pivotably connected to first ends of left and right rocker arm linkage bars 165 or 265 with rocker arm linkage bar upper pivots 164 or 264. Second ends of rocker arm linkage bars 165 or 265 are pivotably connected to linkage connection hub flanges 171 or 271 with rocker arm linkage bars lower pivots 163 or 263 such that the left and right upper and lower body user supports are operatively connected and synchronized such that any rolling motion of either lower body user support or pivoting motion of either upper body user supports causes movement of all 4 user supports. This concurrent motion is such that the left side upper body user support and the left side lower body user support move in simultaneous pulling motions when the right side upper body user support and the right side lower body user support move in simultaneous pushing motions and vice versa.

Figure 20:
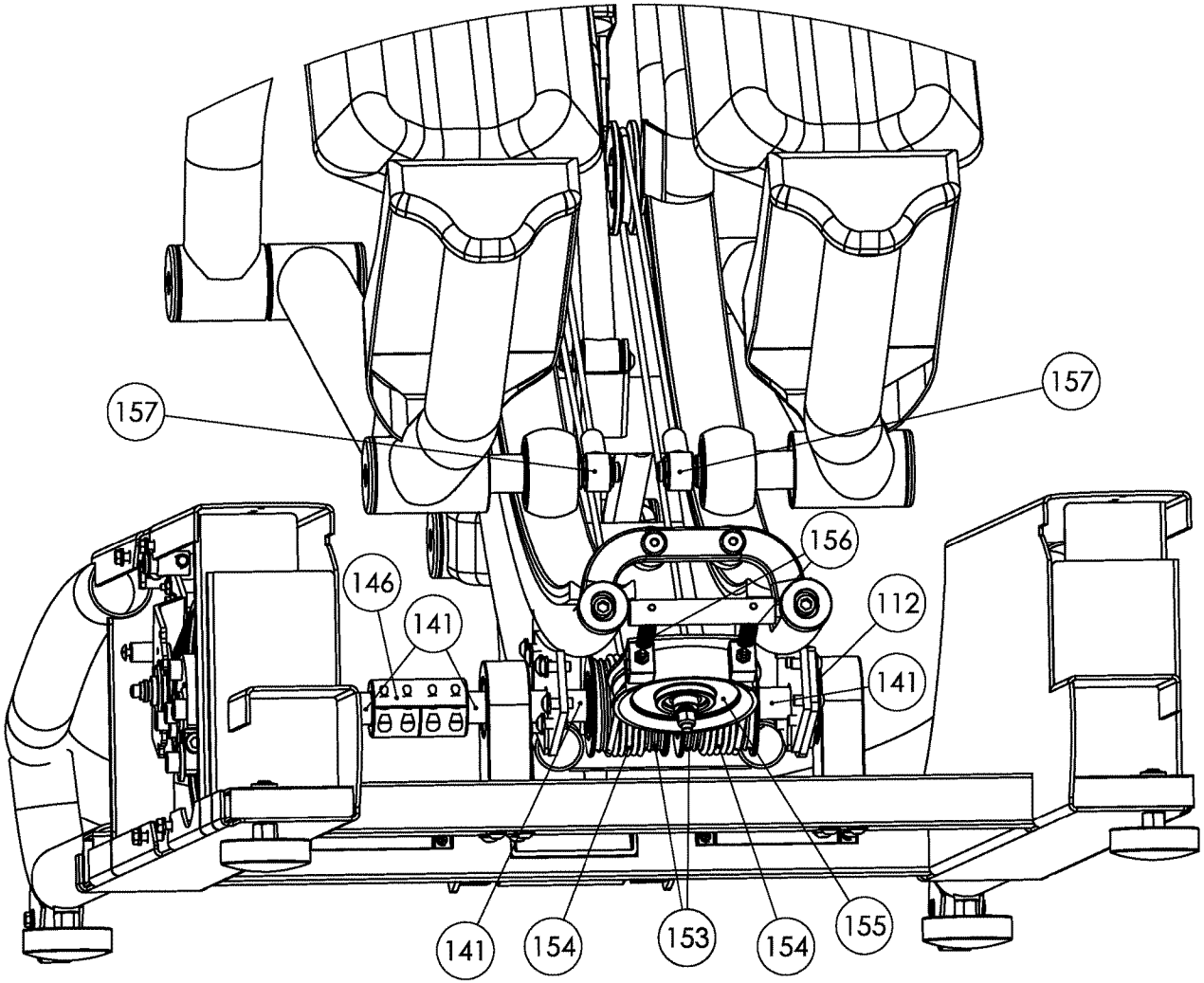
FIG. 20 is a close up view of the lower rear section of the invention with an electrical angle adjustment mechanism.
Figure 21:
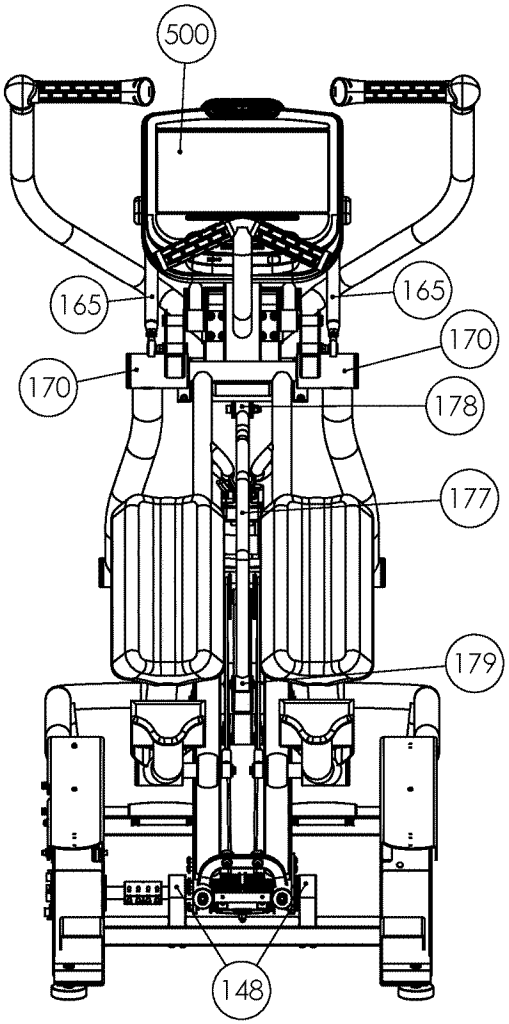
FIG. 21 is a rear view of the invention with an electrical angle adjustment mechanism.
Figure 22:
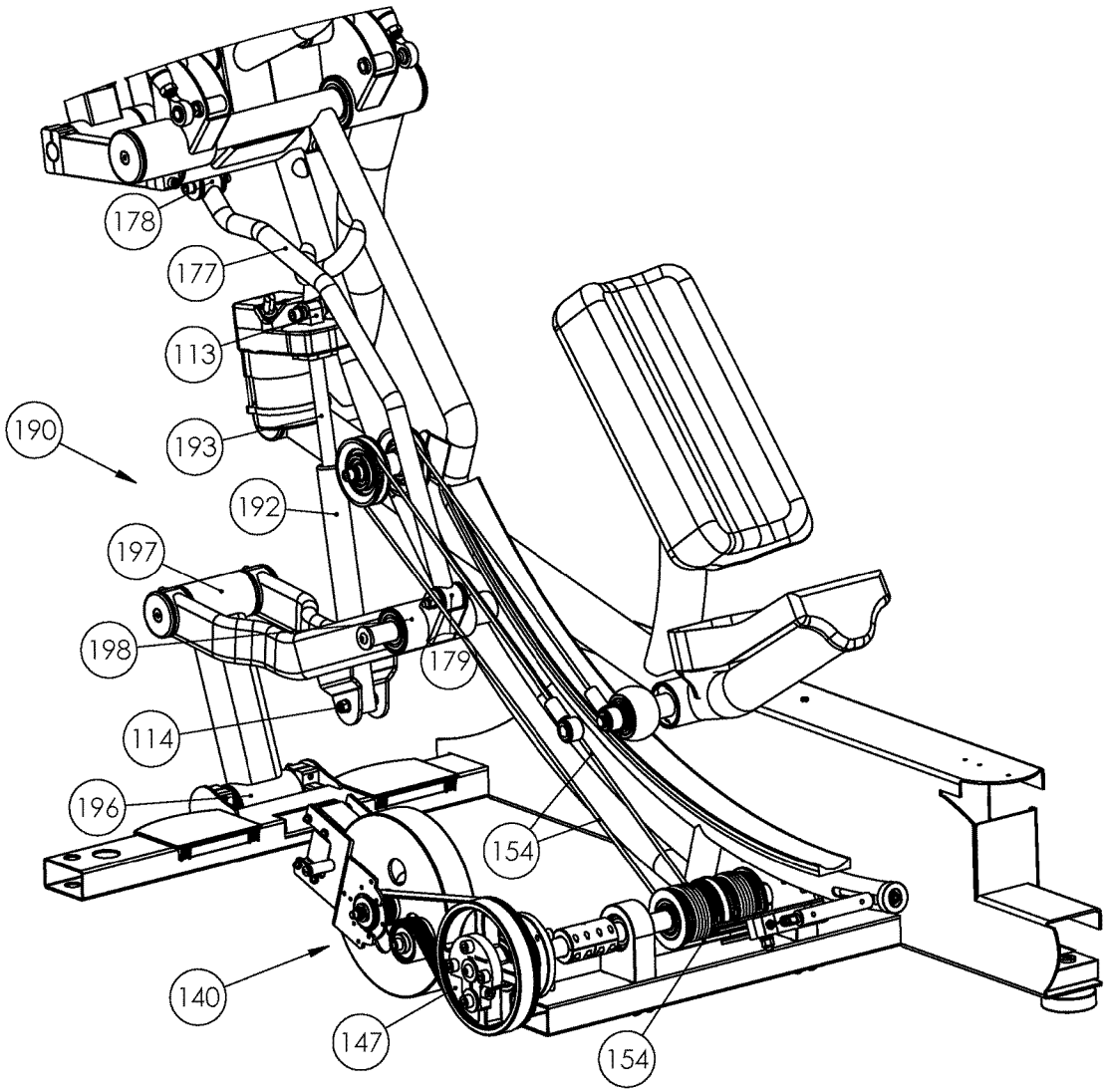
FIG. 22 is a left side perspective view of the invention at a mid angle position with an electrical angle adjustment mechanism and some components removed to offer a better view of other components.
Figure 23:
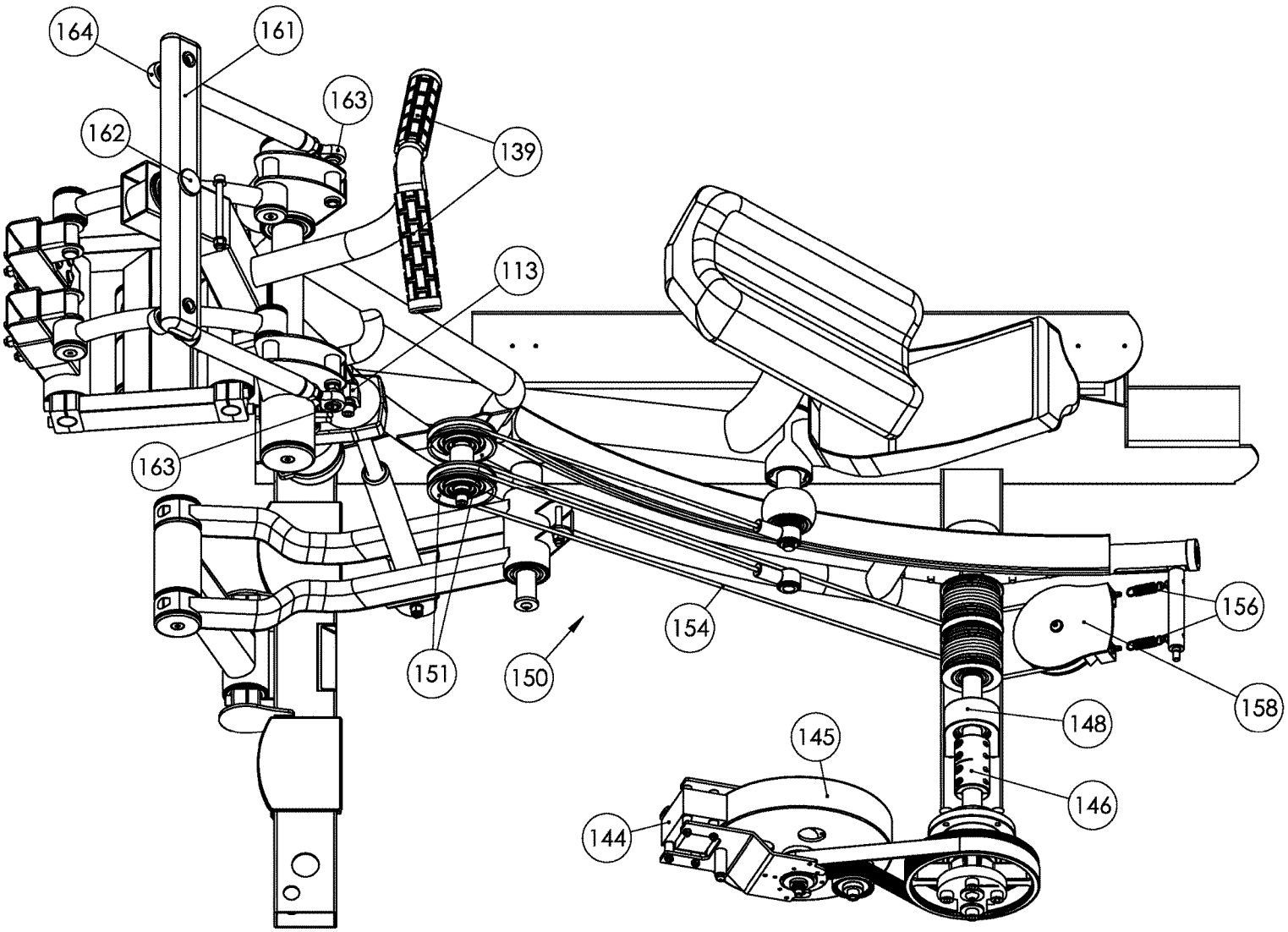
FIG. 23 is an elevated left side perspective view of the invention at a mid angle position with an electrical angle adjustment mechanism illustrated with some components removed to offer a better view of other components.
Figure 24:
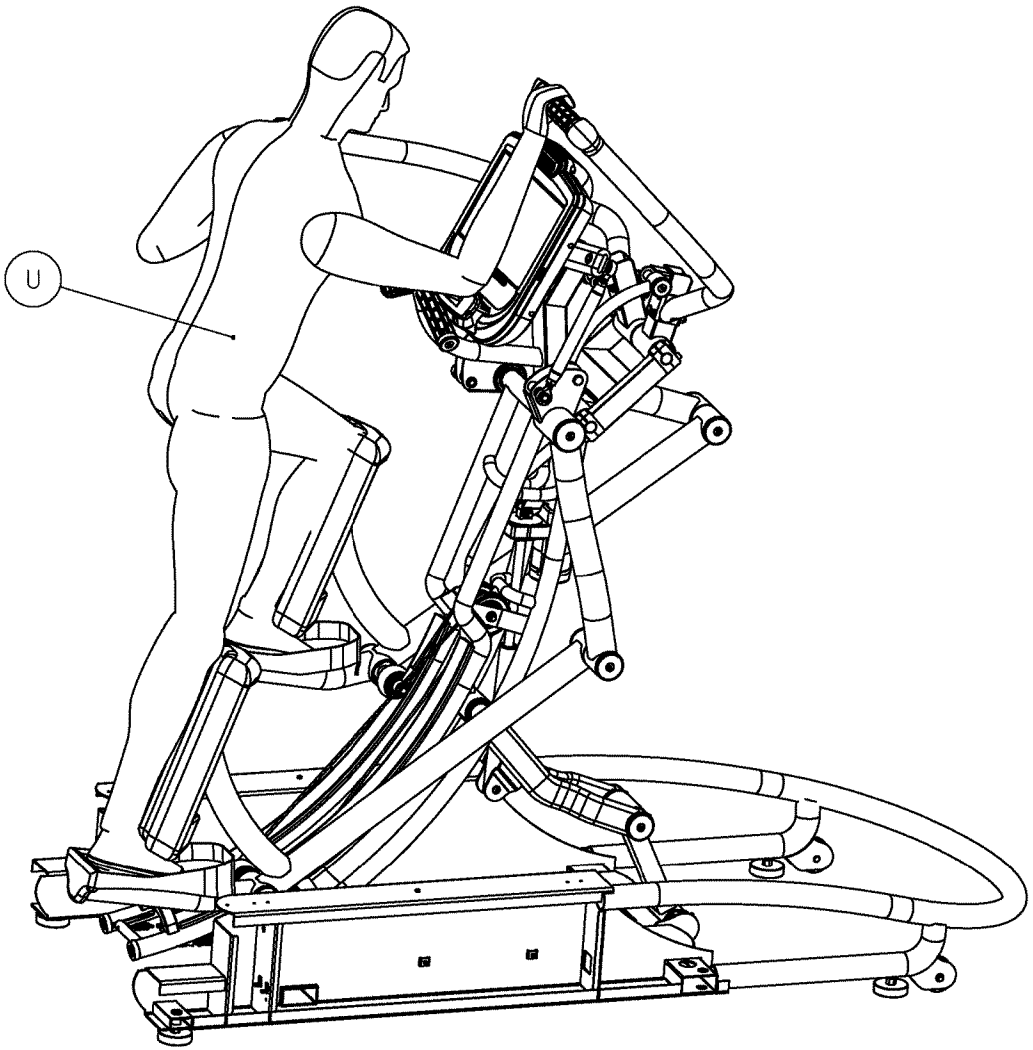
FIG. 24 is a right side view of the invention at a higher angle position with an electric angle adjusting mechanism and a user operating the machine.
Figure 25:
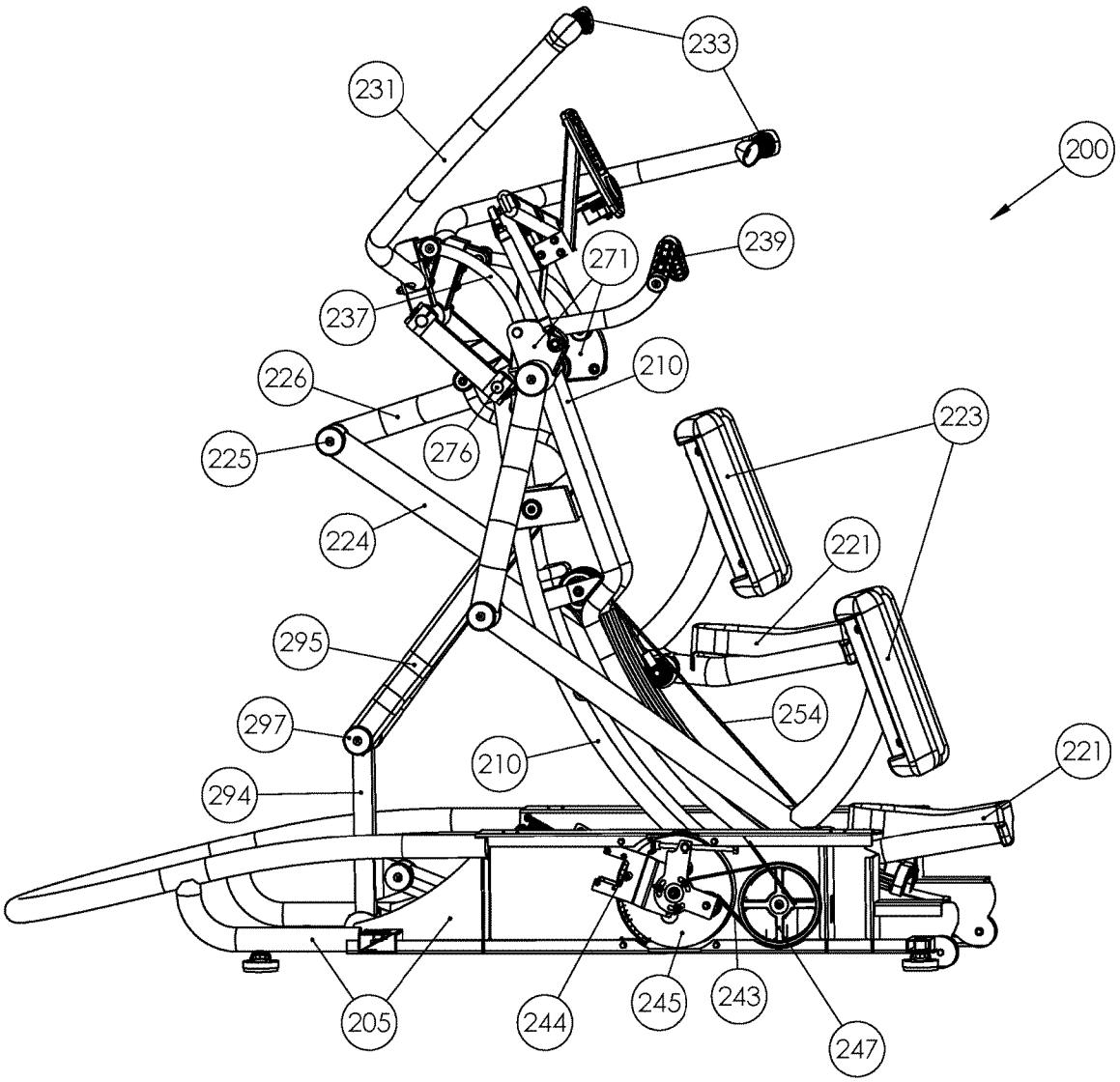
FIG. 25 is a left side view of the invention at a higher angle position with a manual gear drive angle adjustment mechanism.
Figure 26:
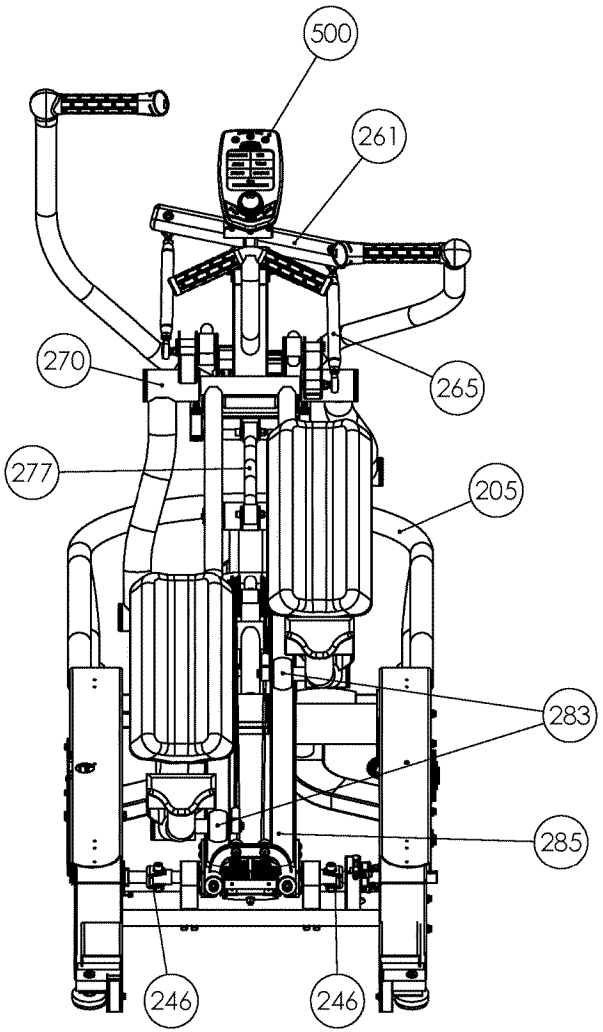
FIG. 26 is a rear view of the invention with a manual gear drive angle adjustment mechanism.

Resistance drive assembly 150 or 250 is best illustrated in FIGS. 20, 22, and 23 and described in detail as follows:

A resistance drive cable 154 or 254 is pivotably connected at a first end to the axle of left side lower body user support wheel 183 or 283 with resistance drive cable connector 157 or 257 and extends forwardly along movable user support frame 110 or 210 at a left side higher elevation and continues over and around a vertically oriented left side resistance drive cable guide pulley 151 or 251 located forward of left side lower body user support wheel track 183 or 283 and returns rearwardly along movable user support frame 110 or 210 at a left side lower elevation and continues under left side one-way clutch resistance drive cable spool 153 or 253 and resistance drive cable 154 or 254 has multiple side by side wraps around left side one-way clutch resistance drive cable spool 153 or 253 then continues rearwardly from under left side one-way clutch resistance drive cable spool 153 or 253 and then wraps around a horizontally oriented resistance drive cable tensioner pulley 155 or 255 and returns forwardly and underneath a right side one-way clutch resistance drive cable spool 153 or 253 and resistance drive cable 154 or 254 has multiple side by side wraps around right side one-way clutch resistance drive cable spool 153 or 253 and continues forwardly from under right side one-way clutch resistance drive cable spool 153 or 253 along movable user support frame 110 or 210 at a right side lower elevation and then wraps around a vertically oriented right side resistance drive cable guide pulley 151 or 251 located forward of right side lower body user support wheel track 183 or 283 and returns rearwardly along movable user support frame 110 or 210 at a right side higher elevation and the second end of resistance drive cable 154 or 254 pivotally connects to the axle of right side lower body user support wheel 183 or 283 with resistance drive cable connector 157 or 257 such that resistance drive assembly 150 or 250 transfers the pushing and pulling force exerted by the user from the upper and lower body user supports to the resistance assembly 140.

As lower body user support wheels 183 or 283 roll back and forth on lower body user support tracks 185 or 285 during operation of machine 100, 200, or 300, various sections of resistance drive cable 154 or 254 wrap onto and off of one-way clutch resistance drive cable spools 153 or 253. The multiple wraps of resistance drive cable 154 or 254 on left and right one-way clutch resistance drive cable spools 153 or 253 creates adequate gripping traction of resistance drive cable 154 or 254 on one-way clutch resistance drive cable spools 153 or 253 to prevent resistance drive cable 154 or 254 from slipping on one-way clutch resistance drive cable spools 153 or 253 during operation of machines 100, 200. or 300. Resistance drive cable tensioner pulley 155 or 255 is mounted in resistance drive cable tensioner pulley housing 158 or 258 and suspended between one-way clutch resistance drive cable spools 153 or 253 and the rearward end of movable user support frame 110 or 210 with adequate tension to keep resistance drive cable 154 or 254 taunt during operation of machines 100, 200. and 300. Resistance drive cable tensioner pulley 155 or 255 is tensioned by left and right resistance drive cable tensioner pulley springs 156 or 256 wherein the first ends of resistance drive cable tensioner pulley springs 156 or 256 are connected to resistance drive cable tensioner pulley housing 158 or 258 and the second ends of resistance drive cable tensioner pulley springs 156 or 256 are connected to the rearward end of movable user support frame 110 or 210.

During operation of machines 100, 200. and 300, left and right one-way clutch resistance drive cable spools 153 or 253 reciprocally engage and disengage resistance drive axle 141 or 241 such that one of the one-way clutch resistance drive cable spools 153 or 253 is engaged with drive axle 141 or 241 while the other one-way clutch resistance drive cable spools 153 or 253 is disengaged with drive axle 141 or 241. Each time the user changes the direction of motion of the user supports, one of the one-way clutch resistance drive cable spools 153 or 253 instantly engages with drive axle 141 or 241 while the other one-way clutch resistance drive cable spools 153 or 253 instantly disengages from drive axle 141 or 241.

The central portion of resistance drive axle 141 or 241 is mounted on stationary base frame 105 or 205 with left and right resistance drive axle bearings 148 or 248. Movable user support frame 110 or 210 is pivotably mounted on the central portion of resistance drive axle 141 or 241 but pivots independently of resistance drive axle 141 or 241 on left and right movable user support frame base pivots 112 and 212. The left side of resistance drive 141 or 241 and the central portion of resistance drive axle 141 or 241 are operatively and rigidly connected with resistance drive axle coupling 146 to allow for ease of assembly of machines 100, 200, and 300.

Machines 100, 200, and 300 illustrate resistance assembly 140 or 240 being located on the left side of the stationary base frame 105 or 205, however it could be placed on either the left or right side of the stationary base frame 105 or 205 and other features and components located on the right side of stationary base frame 105 or 205 disclosed in the illustrations and descriptions herein can be placed on the opposite side of the stationary base frame 105 or 205.

Figure 16:
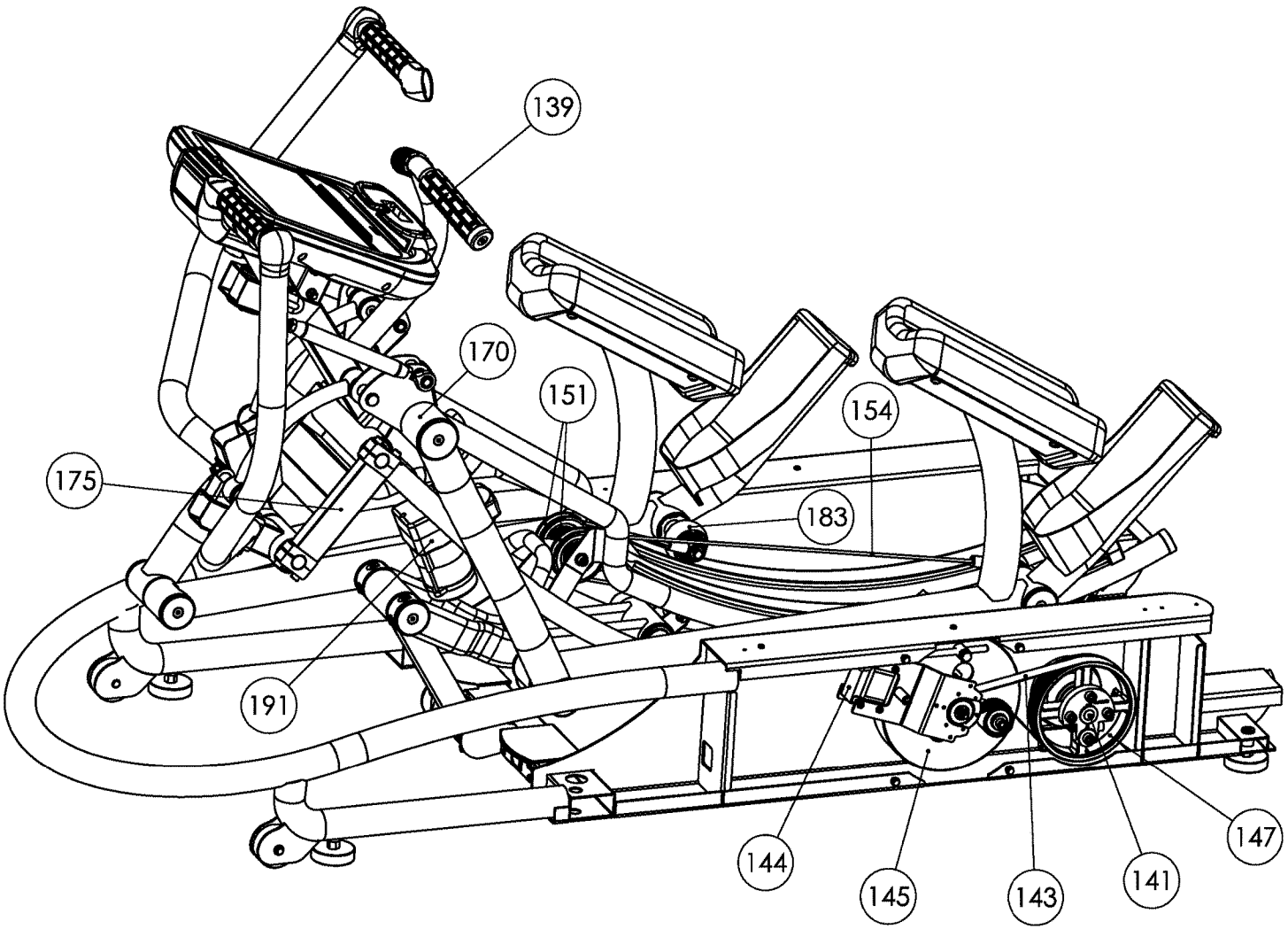
FIG. 16 is a left side perspective view of the invention at a lower angle position with an electrical angle adjustment mechanism.

Resistance assembly 140 or 240 is best illustrated in FIGS. 16, 22, and 23 and described in detail as follows:

Resistance drive pulley 147 or 247 is rigidly mounted on resistance drive axle 141 or 241. Resistance drive pulley 147 or 247 which transfers the rotational force from resistance drive axle 141 or 241 with resistance flywheel belt 143 or 243 to resistance flywheel 145 or 245. Resistance flywheel resistance magnet 144 or 244 creates an adjustable braking resistance to the rotation of resistance flywheel 145 or 245 to increase or decrease the amount of force required by user U to rotate resistance flywheel 145 or 245. However, other components or devices or combination of component or devices can also be utilized with the invention to create an adjustable braking resistance to resistance flywheel 145 or 245 including but not limited to fan blades, friction brakes, electric brake motors, and liquid resistance such as a paddle wheel rotating in liquid. Resistance flywheel 145 or 245 is illustrated as rotating on its own separate axle from resistance axle 141 or 241 which is configured to reduce the effort required by the user U to generate higher revolutions per minute of flywheel 145 or 245 in order to create a lower starting resistance to the exercise motion and a greater range of achievable resistance to the exercise motion, however resistance flywheel 145 or 245 could be mounted rigidly to resistance axle 141 or 241 and achieve a braking resistance to exercise motion of machines 100, 200, or 300.

As illustrated in FIGS. 15-40 and described herein when user U mounts machine 100, 200, or 300 and begins urging any or all of the user supports into their respective reciprocating motions, left and right foot platforms 121 or 221 and left and right shin pads 123 or 223 transfer the force generated by user U's legs into left and right first lower body user support linkage bars 124 or 224 and left and right second lower body user support linkage bars 126 or 226 which transfer the force into left and right linkages connections hubs 170 and 270. Concurrently with this motion, left and right upper body user support grips handles 133 or 233 transfer the force generated by user U's hands and arms into left and right upper body user support lever arms 131 or 231, which transfer the force into left and right upper body user support linkage bars 137 or 237, which transfer the force into left and right linkages connection hub flanges 171 or 271 such that the urging force generated by user U into the left side upper and lower body user supports is operatively and dependently connected and the urging force generated by user U into the right side upper and lower body user supports is operatively and dependently connected.

The urging force generate by user U into the dependently connected left side upper and lower body user supports is operatively connected from left side linkages connection hub 170 or 270 to the left side of rocker arm 161 or 261 with a rocker arm linkage bar 165 or 265 and the urging force generate by user U into the dependently connected right side upper and lower body user supports is operatively connected from left side linkages connection hub 170 or 270 to the right side of rocker arm 161 or 261 with a rocker arm linkage bar 165 or 265 such that the urging force generated by user U into any of the upper or lower body user supports is synchronized and transferred between all four user supports such that all four user supports are operatively and dependently connected to transfer a single force into the resistance system of machine 100, 200, or 300.

The collective force urged into the user supports of the invention by user U can be transferred to the one directional resistance system with various resistance drive assemblies operatively connected to any or all of the upper or lower body user supports. In the embodiments illustrated in FIGS. 15-40, when user U urges any of the dependently connected user supports as described herein, a singular resistance drive cable 154 or 254 pivotably connected at each end to the axles of left and right lower body user support wheels 183 or 283 reciprocally rotates left and right one-way clutch resistance drive cable spools 153 or 253 transferring the force to resistance drive axle 141 or 241 causing it to rotate in one direction which transfers the force by causing rotation of resistance flywheel drive pulley 147 or 247 which transfers the force by causing movement of resistance flywheel drive belt 143 or 243 which transfers the force by rotating resistance flywheel 145 or 245. A resistance to the urging force required by user U to rotate resistance flywheel 145 or 245 is generated by a resistance flywheel resistance magnet 144 or 244. The resistance force generated by resistance flywheel resistance magnet 144 or 244 is adjustable by user U.

Referring to FIGS. 15-24, machine 100 is an embodiment of the invention with an electrical angle adjustment wherein user U can activate angle adjustment assembly 190 to adjust the angle of movable user support frame 110 with controls located on the exercise information console 500 or other locations on the movable user support frame 110 that are conveniently accessible by user U.

Figure 17:
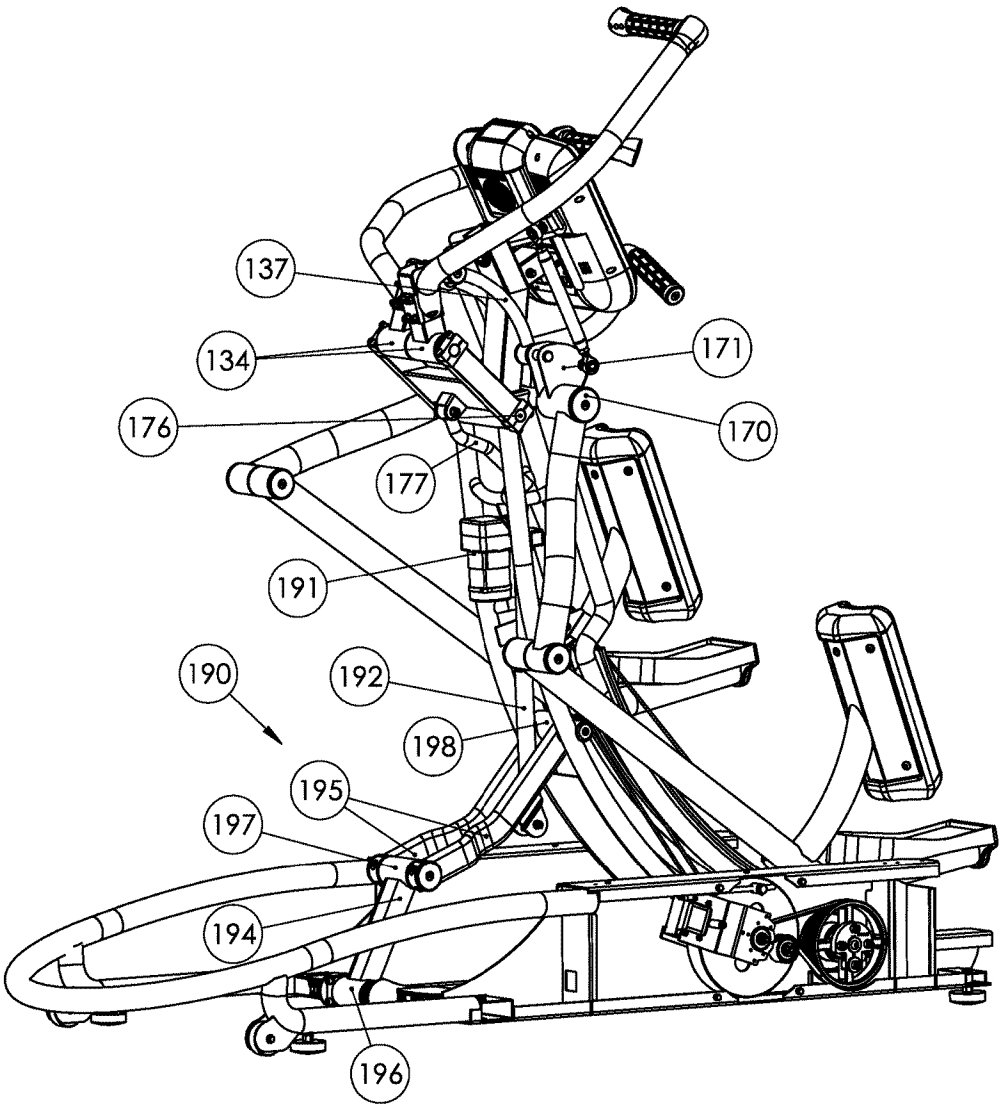
FIG. 17 is a left side perspective view of the invention at a higher angle position with an electrical angle adjustment mechanism.
Figure 18:
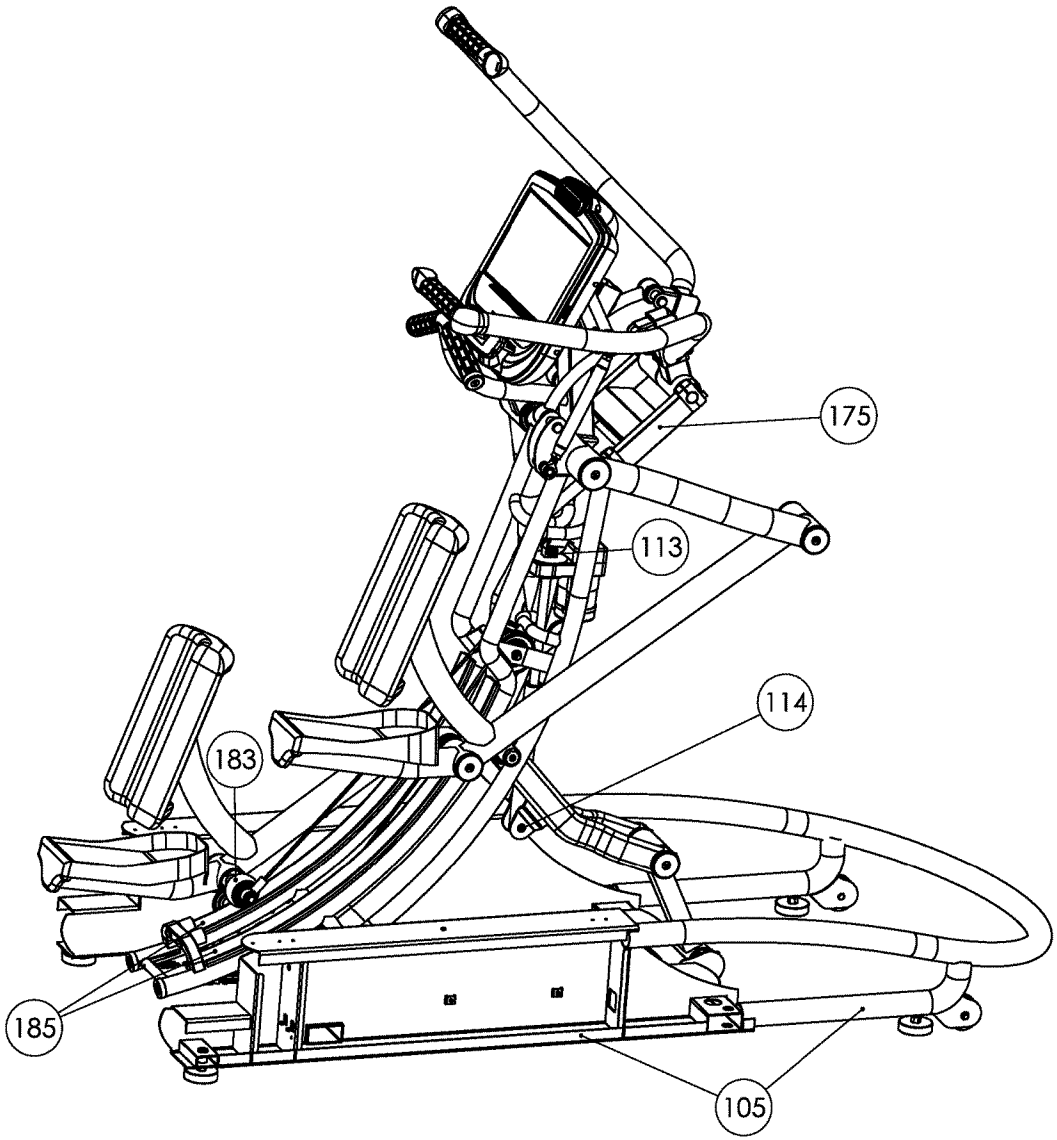
FIG. 18 is a right side perspective view of the invention at a higher angle position with an electrical angle adjustment mechanism.

Angle adjustment assembly 190 is best illustrated in FIGS. 17 and 22 and described in detail as follows:

Angle adjustment actuator 191 which rotates angle adjustment actuator inner shaft 193 in a first direction to rotate it down into angle adjustment actuator outer tube 192 and rotates angle adjustment actuator inner shaft 193 in a second direction to rotate it out of angle adjustment actuator outer tube 192. First angle adjustment linkage bar 194 which is pivotably connected at a first end to a central or forward portion of stationary base frame 105 with angle adjustment linkage lower pivot 196 and pivotably connected at a second end to a first end of second angle adjustment linkage bar 195 with angle adjustment linkage mid pivot 197 and a second end of second angle adjustment linkage bar 195 is pivotably connected to a central portion of movable user support frame 110 with angle adjustment linkage upper pivot 198. Angle adjustment actuator 191 which is connected to an upper and forward portion of movable user support frame 110 with angle adjustment actuator upper pivot 113 and angle adjustment actuator outer tube 192 is connected to a central portion of second angle adjustment link bars 195 with angle adjustment actuator lower pivot 114.

When angle adjustment assembly 190 is activated to move movable user support frame 110 from a higher angle position to a lower angle position, angle adjustment actuator 191 rotates angle adjustment actuator inner shaft 193 in a first direction which rotates angle adjustment actuator inner shaft 193 into angle adjustment actuator outer tube 192 which reduces the distance between angle adjustment actuator upper pivot 133 and angle adjustment actuator lower pivot 114. This causes first angle adjustment linkage bar 194 to pivot about angle adjustment linkage lower pivot 196 and second angle adjustment linkage bars 195 to pivot about angle adjustment linkage upper pivot 198 such that angle adjustment linkage mid pivot 197 move towards the front of stationary base frame 105 and angle adjustment linkage upper pivot moves downward. When angle adjustment assembly 190 is activated to move movable user support frame 110 from a lower angle position to a higher angle position, angle adjustment actuator 191 rotates angle adjustment actuator inner shaft 193 in an opposite second direction, which rotates angle adjustment actuator inner shaft 193 out of angle adjustment actuator outer tube 192, which increases the distance between angle adjustment actuator upper pivot 133 and angle adjustment actuator lower pivot 114. This causes first angle adjustment linkage bar 194 to pivot about angle adjustment linkage lower pivot 196 and second angle adjustment linkage bars 195 to pivot about angle adjustment linkage upper pivot 198 such that angle adjustment linkage mid pivot 197 moves towards the rear of stationary base frame 105 and angle adjustment linkage upper pivot 198 moves upward.

Referring to FIGS. 25-36, machine 200 is an embodiment of the invention with a manual gear drive angle adjustment wherein user U's exercise motion on machine 200 activates manual gear drive angle adjusting assembly 215, which activates angle adjustment drive assembly 201, which activates angle adjustment assembly 290 to adjust the angle of movable user support frame 210. Machine 200 also comprises a clutch assembly 280 that can engage with or disengage from manual gear drive angle adjusting assembly 215. During operation of machine 200 angle manual gear drive angle adjusting assembly 215, angle adjustment drive assembly 201, and angle adjustment assembly 290 are constantly activated when clutch 289 is engaged, and during operation of machine 200 manual gear drive angle adjusting assembly 215, angle adjustment drive assembly 201 and angle adjustment assembly 290 are not activated when clutch 289 is disengaged.

Figure 27:
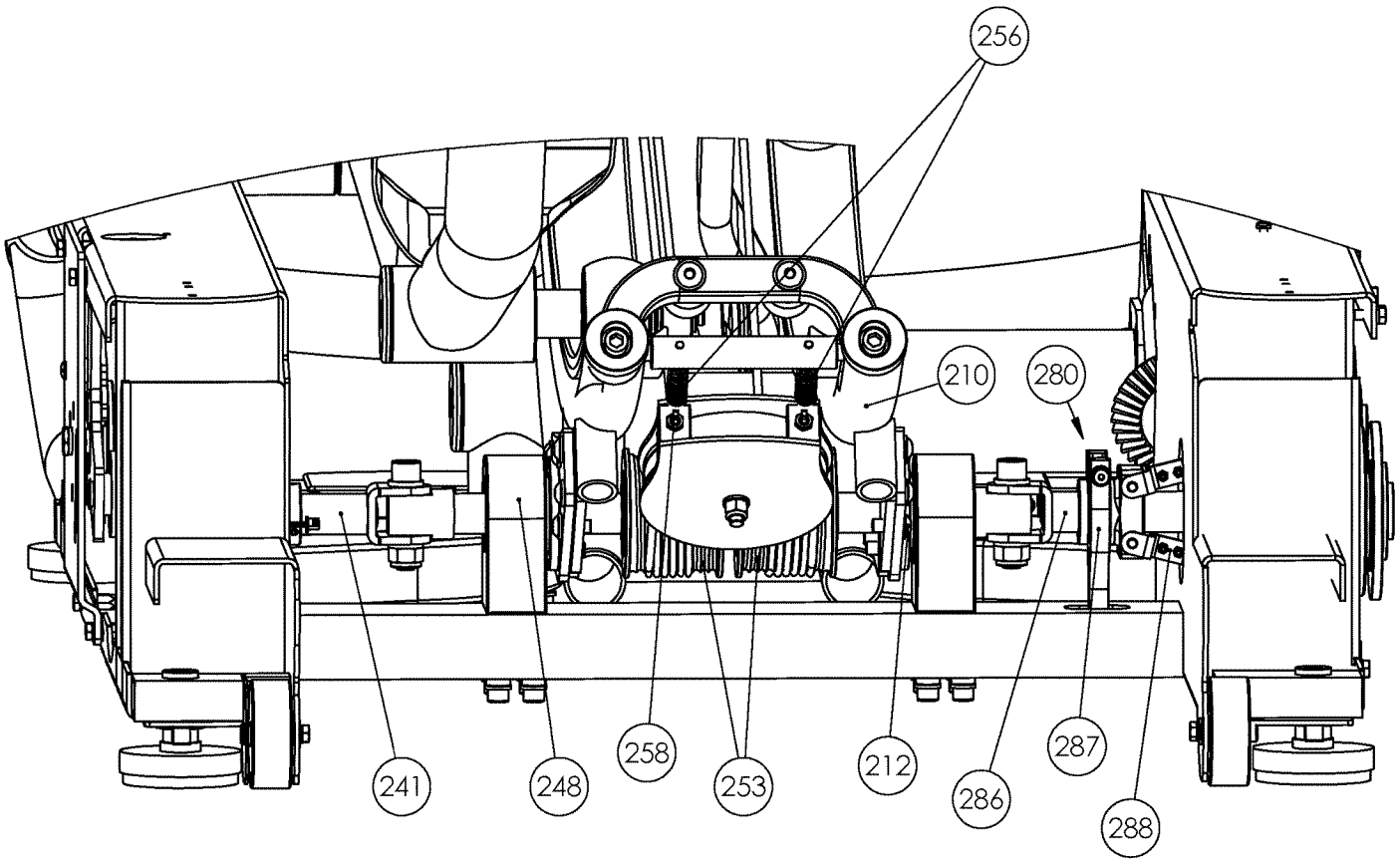
FIG. 27 is a close up view of the lower rear section of the invention with a manual gear drive angle adjustment mechanism.
Figure 28:
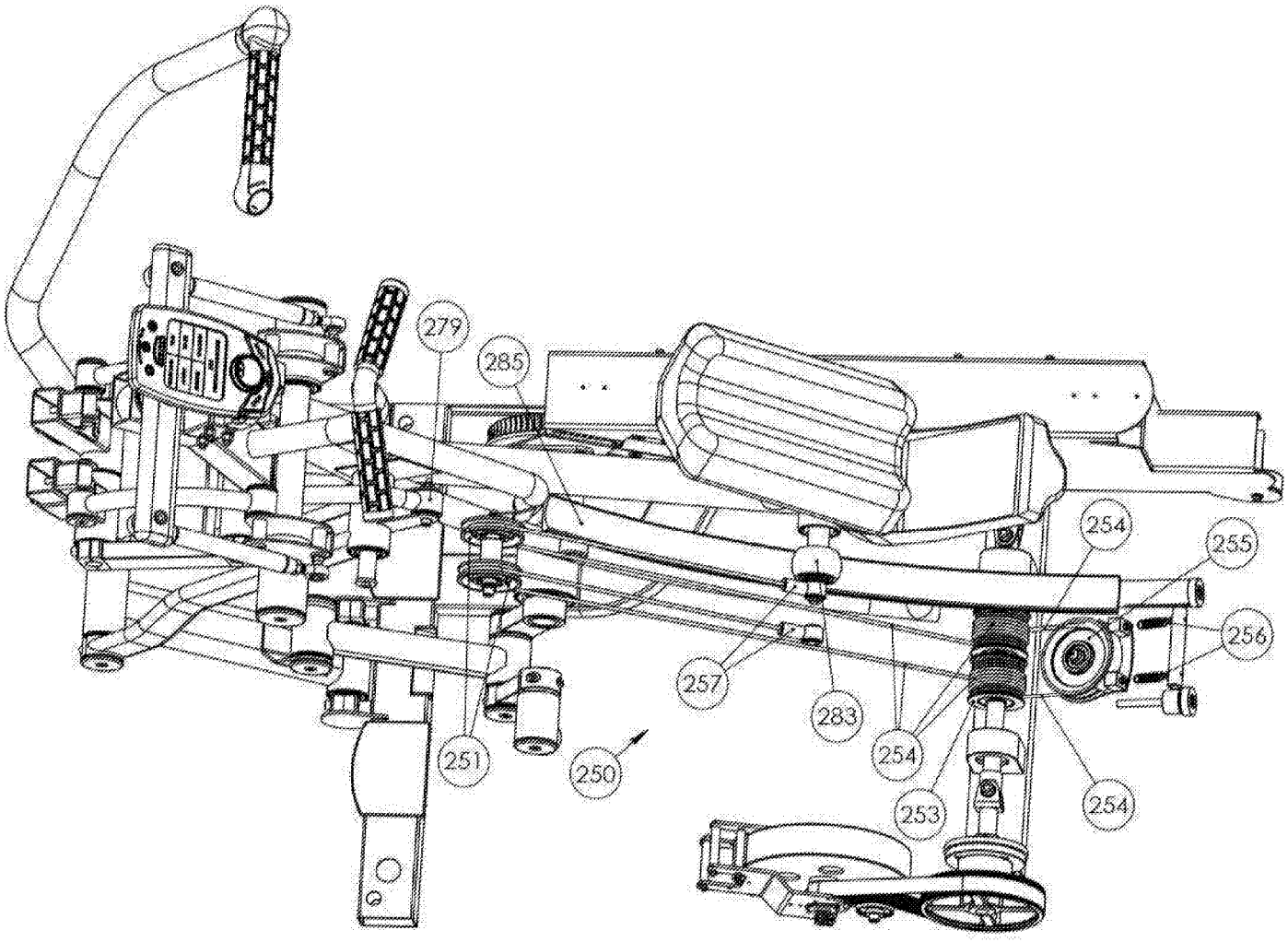
FIG. 28 is a left side overhead view of the invention with a manual gear drive angle adjustment mechanism illustrated with some components removed to offer a better view of other components.
Figure 29:
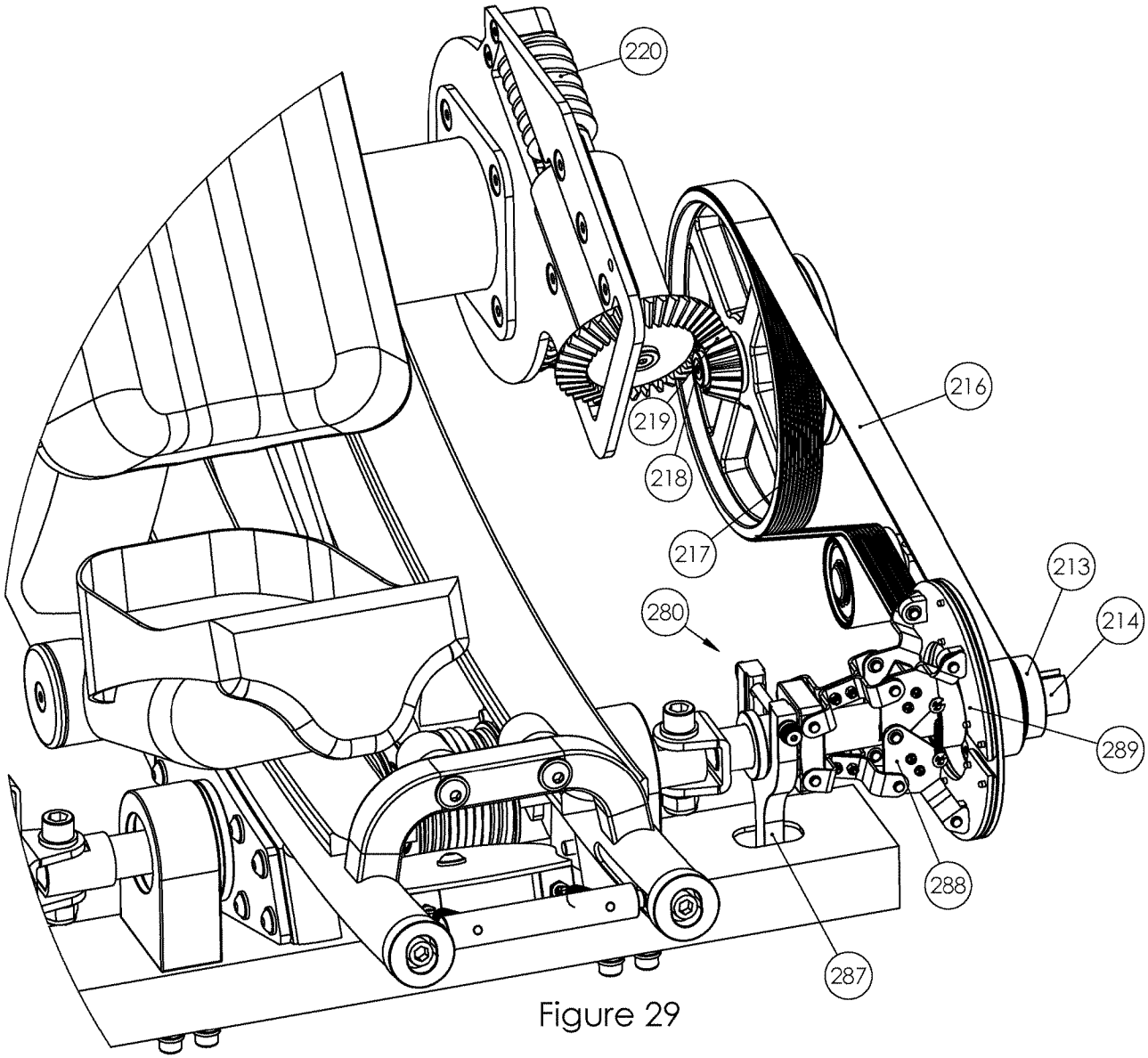
FIG. 29 is a close up view of the lower center and right side sections of the invention with a manual gear drive angle adjustment mechanism illustrated with some components removed to offer a better view of other components.

Clutch assembly 280 is best illustrated in FIGS. 27 and 29 and described in detail as follows:

A first end of a clutch drive axle 286 is operatively coupled to resistance drive axle 241 with a right side resistance drive axle coupling 246 and operatively aligned at a second end with first gear drive axle 214. A first portion of clutch engagement linkage assembly 288 is pivotably mounted to a central portion of clutch drive axle 286 and a second portion of clutch engagement linkage assembly 288 is operatively engaged with clutch engagement fork 287 to slide on clutch drive axle 286 such that clutch engagement fork 287 can pivot the first portion of clutch engagement linkage assembly 288 to engage or disengage a clutch 289. Clutch engagement fork 289 is controlled by clutch engagement switch 291. Clutch 289 can be operatively engaged with or disengaged from manual gear drive assembly 215 with first gear drive pulley 213 and first gear drive axle 214.

Figure 30:
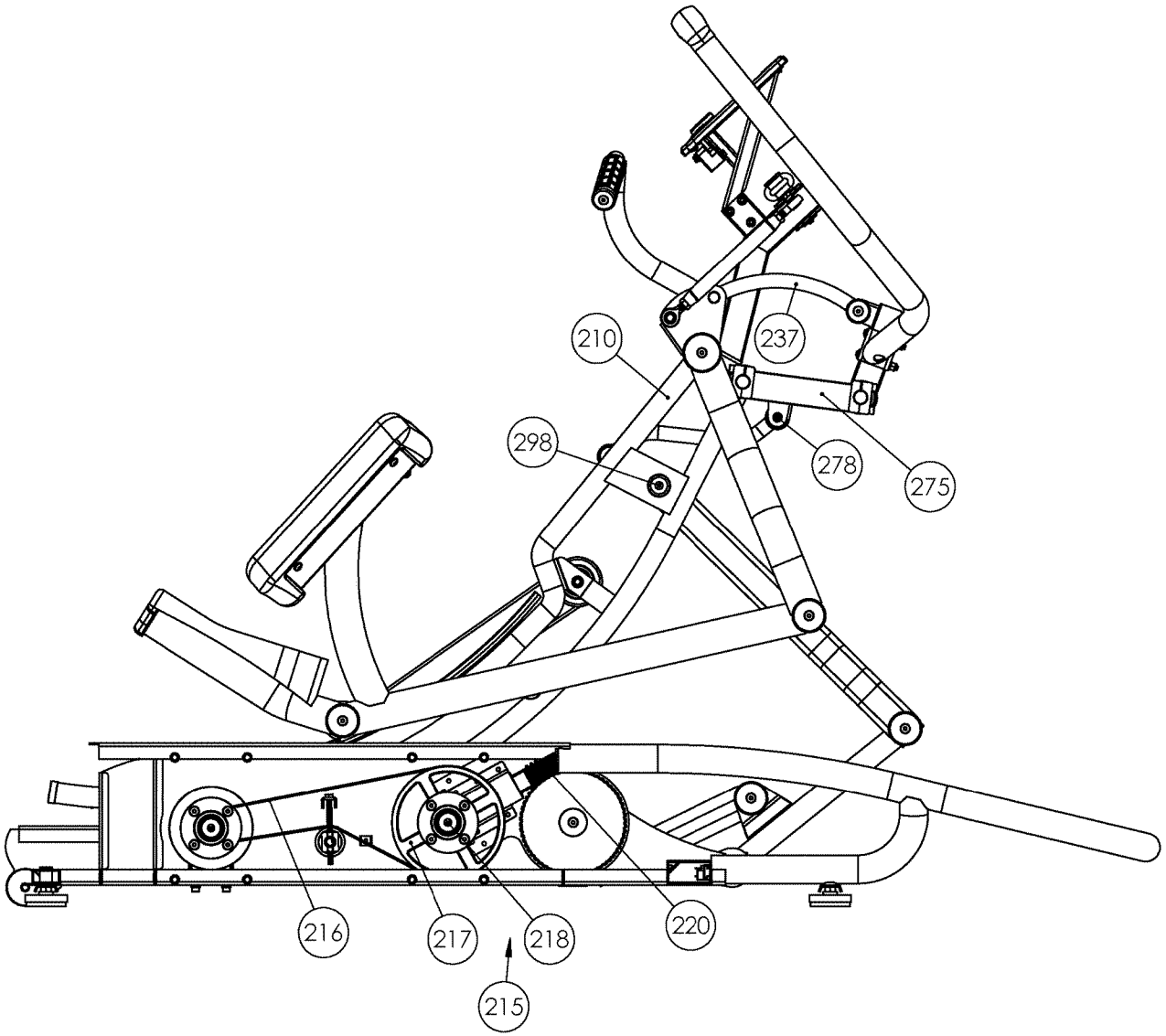
FIG. 30 is a right side view of the invention at a mid angle position with a manual gear drive angle adjustment mechanism.
Figure 32:
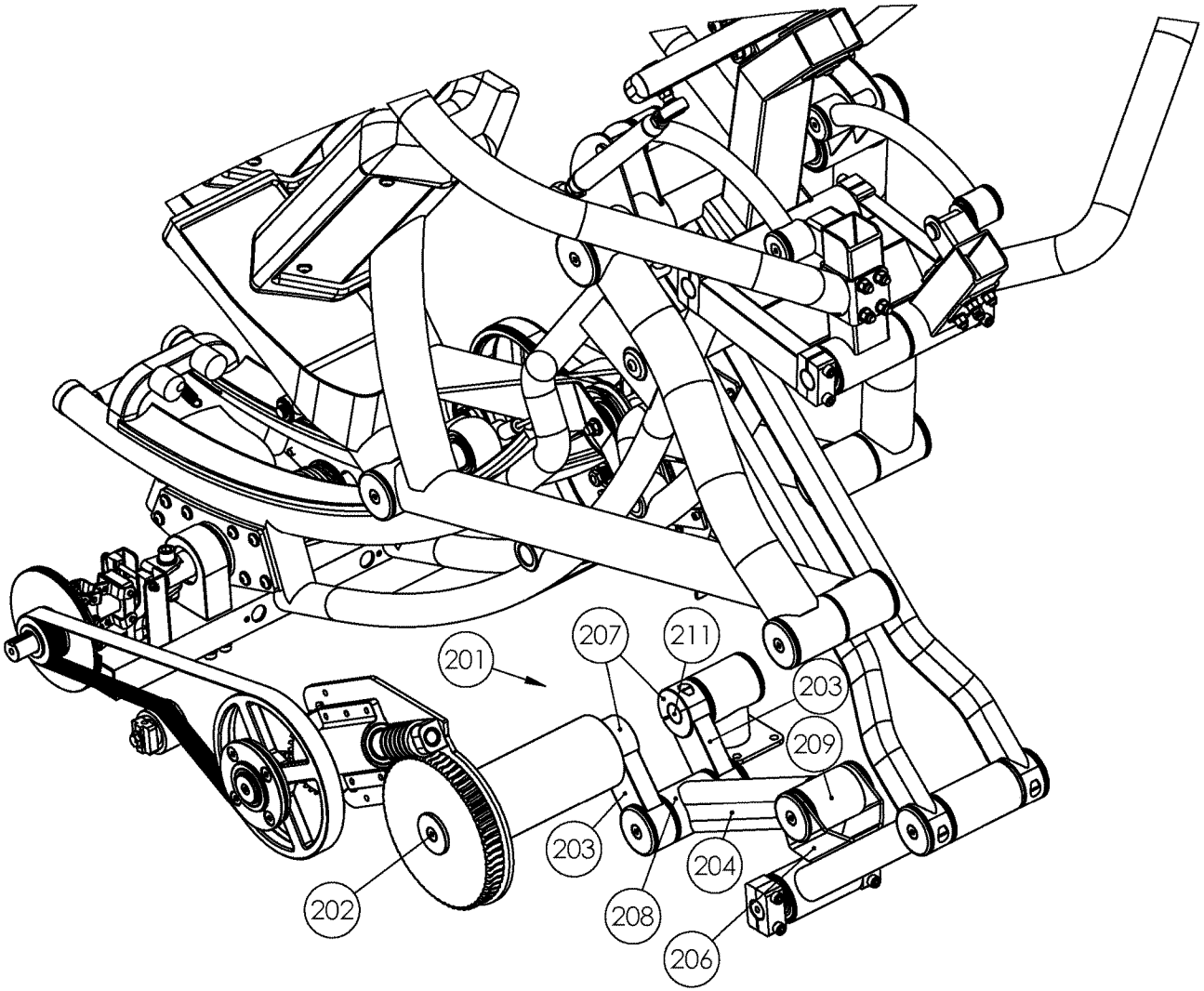
FIG. 32 is a close up front view of the central and right side of the invention with a manual gear drive adjustment mechanism illustrated with some components removed to offer a better view of other components.

Manual gear drive assembly 215 is best illustrated in FIGS. 29, 30, and 32 and described in detail as follows:

A first gear drive axle 214 is operatively aligned with clutch drive axle 286 but rotates independently of clutch drive axle 286. A first gear pulley 213 is rigidly mounted on first gear drive axle 214 such that first gear pulley 213 and first gear drive axle 214 rotate together. Gear drive pulley belt 216 operatively connects first gear pulley 213 to a second gear pulley 217. Second gear pulley 217 is rigidly connected to second gear drive axle 218 and second gear drive axle 218 is operatively engaged with first drive gears 219 and first drive gears 219 are operatively engaged with second drive gears 220 and second drive gears 220 are operatively engaged with angle adjusting drive axle 202. In this embodiment of the invention, first drive gears 219 are represented as a bevel gearing assembly and second drive gears 220 are represented as a worm gear assembly, however various gearing assemblies including pulleys with flexible drive components gearing assemblies could be used to drive the angle adjusting system of machine 200 and achieve the same or very similar operation of machine 200.

Angle adjusting drive assembly 201 is best illustrated in FIG. 32 and described in detail as follows:

Angle adjusting drive axle 202 is rigidly connected to a right side angle adjusting drive assembly first pivot 207 and a left side angle adjusting drive first pivot 207 is rigidly connected to angle adjusting drive guide axle 211. Left and right first angle adjusting drive link bars 203 rotate at a first end on angle adjusting drive first pivots 207 and a second end of left and right angle adjusting drive linkage bars 203 are rotatably connected to a first end of second angle adjusting drive linkage bar 204 with angle adjusting drive second pivot 208 and a second end of second angle adjusting drive linkage bar 204 is pivotably connected to second angle adjusting drive linkage bar connection flange 206 with angle adjusting drive third pivot 209 and second angle adjusting drive linkage bar connection flange 206 is rigidly connected to a lower central portion of first angle adjustment linkage bar 294.

Figure 31:
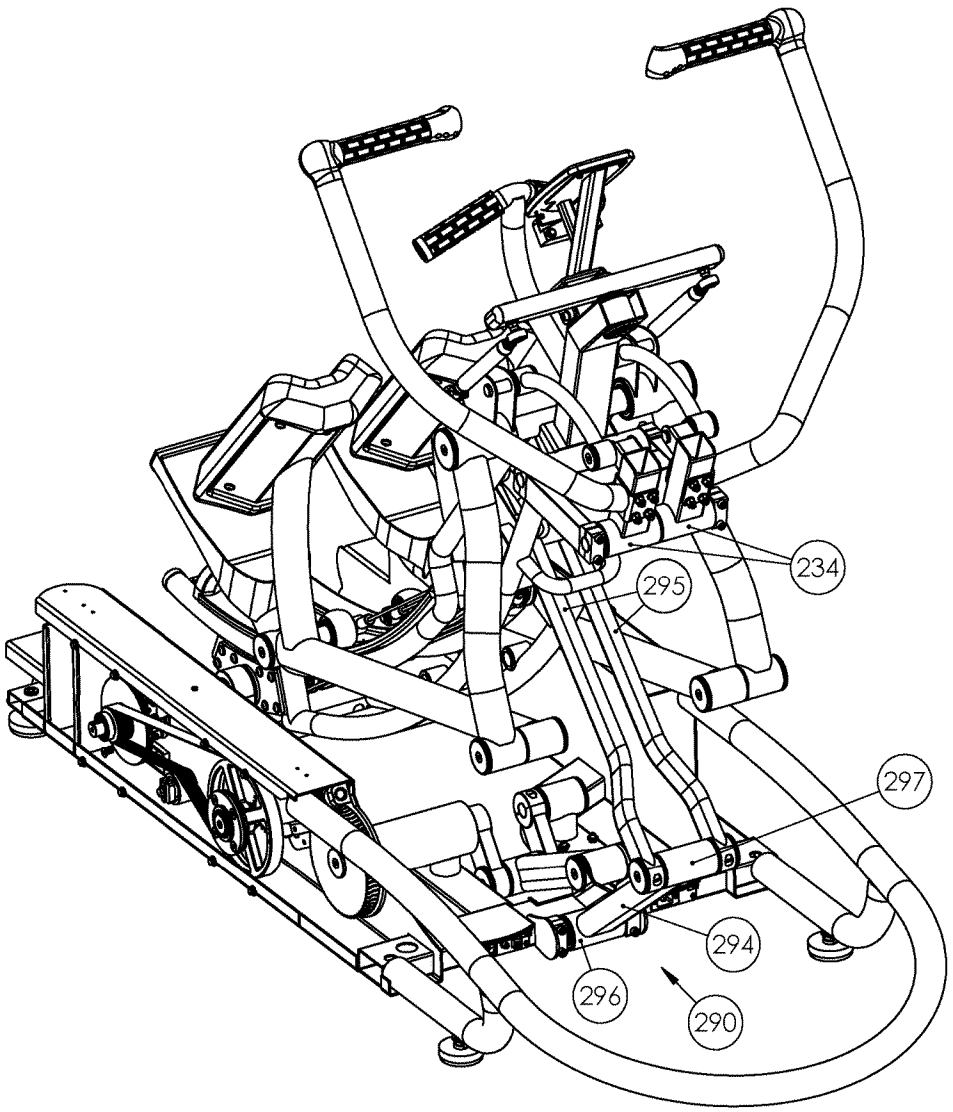
FIG. 31 is a front perspective view of the right side of the invention in a mid angle position with a manual gear drive adjustment mechanism.

Angle adjustment assembly 290 is best illustrated in FIG. 31 and described in detail as follows:

A first end of first angle adjustment linkage bar 294 is pivotably connected to stationary base frame 205 with angle adjustment linkage lower pivot 296 and a second end of first angle adjustment linkage bar 294 is pivotably connected to first ends of left and right second angle adjustment linkage bars 295 with angle adjustment linkage mid pivot 297 and second ends of left and right second linkage bars 295 are pivotably connected to movable user support frame 210 at angle adjustment linkage upper pivot 298.

When user U urges upper body user support grip handles 233 and or foot platforms 221 to activate machine 200, the resistance drive assembly 250 engages and rotates resistance axle 241 as previously described herein. This causes the left side of resistance drive axle 241 to operatively engage resistance assembly 240 as previously described herein and concurrently the right side of resistance drive axle 241 is operatively connected to and rotates clutch drive axle 286. If clutch engagement switch 291 has clutch engagement fork 287 located in the disengaged position such that clutch linkage assembly 288 and clutch 289 are not operatively engaged with manual gear drive assembly 215 then manual gear drive assembly 215, angle adjustment drive assembly 201, angle adjustment assembly 290, and movable user support frame 210 will remain stationary when machine 200 is being activated by user U.

If clutch engagement switch 291 has clutch engagement fork 287 located in the engaged position when user U is operating machine 200 this causes clutch linkage assembly 288 to move clutch 289 into a position of being operatively engaged with first drive gear pulley 213 and first drive gear axle 214, this causes rotational movement of first gear drive pulley 213 and first drive gear axle 214, which causes movement of gear drive pulley belt 216, which causes rotation of second gear drive pulley 217 and second gear drive axle 218, which causes second gear drive axle 218 to rotate first drive gears 219 and first drive gears 219 cause second drive gears 220 to rotate which causes rotation of angle adjusting drive axle 202. Rotation of angle adjusting drive axle 202 causes rotation of angle adjusting drive first pivots 207, which causes first angle adjusting drive link bars 203 and angle adjusting drive second pivot 208 to orbit around angle adjusting drive axle 202 and angle adjusting drive guide axle 211. This orbital rotation of angle adjusting drive second pivot 208 causes second angle adjusting drive linkage bar 204 to move in a first direction when angle adjusting drive second pivot 208 is moving below a horizontal center line that intersects the center of angle adjusting drive axle 202 and angle adjusting drive guide axle 211 and this orbital rotation of angle adjusting drive second pivot 208 causes second angle adjusting drive linkage bar 204 to move in an opposite second direction when angle adjusting drive second pivot 208 is moving above a horizontal center line that intersects the center of angle adjusting drive axle 202 and angle adjusting drive guide axle 211 such that when angle adjusting drive second pivot 208 is moving in a first direction on one side of a horizontal center line that intersects the center of angle adjusting drive axle 202 and angle adjusting drive guide axle 211, angle adjusting drive second pivot 208 pushes second angle adjusting drive linkage bar 204 forward and when angle adjusting drive second pivot 208 is moving in an opposite second direction on the other side of a horizontal center line that intersects the center of angle adjusting drive axle 202 and angle adjusting drive guide axle 211, angle adjusting drive second pivot 208 pulls second angle adjusting drive linkage bar 204 rearward. The forward movement of second angle adjusting drive linkage bar 204 causes first angle adjustment linkage bar 294 to pivot about angle adjustment linkage lower pivot 296 and second angle adjustment linkage bars 295 to pivot about angle adjustment linkage upper pivot 298 such that angle adjustment linkage mid pivot 297 move towards the front of stationary base frame 105 and angle adjustment linkage upper pivot 298 moves downward such that the angle of movable user support frame 210 moves to a lower angle position. The rearward movement of second angle adjusting drive linkage bar 204 causes first angle adjustment linkage bar 294 to pivot about angle adjustment linkage lower pivot 296 and second angle adjustment linkage bars 295 to pivot about angle adjustment linkage upper pivot 298 such that angle adjustment linkage mid pivot 297 move towards the rear of stationary base frame 205 and angle adjustment linkage upper pivot 298 moves upward such that the angle of movable user support frame 210 moves to a higher angle position.

During operation of machine 200, when clutch assembly 280 is engaged such that manual gear drive assembly 215, angle adjustment drive assembly 201, and angle adjustment assembly 290 are activated, movable user support frame 210 will continually pivot about stationary base frame 205 to move up or down to the limit of the full range of motion in a first direction and then almost immediately move in an opposite second direction to the limit of the full range of motion in the opposite second direction, and continue this reciprocating cycle until either clutch assembly 280 is disengaged from manual gear drive assembly 215 or user U ceases operating machine 200. The total up or down range of motion is limited to less than 90 degrees on one side of a vertical line and above a horizontal line. This perpetual reciprocal pattern of motion of angle change of movable user support frame 210 is achieved with the orbital motion of angle adjustment drive assembly 201.

Referring to FIGS. 37-40, machine 300 is an embodiment of the invention with a manual lever arm angle adjustment assembly 390 for locating and locking the angle of movable user support frame 310, wherein user U manually moves the angle of movable user support 310 to a preferred angle and locks it into position prior to entering and operating machine 300. The exercise motion and resistance drive operation of machine 300 are identical or very similar to those of machines 100 and 200 as previously described herein.

Figure 37:
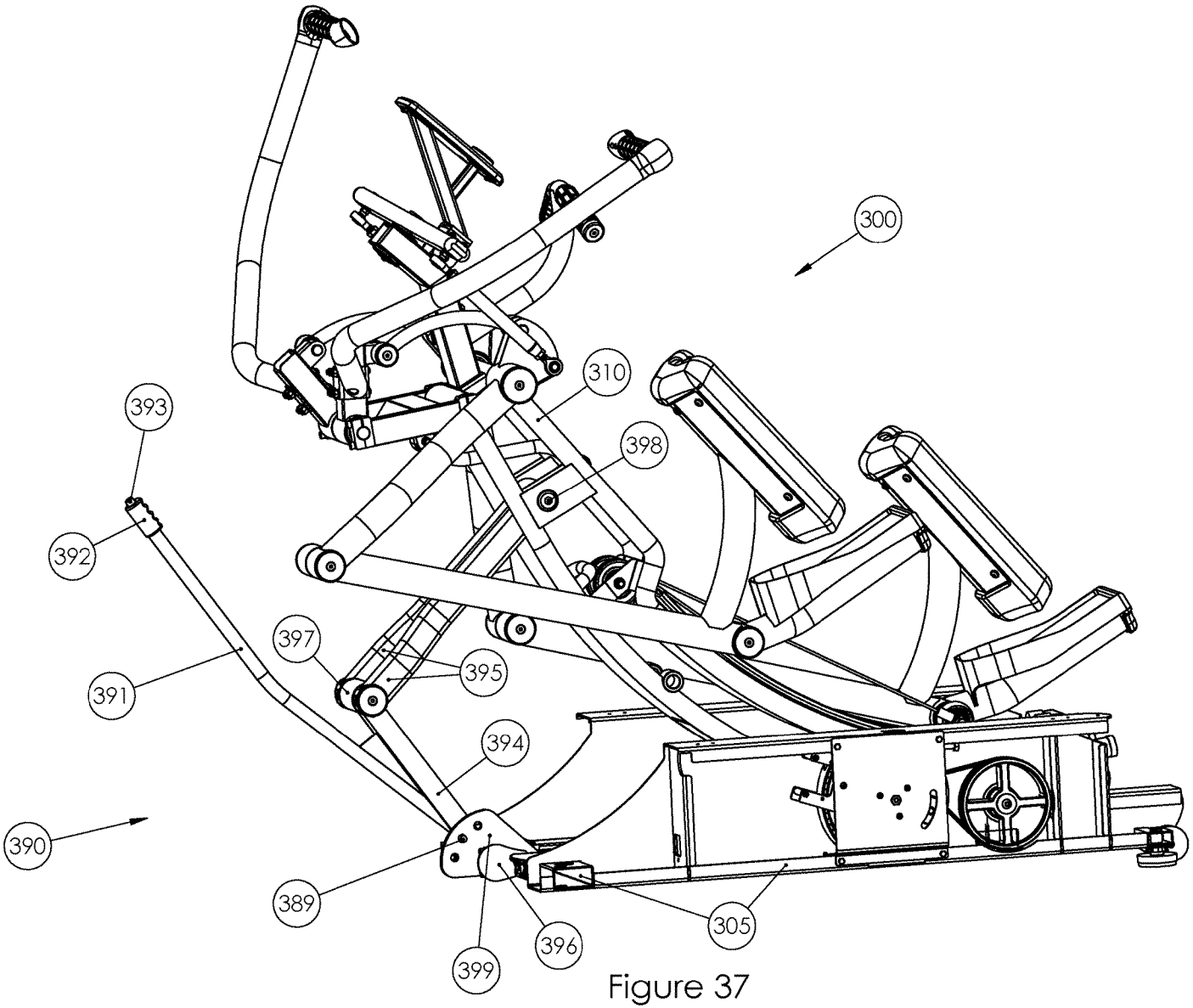
FIG. 37 is a left side view of the invention in a mid angle position with a manual lever arm angle adjustment mechanism with some components removed to offer a better view of other components.
Figure 38:
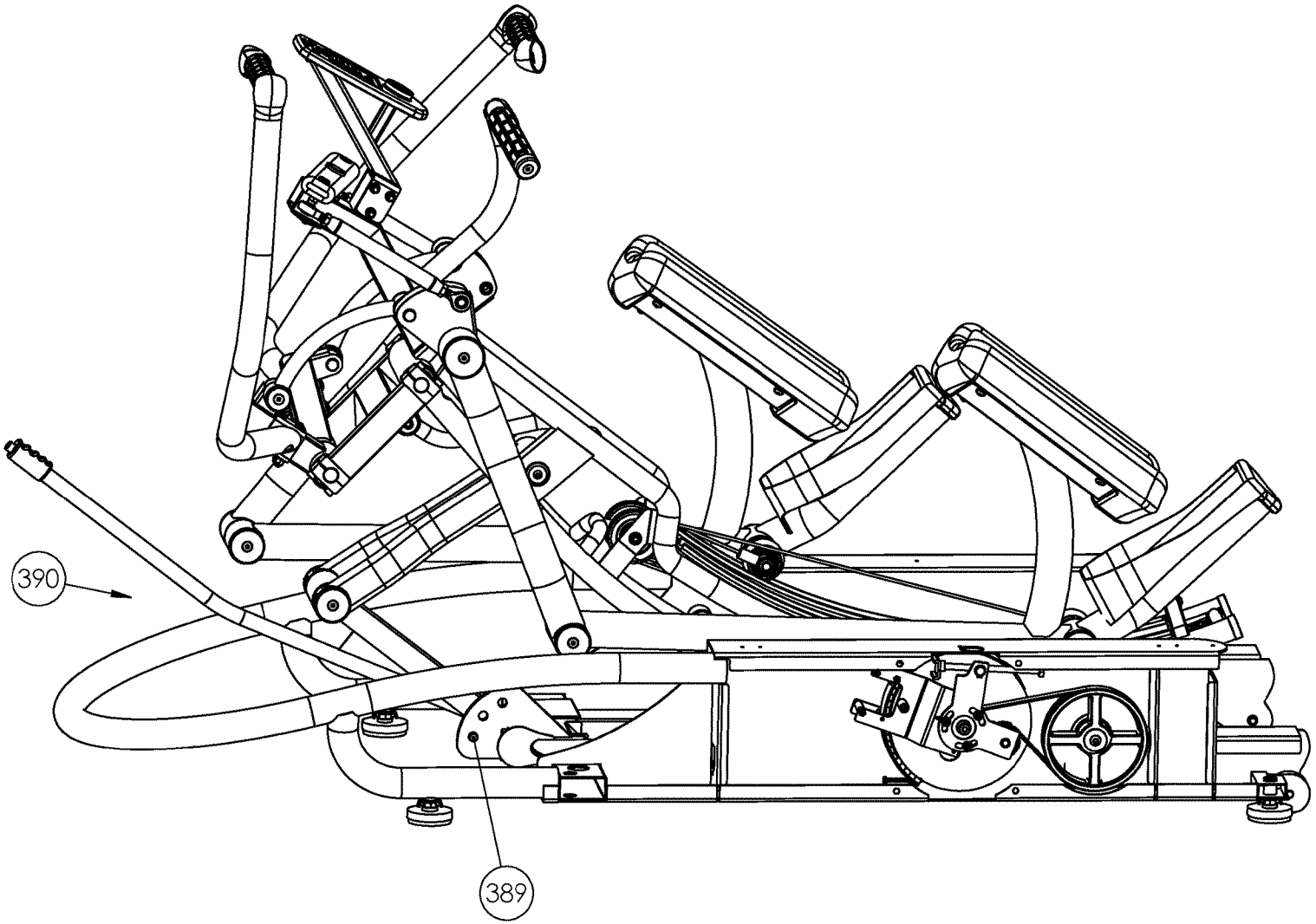
FIG. 38 is a left side view of the invention in a mid angle position with a manual lever arm angle adjustment mechanism.
Figure 39:
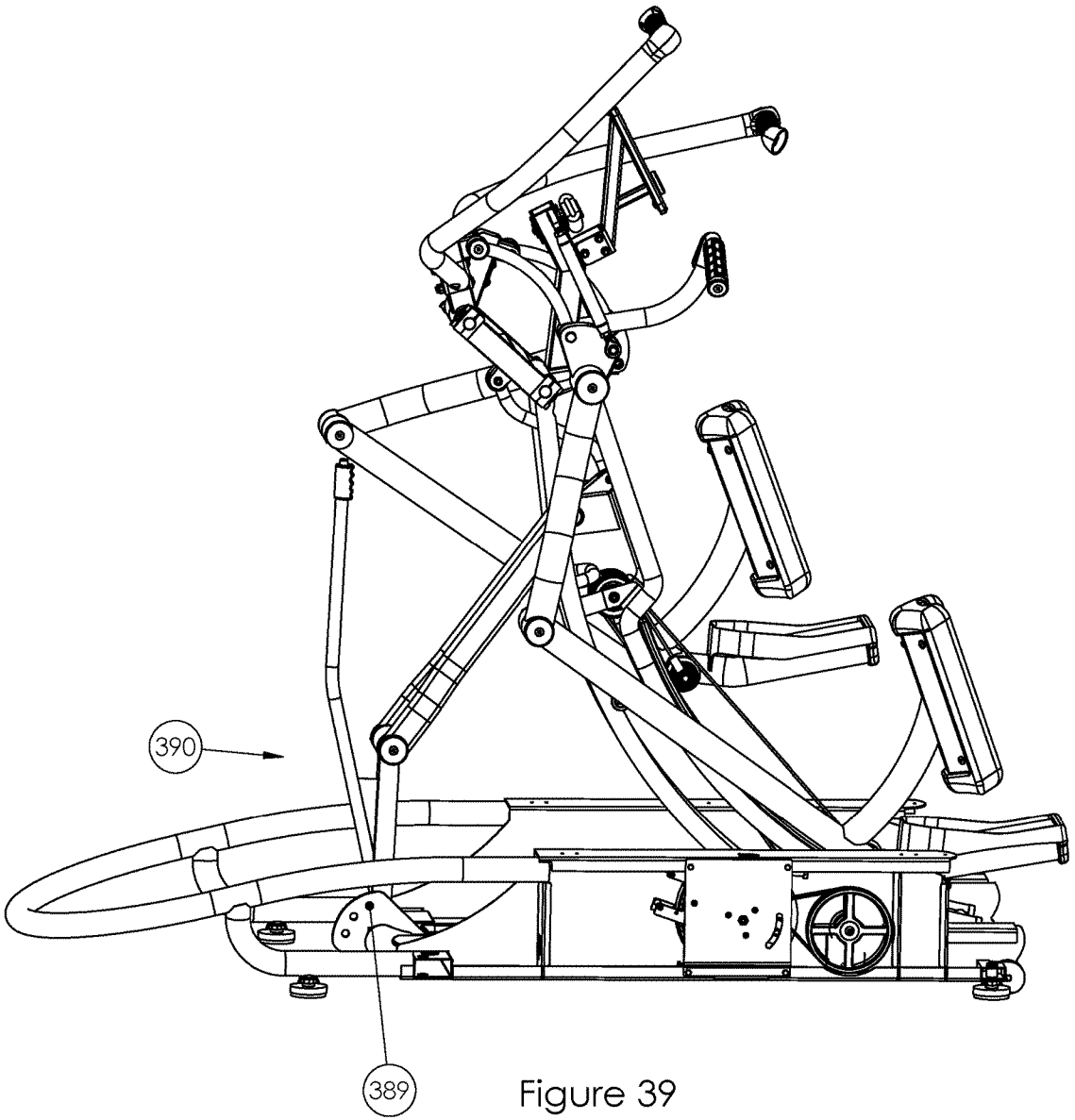
FIG. 39 is a left side view of the invention in a higher angle position with a manual lever arm angle adjustment mechanism.
Figure 40:
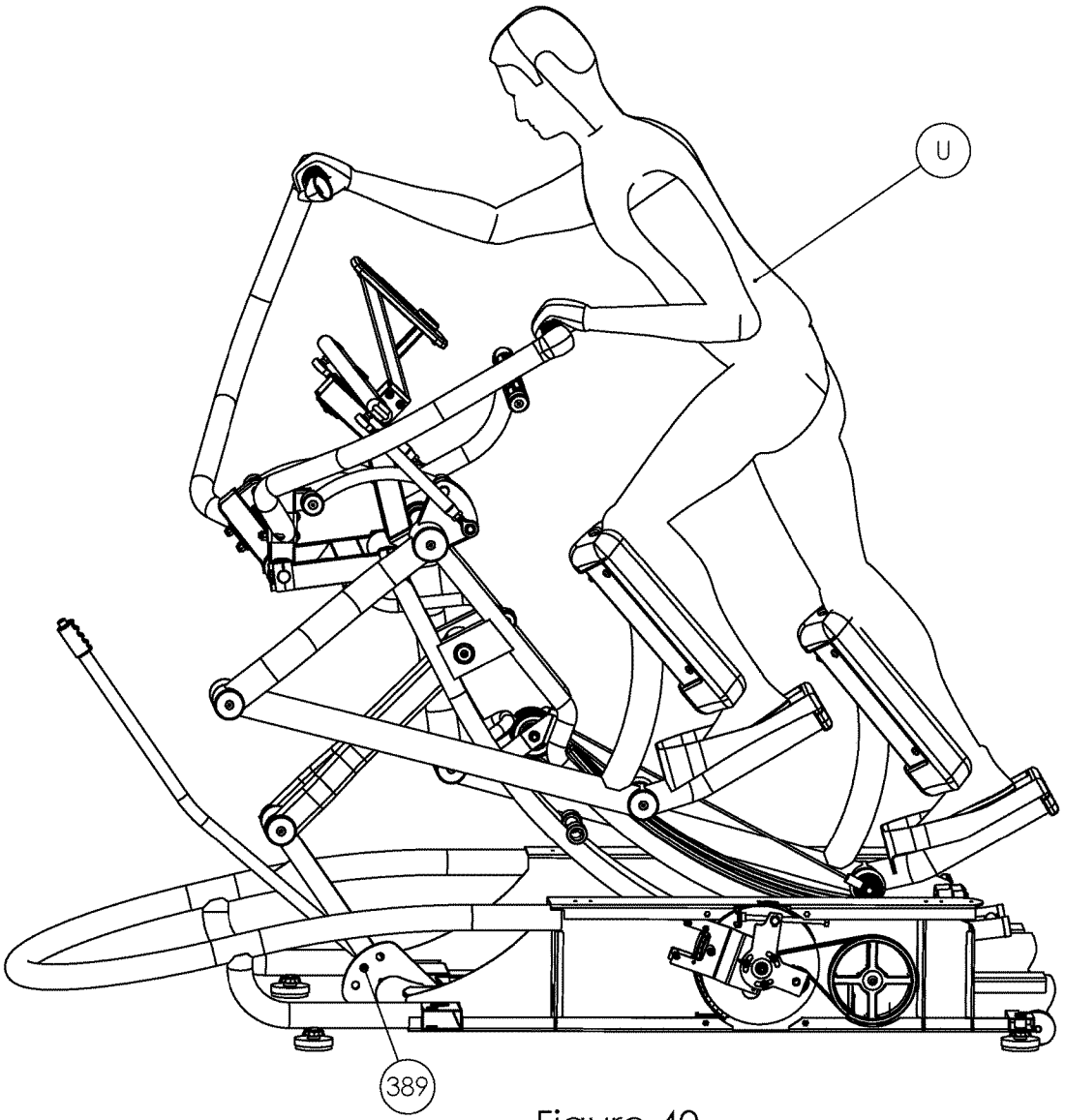
FIG. 40 is a left side view of the invention in a mid angle position with a manual lever arm angle adjustment mechanism and a user operating the machine.

Manual lever arm angle adjustment assembly 390 is best illustrated in FIG. 37 described in detail as follows:

A first end of first angle adjustment linkage bar 394 is pivotably connected to stationary base frame 305 with angle adjustment linkage lower pivot 396 and a second end of first angle adjustment linkage bar 394 is pivotably connected to first ends of left and right second angle adjustment linkage bars 395 with angle adjustment linkage mid pivot 397 and second ends of left and right second linkage bars 395 are pivotably connected to movable user support frame 310 at angle adjustment linkage upper pivot 398. A first end of an elongated angle adjustment lever arm 391 is rigidly connected to first angle adjustment linkage bar 394 such that they move as one and an angle adjustment lever arm hand grip 392 is mounted proximal to a second end of angle adjustment lever arm 391 and an angle adjustment lever arm lock release switch 393 is located in operable proximity to angle adjustment lever arm hand grip 392. An angle adjustment lever arm locking plate 399 with multiple locking holes that are configured in an arcing pattern is rigidly connected to stationary base frame 305 proximal to the first end of angle adjustment linkage bar 394 and an angle adjustment lever arm locking pin assembly 395 is operatively mounted on a first end of first angle adjustment linkage bar 394 such that angle adjustment lever arm locking pin 395 is in operative alignment with the locking holes in angle adjustment lever arm locking plate 399. As illustrated, angle adjustment lever arm locking pin 395 is connected to and moves with first angle adjustment linkage bar 394 and angle adjustment arm locking pin 395 is operatively engaged with angle adjustment lever arm lock release switch 393. An example of this operative locking assembly would be a spring-loaded detent pin that is contracted and extended with a release switch. However, various components and configurations could be used to lock angle adjustment lever arm 391 and first angle adjustment linkage bar 394 into position on angle adjustment lever arm locking plate 399 and achieve the same results of locking manual lever arm angle adjustment assembly 390 and movable user support frame 310 into the preferred exercise position.

To adjust manual angle adjustment assembly 390 to a higher angle position, user U would stand in front of machine 300 and grasp angle adjusting lever arm hand grip 392 and activate angle adjustment lever arm lock release switch 393 to withdraw angle adjustment lever arm locking pin 395 from angle adjustment lever arm locking plate 399 to unlock angle adjustment lever arm 391. User U would next push angle adjusting lever arm 391 rearward, which causes first angle adjustment linkage bar 394 to pivot about angle adjustment linkage lower pivot 396 and second angle adjustment linkage bars 395 to pivot about angle adjustment linkage upper pivot 398 such that angle adjustment linkage mid pivot 397 move towards the rear of stationary base frame 105 and angle adjustment linkage upper pivot 298 moves upward until movable user support frame 310 is at the desired angle position. User U would next release angle adjustment lever arm lock release switch 393 to insert angle adjustment lever arm locking pin 395 into angle adjustment lever arm locking plate 399 to lock angle adjustment lever arm 391 into position.

To adjust manual angle adjustment assembly 390 to a lower angle position, user U would stand in front of machine 300 and grasp angle adjusting lever arm hand grip 392 and activate angle adjustment lever arm lock release switch 393 to withdraw angle adjustment lever arm locking pin 395 from angle adjustment lever arm locking plate 399 to unlock angle adjustment lever arm 391. User U would next pull angle adjusting lever arm 391 forward, which causes first angle adjustment linkage bar 394 to pivot about angle adjustment linkage lower pivot 396 and second angle adjustment linkage bars 395 to pivot about angle adjustment linkage upper pivot 398 such that angle adjustment linkage mid pivot 397 move towards the front of stationary base frame 105 and angle adjustment linkage upper pivot 298 moves downward until movable user support frame 310 is at the desired angle position. User U would next release angle adjustment lever arm lock release switch 393 to insert angle adjustment lever arm locking pin 395 into angle adjustment lever arm locking plate 399 to lock angle adjustment lever arm 391 into position.

User U can operate machines 100, 200, or 300 at multiple forward leaning angles to achieve a variety of concurrent pushing and pulling upper and lower body exercises including simulated ladder climbs, hiking, stair climbing, jogging, sprinting, and bear crawls. Machine 100 allows user U to change the angle of movable user support frame 110 with an electric actuator or other electrical device using controls located on the exercise information console 500 or other locations on machine 100 convenient to user U. Machine 200 does not require electricity to operate and the mechanical features of machine 200 can constantly pivot movable user support frame 210 about stationary base frame 205 to move movable support frame 210 through its full range of reciprocal up and down motion or machine 200 can be operated such that movable user support frame 210 remains at a fixed angle position by disengaging clutch assembly 280 which disengages the mechanical features of machine 200 that cause movable user support frame 210 to move and change angle position. Clutch assembly 280 can be engaged at any time during operation of machine 200 to resume movement and angle change of movable user support frame 210. Machine 300 does not require electricity and has far few components than machine 100 or 200. Machine 300 requires user U to manually adjust the angle of movable user support 310 and lock it into position with angle adjustment assembly 390 prior to entering and operating machine 300. To change the angle of movable user support 310 after user U has begun exercising, user U must stop exercising and exit machine 300 to manually adjust the angle of movable user support 310 to the new angle of exercise position and then reenter machine 300 to resume exercising.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

U User
1 Machine
5 Stationary base frame
6 Angle adjusting device lower pivot
7 Angle adjusting device
8 Angle adjusting shaft
9 Movable frame foot
10 Movable frame
11 Lower body support rail
12 Movable frame base pivot
13 Angle adjusting device upper pivot
15 Angle adjusting support arm assembly
16 Angle adjusting support arm
17 Angle adjusting support arm cross brace
18 Angle adjusting support arm wheels
19 Angle adjusting support arm pivot
20 Lower body user support assembly
21 Foot platform
22 Lower body user support frame
23 Shin pad
24 First Lower body user support linkage bar
25 Lower body user support linkage pivot
26 Second lower body user support linkage bar
29 Lower body user support frame pivot
30 Upper body user support assembly
31 Upper body user support lever arm
32 Upper body user support adjusting shaft
33 Upper body user support grip handle
34 Upper body user support pivot
35 Upper body user support linkage connection flange
36 Upper body user support linkage bar lower pivot
37 Upper body user support linkage bar
38 Upper body user support linkage bar upper pivot
40 Rotational resistance mechanism
41 Rotational resistance axle
42 Rotational resistance axle connection flange
50 Resistance drive assembly
51 Upper resistance drive sprocket
52 Lower resistance drive sprocket
53 One-way clutch
4 Flexible drive member
60 Rocker arm linkage assembly
61 Rocker arm
62 Rocker arm pivot
63 Rocker arm linkage lower pivot
64 Rocker arm linkage upper pivot
65 Rocker arm linkage bar
70L Left linkages connection hub
70R Right linkages connection hub
71L Left linkages connection hub flange
71R Right linkages connection hub flange
72 Linkages connection hub axle
80 Traveling member assembly
81 Traveling member inner frame plate
82 Traveling member outer frame plate
83 Traveling member wheels
84 Traveling member axle
100 Electrical angle adjusting machine
105 Stationary base frame
107 Angle adjusting actuator
110 Movable user support frame
112 Movable user support frame base pivot
113 Angle adjusting actuator upper pivot
114 Angle adjusting actuator lower pivot
121 Foot platform
123 Shin pad
124 First lower body user support linkage bar
125 Lower body user support linkage pivot
126 Second lower body user support linkage bar
131 Upper body user support lever arm
133 Upper body user support grip handle
134 Upper body user support pivot
137 Upper body user support linkage bar
139 Stationary grip handle
140 Resistance assembly
141 Resistance drive axle
143 Resistance flywheel drive belt
144 Resistance flywheel resistance magnet
145 Resistance flywheel
146 Resistance drive axle coupling
147 Resistance flywheel drive pulley
148 Resistance drive axle bearing
150 Resistance drive assembly
151 Resistance drive cable guide pulley
153 One-way clutch resistance drive cable spool
154 Resistance drive cable
155 Resistance drive cable tensioner pulley
156 Resistance drive cable tensioner pulley springs
157 Resistance drive cable connector
158 Resistance drive cable tensioner pulley housing
160 Rocker arm linkage assembly
161 Rocker arm
162 Rocker arm pivot
163 Rocker arm linkage bar lower pivot
164 Rocker arm linkage bar upper pivot
165 Rocker arm linkage bar
170 Linkages connection hub

171 Linkages connection hub flange
175 Upper body user support height adjustment lever
176 Upper body user support height adjustment lever pivot
177 Upper body user support height adjustment lever push rod
178 Upper body user support height adjustment lever push rod upper pivot
179 Upper body user support height adjustment lever push rod lower pivot
183 Lower body user support wheel
185 Lower body user support wheel track
190 Angle adjustment assembly
191 Angle adjustment actuator
192 Angle adjustment actuator outer tube
193 Angle adjustment actuator inner shaft
194 First angle adjustment linkage bar
195 Second angle adjustment linkage bar
196 Angle adjustment linkage lower pivot
197 Angle adjustment linkage mid pivot
198 Angle adjustment linkage upper pivot
200 Manual gear drive angle adjusting machine
201 Angle adjusting drive assembly
202 Angle adjusting drive axle
203 First angle adjusting drive linkage bar
204 Second angle adjusting drive linkage bar
205 Stationary base frame
206 Second angle adjust drive link bar connection flange
207 Angle adjusting drive first pivot
208 Angle adjusting drive second pivot
209 Angle adjusting drive third pivot
210 Movable user support frame
211 Angle adjusting drive guide axle
212 Movable user support frame base pivot
213 First gear drive pulley
214 First gear drive axle
215 Manual gear drive angle adjusting assembly
216 Gear drive pulley belt
217 Second gear drive pulley
218 Second gear drive axle
219 First drive gears
220 Second drive gears
221 Foot platform
223 Shin pad
224 First lower body user support linkage bar
225 Lower body user support linkage pivot
226 Second lower body user support linkage bar
231 Upper body user support lever arm
233 Upper body user support grip handle
234 Upper body user support pivot
237 Upper body user support linkage bar
238 Upper body user support linkage bar pivot
239 Stationary grip handle
240 Resistance assembly
241 Resistance drive axle
243 Resistance flywheel drive belt
244 Resistance flywheel resistance magnet
245 Resistance flywheel
246 Resistance drive axle coupling
247 Resistance flywheel drive pulley
248 Resistance drive axle bearing
250 Resistance drive assembly
251 Resistance drive cable guide pulley
253 One-way clutch resistance drive cable spool
254 Resistance drive cable
255 Resistance drive cable tensioner pulley
256 Resistance drive cable tensioner pulley springs
257 Resistance drive cable connector
258 Resistance drive cable tensioner pulley housing
260 Rocker arm linkage assembly
261 Rocker arm
262 Rocker arm pivot
263 Rocker arm linkage bar lower pivot
264 Rocker arm linkage bar upper pivot
265 Rocker arm linkage bar
270 Linkages connection hub
271 Linkages connection hub flange
275 Upper body user support height adjustment lever
276 Upper body user support height adjustment lever pivot
277 Upper body user support height adjustment lever push rod
278 Upper body user support height adjustment lever push rod upper pivot
279 Upper body user support height adjustment lever push rod lower pivot
280 Clutch assembly
283 Lower body user support wheel
285 Lower body user support wheel track
286 Clutch drive axle
287 Clutch engagement fork
288 Clutch engagement linkage assembly
289 Clutch
290 Angle adjustment assembly
291 Clutch engagement switch
294 First angle adjustment linkage bar
295 Second angle adjustment linkage bar
296 Angle adjustment linkage lower pivot
297 Angle adjustment linkage mid pivot
298 Angle adjustment linkage upper pivot
300 Manual lever arm angle adjustment machine
305 Stationary base frame
310 Movable user support frame
389 Angle adjustment lever arm locking pin
390 Manual lever arm angle adjustment assembly
391 Angle adjustment lever arm
392 Angle adjustment lever arm hand grip
393 Angle adjustment lever arm lock release switch
394 First angle adjustment linkage bar
395 Second angle adjustment linkage bars
396 Angle adjustment linkage lower pivot
397 Angle adjustment linkage mid pivot
398 Angle adjustment linkage upper pivot
399 Angle adjustment lever arm locking plate
500 Exercise information console

What is claimed is:

1. An upper and lower body push and pull exercise machine with a rotatable one direction resistance mechanism and adjustable angle comprising:

a) a movable user support frame that is adjustable relative to a floor surface on which the exercise machine is located;

b) an angle adjusting mechanism operatively engaged with the movable user support frame;

c) a movable left side lower body user support comprising a foot support platform and a shin support pad operatively connected to the movable user support frame for movement in a reciprocating arcing path and a movable right side lower body user support comprising a foot support platform and a shin support pad operatively connected to the movable user support frame for movement in a reciprocating arcing path;

d) a movable left side upper body user support comprising a gripping handle operatively connected to the movable user support frame for movement in a reciprocating arcing path and a movable right side upper body user support comprising a gripping handle operatively connected to the movable user support frame for movement in a reciprocating arcing path;

e) the rotatable one direction resistance mechanism being operatively connected to the upper and lower body user supports for creating resistance to the exercise motion of the movable upper and lower body user supports;

f) a resistance mechanism drive assembly operatively connecting all of the movable user supports to the rotatable one direction resistance mechanism;

g) a linkage assembly operatively connected to all of the movable user supports, wherein the linkage assembly comprises a first linkage assembly connecting the movable left side lower body user support to the movable left side upper body user support and a second linkage assembly connecting the movable right side lower body user support to the movable right side upper body user support; and h) a centrally pivoted rocker arm mounted on the movable user support frame, wherein the first linkage assembly and the second linkage assembly are pivotally connected to opposing ends of the centrally pivoted rocker arm such that the rocker arm synchronizes the motion of the movable left side lower body user support, the movable left side upper body user support, the movable right side lower body user support and the movable right side upper body user support.

2. The upper and lower body push and pull exercise machine according to claim 1, wherein the angle adjusting mechanism is manually operated.

3. The upper and lower body push and pull exercise machine according to claim 1, wherein the gripping handles of the movable upper body user supports are mounted on pivoting levers that are operatively connected to the movable user support frame.

4. The upper and lower body push and pull exercise machine according to claim 1, wherein the reciprocating arcing path of motion of the movable upper body user supports and the movable lower body user supports are defined by the mechanical components of the machine, and a range of movement of the arcing path of motion of the movable upper body user supports and the movable lower body user supports is controllable by a range of movement of the exercise motion of the user.

5. An upper and lower body push and pull exercise machine with a rotatable one direction resistance mechanism and adjustable angle comprising:

a) a movable user support frame that is adjustable relative to a floor surface on which the exercise machine is located;

b) an angle adjusting mechanism operatively engaged with the movable user support frame;

c) a movable left side lower body user support comprising a foot support platform and a shin support pad operatively connected to the movable user support frame for movement in a reciprocating arcing path and a movable right side lower body user support comprising a foot support platform and a shin support pad operatively connected to the movable user support frame for movement in a reciprocating arcing path;

d) a movable left side upper body user support comprising a gripping handle operatively connected to the movable user support frame for movement in a reciprocating arcing path and a movable right side upper body user support comprising a gripping handle operatively connected to the movable user support frame for movement in a reciprocating arcing path;

e) the rotatable one direction resistance mechanism being operatively connected to the upper and lower body user supports for creating resistance to the exercise motion of the movable upper and lower body user supports; and f) a resistance mechanism drive assembly operatively connecting all of the movable user supports to the rotatable one direction resistance mechanism, wherein the movable lower body user supports roll or slide on curved tracks.

6. An upper and lower body push and pull exercise machine with a rotatable one direction resistance mechanism and adjustable angle comprising:

a) a movable user support frame that is adjustable relative to a floor surface on which the exercise machine is located;

b) an angle adjusting mechanism operatively engaged with the movable user support frame;

c) a movable left side lower body user support comprising a foot support platform and a shin support pad operatively connected to the movable user support frame for movement in a reciprocating arcing path and a movable right side lower body user support comprising a foot support platform and a shin support pad operatively connected to the movable user support frame for movement in a reciprocating arcing path;

d) a movable left side upper body user support comprising a gripping handle operatively connected to the movable user support frame for movement in a reciprocating arcing path and a movable right side upper body user support comprising a gripping handle operatively connected to the movable user support frame for movement in a reciprocating arcing path;

e) the rotatable one direction resistance mechanism being operatively connected to the upper and lower body user supports for creating resistance to the exercise motion of the movable upper and lower body user supports; and f) a resistance mechanism drive assembly operatively connecting all of the movable user supports to the rotatable one direction resistance mechanism, wherein the rotatable one direction resistance mechanism comprises at least one rotatable flywheel, at least one resistance axle, and at least one resistance component to create a braking force to the rotational motion of the flywheel, wherein the resistance mechanism drive assembly comprises at least one drive component operatively connecting the movable upper and lower body user supports to the resistance axle of the rotatable one direction resistance mechanism and at least two one-way clutches operatively engaged with the resistance axle for propelling the rotatable flywheel in one direction only.

* * * * *